US012607125B2

(12) United States Patent
Shiraishi et al.

(10) Patent No.: US 12,607,125 B2
(45) Date of Patent: Apr. 21, 2026

(54) BLADE MEMBER AND STRUCTURAL MEMBER

(71) Applicant: NIKON CORPORATION, Tokyo (JP)

(72) Inventors: Masayuki Shiraishi, Kumagaya (JP); Takahiro Kurashima, Tokyo (JP); Baku Ogasawara, Kumagaya (JP)

(73) Assignee: NIKON CORPORATION, Tokyo (JP)

( * ) Notice: Subject to any disclaimer, the term of this patent is extended or adjusted under 35 U.S.C. 154(b) by 0 days.

(21) Appl. No.: 18/275,367

(22) PCT Filed: Feb. 5, 2021

(86) PCT No.: PCT/JP2021/004308
§ 371 (c)(1),
(2) Date: Aug. 21, 2023

(87) PCT Pub. No.: WO2022/168262
PCT Pub. Date: Aug. 11, 2022

(65) Prior Publication Data
US 2024/0102389 A1 Mar. 28, 2024

(51) Int. Cl.
*F01D 5/14* (2006.01)

(52) U.S. Cl.
CPC ..... *F01D 5/141* (2013.01)

(58) Field of Classification Search
CPC ..... F01D 5/14; F01D 5/141; F01D 5/145
See application file for complete search history.

(56) References Cited

U.S. PATENT DOCUMENTS

| | | | | |
|---|---|---|---|---|
| 5,114,099 | A | 5/1992 | Gao | |
| 5,133,519 | A | 7/1992 | Falco | |
| 8,460,779 | B2 * | 6/2013 | Gupta | F15D 1/004 428/167 |
| 9,149,692 | B2 * | 10/2015 | Shimahara | A63B 53/04 |
| 9,504,885 | B2 * | 11/2016 | Ban | A63B 53/0466 |
| 10,465,520 | B2 * | 11/2019 | Vandeputte | B23K 15/0086 |
| 10,465,525 | B2 * | 11/2019 | Jones | B29C 64/153 |

(Continued)

FOREIGN PATENT DOCUMENTS

| | | |
|---|---|---|
| EP | 2 283 169 B1 | 5/2014 |
| EP | 3475532 B1 | 4/2020 |

(Continued)

OTHER PUBLICATIONS

Apr. 6, 2021 Written Opinion issued in International Patent Application No. PCT/JP2021/004308.

(Continued)

*Primary Examiner* — Nathaniel E Wiehe
*Assistant Examiner* — Jason G Davis
(74) *Attorney, Agent, or Firm* — Oliff PLC

(57) ABSTRACT

A blade member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction, the third groove structure extends along a third direction that is different from the first and second directions, and is formed between one first groove structure and one second groove structure.

14 Claims, 25 Drawing Sheets

(56) References Cited

U.S. PATENT DOCUMENTS

| | | | | |
|---|---|---|---|---|
| 10,815,793 | B2 * | 10/2020 | Styborski | F01D 5/188 |
| 10,851,817 | B2 * | 12/2020 | Van Nesselrooij | F15D 1/003 |
| 2006/0269419 | A1 | 11/2006 | Downs et al. | |
| 2009/0017260 | A1 | 1/2009 | Kulkarni et al. | |
| 2011/0262705 | A1 | 10/2011 | Gupta et al. | |
| 2012/0010016 | A1 | 1/2012 | Solheim et al. | |
| 2013/0183166 | A1 | 7/2013 | Lacy | |
| 2013/0288820 | A1 | 10/2013 | Shimahara | |
| 2017/0159442 | A1 * | 6/2017 | Velazquez, Jr. | F01D 5/288 |
| 2018/0126230 | A1 * | 5/2018 | Tassistro | A63B 53/04 |
| 2019/0168862 | A1 | 6/2019 | Riera et al. | |
| 2019/0383150 | A1 | 12/2019 | Styborski et al. | |
| 2021/0231142 | A1 | 7/2021 | Smith et al. | |

FOREIGN PATENT DOCUMENTS

| | | | |
|---|---|---|---|
| JP | S60-39702 | U | 3/1985 |
| JP | H07-189985 | A | 7/1995 |
| JP | 2006-329202 | A | 12/2006 |
| JP | 2013-144980 | A | 7/2013 |
| JP | 2014-528275 | A | 10/2014 |
| JP | 2021-113607 | A | 8/2021 |

OTHER PUBLICATIONS

Apr. 6, 2021 International Search Report issued in International Patent Application No. PCT/JP2021/004308.

Jul. 9, 2024 Office Action issued in Japanese Patent Application No. 2022-579260.

Nov. 4, 2024 Search Report issued in European Patent Application No. 21924657.6.

Dec. 24, 2024 Office Action issued in Japanese Patent Application No. 2022-579260.

Feb. 3, 2026 Office Action issued in Japanese Patent Application No. 2025-028807.

Mar. 10, 2026 Office Action issued in European Patent Application No. 21 924 657.6.

* cited by examiner

BLADE MEMBER AND STRUCTURAL MEMBER

TECHNICAL FIELD

The present invention relates to a technical field of a blade member and a structural member such as a turbine blade, for example.

BACKGROUND ART

A turbine blade that is used in a turbine is one example of a blade member and a structural member. For example, a Patent Literature 1 discloses a turbine blade on a surface of which a groove structure is formed. The blade member and the structural member are required to form the proper groove structure on the surface thereof.

CITATION LIST

Patent Literature

Patent Literature 1: EP2283169B

SUMMARY OF INVENTION

A first aspect provides a blade member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction, the third groove structure extends along a third direction that is different from the first and second directions, and is formed between one first groove structure of the plurality of first groove structures and one second groove structure of the plurality of second groove structures.

A second aspect provides a blade member on a surface of which a groove structure is formed, wherein the groove structure includes a plurality of first groove structures, a plurality of second groove structures, and a third groove structure, the plurality of first groove structures have a first wavy shape extending along a first direction and are formed to be arranged along a direction intersecting with the first direction at a first arrangement pitch, the plurality of second groove structures have a second wavy shape extending along a second direction and are formed to be arranged along a direction intersecting with the second direction at a second arrangement pitch that is different from the first arrangement pitch, the third groove structure has a third wavy shape extending along a third direction and is formed between one first groove structure of the plurality of first groove structures and one second groove structure of the plurality of second groove structures.

A third aspect provides a blade member on a surface of which a groove structure is formed, wherein the blade member includes: a first area in which a groove structure extending along a first direction is formed; a second area in which the groove structure is not formed; and a third area which is located between the first area and the second area and in which a groove structure connected to the groove structure in the first area is formed, a depth of the groove structure formed in the third area is shallower as it is closer to the second area from the first area.

A fourth aspect provides a structural member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction, the third groove structure extends along a third direction and is formed between one first groove structure of the plurality of first groove structures and one second groove structure of the plurality of second groove structures.

A fifth aspect provides a structural member on a surface of which a groove structure is formed, wherein the groove structure includes a plurality of first groove structures, a plurality of second groove structures, and a third groove structure, the plurality of first groove structures have a first wavy shape extending along a first direction and are formed to be arranged along a direction intersecting with the first direction at a first arrangement pitch, the plurality of second groove structures have a second wavy shape extending along a second direction and are formed to be arranged along a direction intersecting with the second direction at a second arrangement pitch, the third groove structure has a third wavy shape extending along a third direction and is formed between one first groove structure of the plurality of first groove structures and one second groove structure of the plurality of second groove structures.

A sixth aspect provides a structural member on a surface of which a groove structure is formed, wherein the groove structure includes a plurality of first groove structures, a plurality of second groove structures, and a third groove structure, the plurality of first groove structures have a first wavy shape extending along a first direction and are formed to be arranged along a direction intersecting with the first direction at a first arrangement pitch, the plurality of second groove structures extend along a second direction and are formed to be arranged along a direction intersecting with the second direction at a second arrangement pitch, the third groove structure has a third wavy shape extending along a third direction and is formed between one first groove structure of the plurality of first groove structures and one second groove structure of the plurality of second groove structures.

A seventh aspect provides a structural member on a surface of which a groove structure is formed, wherein the structural member includes: a first area in which a groove structure extending along a first direction is formed; a second area in which the groove structure is not formed; and a third area which is located between the first area and the second area and in which a groove structure connected to the groove structure in the first area is formed, a depth of the groove structure formed in the third area is shallower as it is closer to the second area from the first area.

DESCRIPTION OF EMBODIMENTS

Next, with reference to drawings, an example embodiment of a blade member, a structural member, a processing system and a processing method will be described. In the below-described description, the example embodiment of the blade member, the structural member, the processing system and the processing method will be described by using a processing system SYS that is configured to perform a processing operation using processing light EL. However, the present invention is not limited to the below-described embodiment.

Moreover, in the below described description, a positional relationship of various components that constitute the processing system SYS will be described by using an XYZ rectangular coordinate system that is defined by a X axis, a Y axis and a Z axis that are perpendicular to one another. Note that each of an X axis direction and a Y axis direction is assumed to be a horizontal direction (namely, a predetermined direction in a horizontal plane) and a Z axis direction is assumed to be a vertical direction (namely, a direction that is perpendicular to the horizontal plane, and substantially an up-down direction), for the purpose of simple description, in the below-described description. Moreover, rotational directions (in other words, inclination directions) around the X axis, the Y axis and the Z axis are referred to as a OX direction, a OY direction and a OZ direction, respectively. Here, the Z axis direction may be a gravity direction. An XY plane may be a horizontal direction.

(1) Configuration of Processing System SYS

Figure 1:
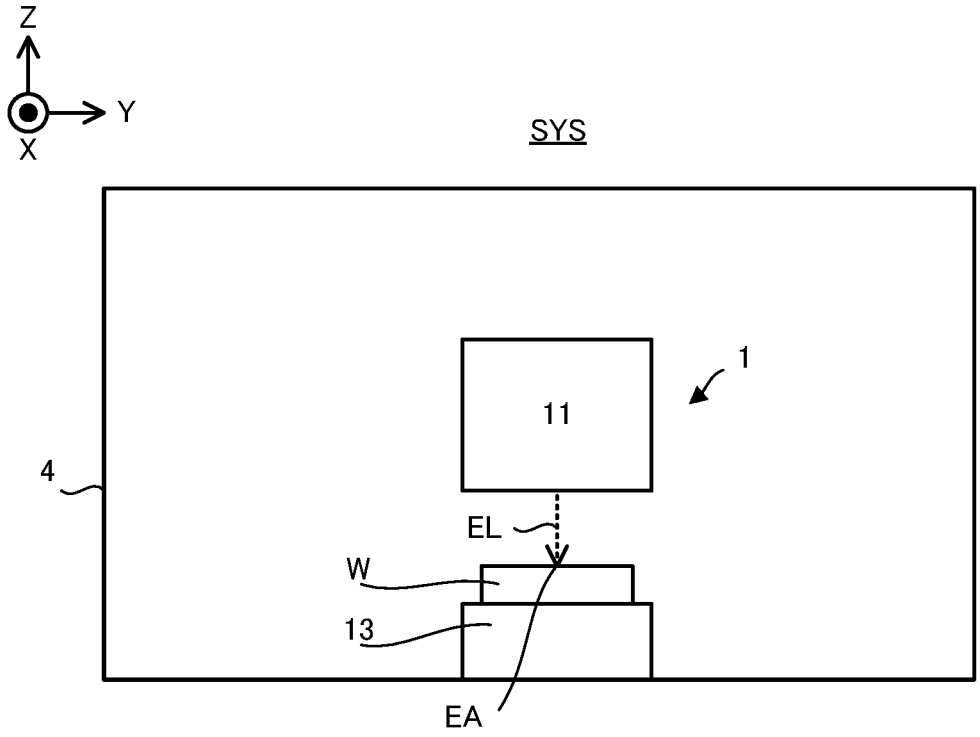
FIG. 1 is a cross-sectional view that schematically illustrates an entire configuration of a processing system in a present example embodiment.
Figure 2:
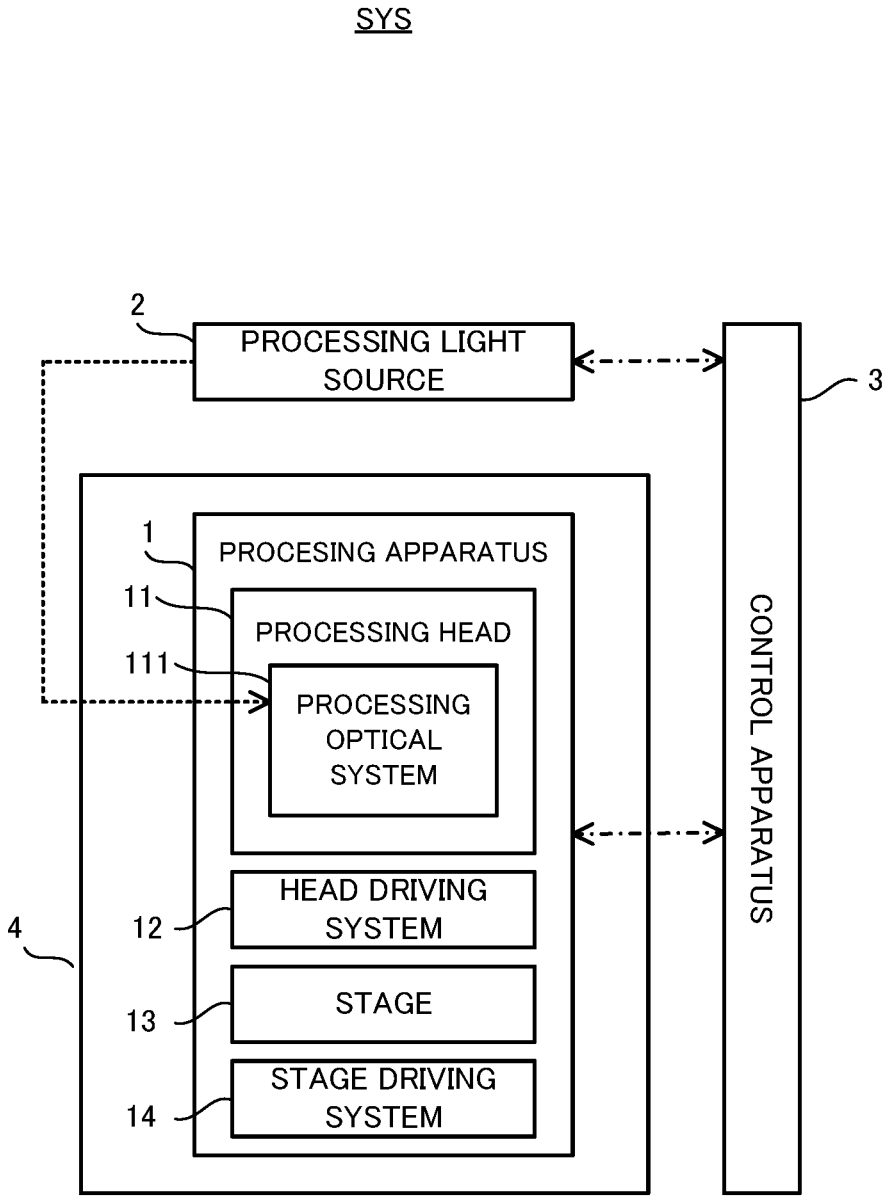
FIG. 2 is a system configuration diagram that illustrates a system configuration of the processing system in the present example embodiment.

Firstly, with reference to FIG. 1 and FIG. 2, a configuration of the processing system SYS in a present example embodiment will be described. FIG. 1 is a cross-sectional view that schematically illustrates the configuration of the processing system SYS in the present example embodiment. FIG. 2 is a system configuration diagram that illustrates a system configuration of the processing system SYS in the present example embodiment.

As illustrated in FIG. 1 and FIG. 2, the processing system SYS includes a processing apparatus 1, a processing light source 2, and a control apparatus 3. At least a part of the processing apparatus 1 is contained in an inner space in a housing 4. The inner space in the housing 4 may be purged by a purge gas such as a Nitrogen gas and so on, or may not be purged by the purge gas. The inner space in the housing may be vacuumed or may not be vacuumed. However, the processing apparatus 1 may not be contained in the inner space in the housing 4. Namely, the processing system SYS may not include the housing 4 for containing the processing apparatus 1.

The processing apparatus 1 is configured to process a workpiece W, which is a processing target object (it may be referred to as a base member), under the control of the control apparatus 3. The workpiece W may be a metal, may be an alloy (for example, a duralumin and the like), may be a semiconductor (for example, a silicon), may be a resin, may be a composite material such as a CFRP (Carbon Fiber Reinforced Plastic), a painting material (as one example, a painting layer that coats a base material), may be a glass or may be an object that is made from any other material, for example.

A surface of the workpiece W may be coated with a coat of material that is different from the workpiece W. In this case, a surface of the coat coating the surface of the workpiece W may be a surface that is to be processed by the processing apparatus 1. Even in this case, the processing apparatus 1 may be regarded to process the workpiece W (namely, process the workpiece W coated with the coat).

The processing apparatus 1 irradiates the workpiece W with processing light EL in order to process the workpiece W. The processing light EL may be any type of light, as long as the workpiece W is processed by irradiating the workpiece W with it. In the present example embodiment, an example in which the processing light EL is laser light will be described, however, the processing light EL may be light that is different from the laser light. Furthermore, a wavelength of the processing light EL may be any wavelength, as long as the workpiece W is processed by irradiating the workpiece W with it. For example, the processing light EL may be visible light, or may be invisible light (for example, at least one of infrared light, ultraviolet light, extreme ultraviolet light and the like). The processing light EL may include pulsed light (for example, pulsed light an ON time of which is equal to or shorter than pico-seconds). Alternatively, the processing light EL may not include the pulsed light. In other words, the processing light EL may be continuous light.

The processing apparatus 1 may perform a removal processing for removing a part of the workpiece W by irradiating the workpiece W with the processing light EL. In the present example embodiment, the processing apparatus 1 forms a riblet structure RB, which will be described later in detail with reference to FIG. 6, on the surface of the workpiece W by performing the removal processing. The riblet structure RB may include a structure by which a resistance (especially, at least one of a frictional resistance and a turbulent frictional resistance) of the surface of the workpiece W to fluid is reducible. The riblet structure RB may include a structure by which noise generated when the fluid relative moves relative to the surface of the workpiece W is reducible. Note that the fluid here means any medium (for example, at least one of gas and liquid) that flows relative to the surface of the workpiece W. For example, the medium may be referred to as the fluid in the case where the surface of workpiece W moves relative to the medium although the medium itself is static. Note that a state where the medium is static may mean a state where the medium does not move relative to a predetermined reference object (for example, a ground surface).

Figure 3:
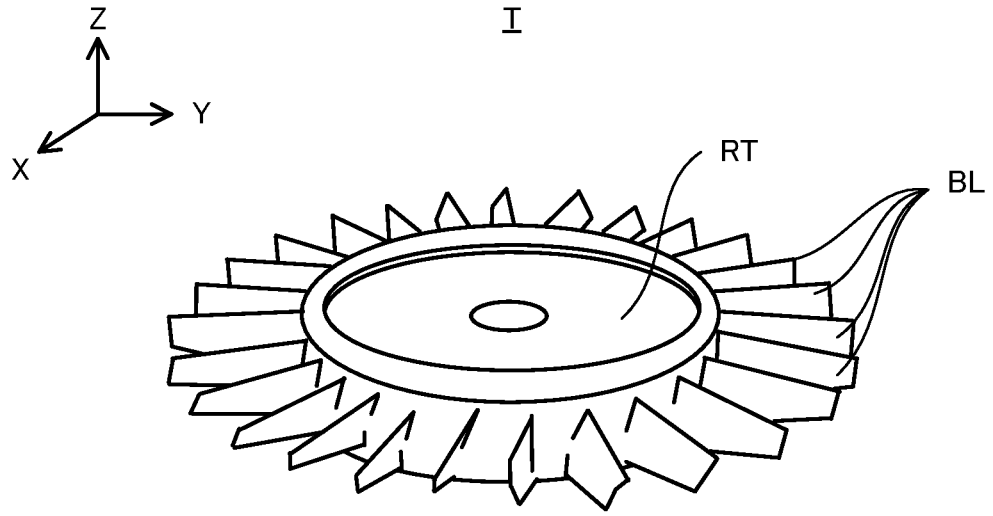
FIG. 3 is a perspective view that illustrates an exterior appearance of a turbine.
Figure 4:
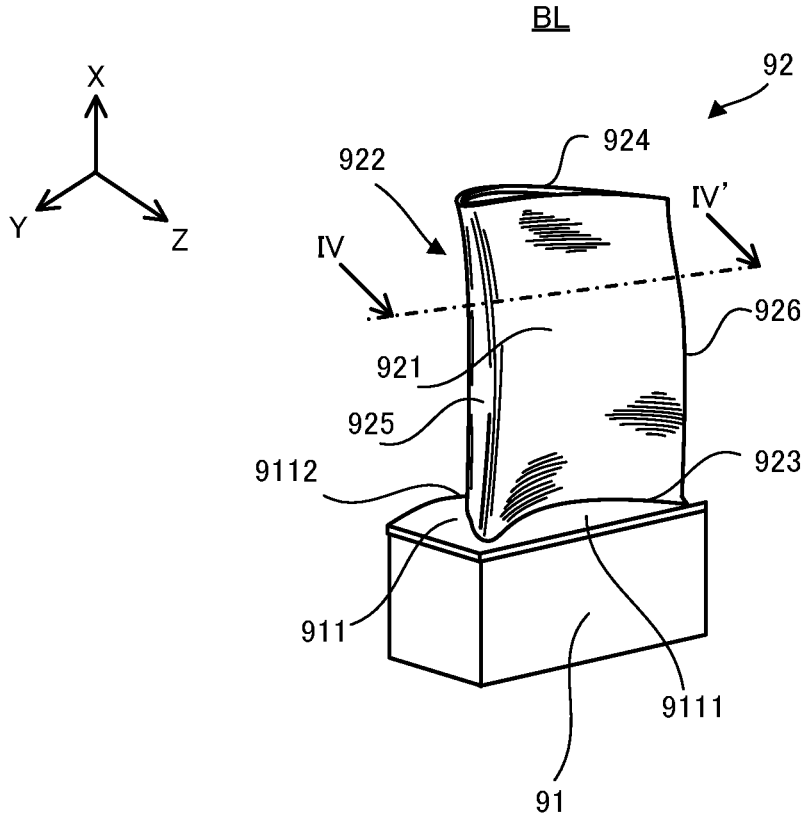
FIG. 4 is a perspective view that illustrates an exterior appearance of a turbine blade.

A turbine blade BL is one example of the workpiece W on which the riblet structure RB is formed. In this case, the processing apparatus 1 may form the riblet structure RB on a surface of the turbine blade BL by processing the turbine blade BL. The turbine blade BL is a member that is used in a turbine T that is one example of a fluid machinery. Specifically, the turbine blade BL is a blade-shaped member that serve as a blade of the turbine T. Namely, the turbine blade BL is a structure that serve as the blade of the turbine T. Thus, the turbine blade may be referred to as a blade member or a structural member. FIG. 3 and FIG. 4 illustrate one example of the turbine T. FIG. 3 is a perspective view that illustrates an exterior appearance of the turbine T. FIG. 4 is a perspective view that illustrates an exterior appearance of the turbine blade BL. As illustrated in FIG. 3 and FIG. 4, the turbine T includes a plurality of turbine blades BL. The turbine blade BL includes: a shank 91; and a blade body 92 that is connected to the shank 91 and that extends from the shank 91 outwardly along radial direction of the turbine T. At least one of the shank 91 and the blade body 92 may be formed by a single metal. At least one of the shank 91 and the blade body 92 may be formed by a plurality of metals. At least one of the shank 91 and the blade body 92 may be manufactured by an existing manufacturing method (for example, a manufacturing using at least one of a molding, a forging, an additive manufacturing, a removal processing and a machine processing). Alternatively, the shank 91 and the blade body 92, which are manufactured separately, may be jointed with each other by an existing coupling method (for example, a jointing method using at least one of a welding, a brazing, an adhesive bonding and so on). The plurality of shanks 91 which the plurality of turbine blades BL include, respectively, may be jointed with each other. The plurality of shanks 91 jointed with each other may constitute at least a part of a rotatable rotor RT. The rotor RT and the turbine blade BL may be formed integrally.

The blade body 92 extends outwardly from a platform 911 of the shank 91 along the radial direction of the turbine T. The platform 911 includes a positive pressure side platform 9111 and a negative pressure side platform 9112. The blade body 92 includes: a positive pressure surface 921; a negative pressure surface 922 that faces toward a side opposite to a side toward which the positive pressure surface 921 faces, a root part 923 that is jointed with the shank 91; and a tip part 924 that constitute an end part located at a side opposite to the root part 923. The blade body 92 further includes: a leading edge surface 925 that is located between the positive pressure surface 921 and the negative pressure surface 922; and a trailing edge surface 926 that is located between the positive pressure surface 921 and the negative pressure surface 922 at a side opposite to the leading edge surface 925. At least one surface of the positive pressure surface 921, the negative pressure surface 922, the leading edge surface 925 and the trailing edge surface 926 may include a curved surface. For example, in an example illustrated in FIG. 4, a surface of each of the positive pressure surface 921 and the negative pressure surface 922 includes the curved surface.

The turbine T is rotatable by using a flow of fluid that is supplied to the turbine T. Specifically, the fluid (for example, at least one of water, steam, air, and gas) is supplied to the turbine T. The fluid that has been supplied to the turbine T flows along the surface of each of the plurality of turbine blades BL. Thus, the turbine blade BL is used in the fluid. As a result, a kinetic energy of the fluid is converted into a rotational energy of the turbine T by the plurality of turbine blades BL. At least one of a steam turbine using the steam as the fluid and a gas turbine using the gas as the fluid is one example of the turbine T. At least one of a hydraulic turbine using the water as the fluid and a wind turbine using the air as the fluid is another example of the turbine T. Moreover, the turbine T may generate the flow of the fluid by the rotation thereof.

Figure 5:
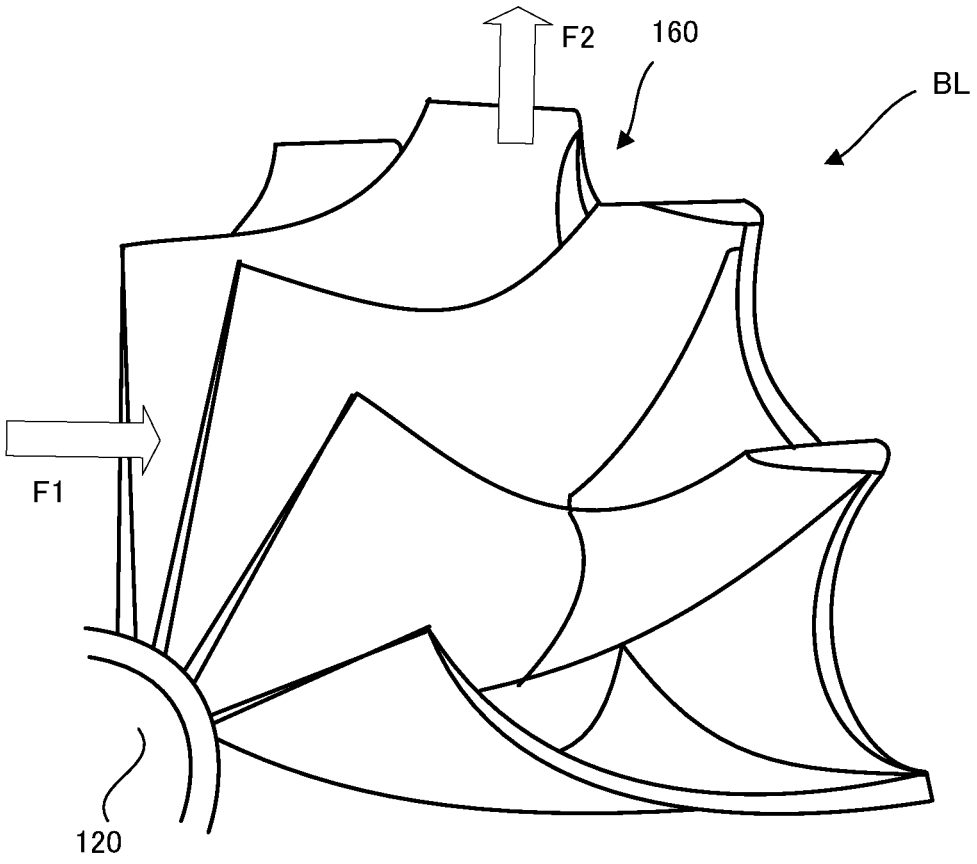
FIG. 5 is a perspective view that illustrates an exterior appearance of a turbine blade.

Incidentally, the turbine T illustrated in FIG. 3 and FIG. 4 includes an axial flow type turbine blades BL. Namely, the turbine T illustrated in FIG. 3 and FIG. 4 is an axial flow turbine. However, the turbine T may be a radial flow turbine (namely, a radial turbine), as illustrated in FIG. 5. In the radial flow turbine, the fluid enters the turbine blades BL parallel to a rotational axis 120 of the turbine blades BL, and flows out from an outlet portion 160 in a direction intersecting with the rotational axis 120, as indicated by arrows F1 and F2 in FIG. 5.

In the below-described description, for convenience of description, an example in which the workpiece W is the turbine blade BL will be described. However, the workpiece W is not limited to the turbine blade BL. Namely, the riblet structure RB may be formed on the workpiece W different from the turbine blade BL. Any member that relatively moves relative to the medium (for example, the fluid) is another example of the workpiece W on which the riblet structure RB is formed. For example, the workpiece W may be at least a part of a fan or propeller (for example, a member constituting a blade of the fan or the propeller). The fan is a member (typically, a rotatable body) that is used in a blower or the like and that forms a flow of gas. A propeller is a member (typically a rotatable body) that converts rotational force outputted from a hydraulic prime mover including at least one of an engine and a motor, for example, into driving force for a movable object including at least one of an airplane, a ship and the like. For example, the workpiece W may be at least a part of an impeller (for example, a member constituting a blade of the fan or the propeller). The impeller is, for example, a member that is used in a pump and that is rotatable so as to generate force to pump (alternatively, suck) the fluid by the pump. For example, the workpiece W may be at least a part of a stationary separator plate that is disposed around the impeller. For example, the workpiece W may be at least part of a body (for example, an airframe or a hull) of the movable object including at least one of the airplane, the ship and so on. For example, the workpiece W may be at least a part of a wing part (so-called wing) of a flying object such as the airplane.

The workpiece W may include a casing. Namely, the riblet structure RB may be formed on at least a part of the casing. For example, in a case where the casing is used in the turbine T, the riblet structure RB may be formed on at least a part of an inner wall surface of the casing that faces at least one of a containing space for containing the turbine blade BL (namely, a movable blade) and a passageway through which the fluid flows. For example, in a case where the casing is used in the pump, the riblet structure RB may be formed on at least a part of an inner wall surface of the casing that faces at least one of a containing space for containing the impeller and a passageway through which the fluid flows. For example, in a case where the casing is used to contain the fan of an air conditioner (for example, at least one of an indoor unit and an outdoor compressor unit constituting the air conditioner), the riblet structure RB may be formed on at least a part of an interior wall of the casing that faces at least one of a containing space for containing the fan, a passageway through which the fluid (for example, refrigerant) flows, and an air passage of the air conditioner.

The workpiece W may be a blade (namely, a blade) of a windmill used for wind power generation. Namely, the riblet structure RB may be formed on the blade of the windmill. Especially, the riblet structure RB may be formed on the blade of the windmill to generate clean energy (alternatively, natural or renewable energy) with low environmental impact. In this case, energy efficiency can be improved.

Alternatively, the processing apparatus 1 may perform an additive manufacturing for adding new structural object to the workpiece W by irradiating the workpiece W with the processing light EL, in addition to or instead of the removal processing. In this case, the processing apparatus 1 may form the above-described riblet structure RB on the surface of the workpiece W by performing the additive manufacturing. Alternatively, the processing apparatus 1 may perform a machine processing for processing the workpiece W by making a tool contact with the workpiece W, in addition to or instead of at least one of the removal processing and the additive manufacturing. In this case, the processing apparatus 1 may form the above-described riblet structure RB on the surface of the workpiece W by performing the machine processing.

The processing light EL is supplied to the processing apparatus 1 from the processing light source 2, which is configured to generate the processing light EL, through a non-illustrated light transmission member (for example, at least one of an optical fiber and a mirror). The processing apparatus 1 irradiates the workpiece W with the processing light EL supplied from the processing light source 2.

In order to process the workpiece W, the processing apparatus 1 includes: a processing head 11; a head driving system 12; a stage 13, and a stage driving system 14.

The processing head 1 irradiates the workpiece W with the processing light EL from the processing light source 2. In order to irradiate the workpiece W with the processing light EL, the processing head 11 includes a processing optical system 111. The processing head 11 irradiates the workpiece W with the processing light EL through the processing optical system 111. The processing optical system 111 may condenses the processing light EL onto the surface of the workpiece W, for example. The processing optical system 111 may control an optical characteristic of the processing light EL, for example. At least one of an intensity of the processing light EL, a temporal variation of the intensity of the processing light EL, a condensed position of the processing light EL, an incident angle of the processing light EL relative to the workpiece W, a shape of the processing light EL in an optical plane intersecting with an optical axis of the processing optical system 111, an intensity distribution of the processing light EL in the optical plane, and the number of pulses of the processing light (in a case where the processing light is the pulsed light) is one example of the optical characteristic of the processing light EL.

The head driving system 12 moves the processing head 11 along at least one of the X-axis direction, the Y-axis direction, and the Z-axis direction under the control of the control apparatus 3. Note that the head driving system 12 may move the processing head 11 along at least one of the θX direction, the θY direction, and the θZ direction, in addition to or instead of at least one of the X-axis direction, the Y-axis direction, and the Z-axis direction. When the processing head 11 moves, a positional relationship between the stage 13 (furthermore, the workpiece W placed on the stage 13) and the processing head 11 changes. Furthermore, when the positional relationship between the processing head 11 and each of the stage 13 and the workpiece W changes, an irradiation position of the processing light EL on the workpiece W changes.

The workpiece W is placed on the stage 13. The stage 13 may not hold the workpiece W placed on the stage 13. Namely, the stage 13 may not apply, to the workpiece W placed on the stage 13, a holding force for holding the workpiece W. Alternatively, the stage 13 may hold the workpiece W placed on the stage 13. Namely, the stage 13 may apply, to the workpiece W placed on the stage 13, the holding force for holding the workpiece W. For example, the stage 13 may hold the workpiece W by vacuum-suck and/or electrostatic-suck the workpiece W.

The stage driving system 14 moves the stage 13 under the control of the control apparatus 3. Specifically, the stage driving system 14 moves the stage 13 relative to the processing apparatus 1. For example, the stage driving system 14 may move the stage 13 along at least one of the X-axis direction, the Y-axis direction, the Z-axis direction, the OX direction, the OY direction, and the OZ direction under the control of the control apparatus 3. Note that moving the stage along at least one of the OX direction, the OY direction, and the OZ direction may be regarded to be equivalent to changing an attitude of the stage 13 (furthermore, the workpiece W placed on the stage 13) around at least one of the X-axis, the Y-axis, and the Z-axis. Alternatively, moving the stage along at least one of the OX direction, the OY direction, and the OZ direction may be regarded to be equivalent to rotating (or rotationally moving) the stage 13 around at least one of the X-axis, the Y-axis, and the Z-axis.

When the stage 13 moves, the positional relationship between the stage 13 (furthermore, the workpiece W placed on the stage 13) and the processing head 11 changes. Furthermore, when the positional relationship between the processing head 11 and each of the stage 13 and the workpiece W changes, the irradiation position of the processing light EL on the workpiece W changes.

The control apparatus 3 controls the operation of the processing system SYS. For example, the control apparatus 3 may generate processing control information for processing the workpiece W and control the processing apparatus 1 based on the processing control information so that the workpiece W is processed based on the generated processing control information.

The control apparatus 3 may include an arithmetic apparatus and a storage apparatus, for example. The arithmetic apparatus may include at least one of a CPU (Central Processing Unit) and a GPU (Graphical Processing Unit), for example. The control apparatus 3 serves as an apparatus for controlling the operation of the processing system SYS by means of the arithmetic apparatus executing a computer program. The computer program is a computer program that allows the control apparatus 3 (for example, the arithmetic apparatus) to execute (namely, to perform) a below described operation that should be executed by the control apparatus 3. Namely, the computer program is a computer program that allows the control apparatus 3 to function so as to make the processing system SYS execute the below described operation. The computer program executed by the arithmetic apparatus may be recorded in the storage apparatus (namely, a recording medium) of the control apparatus 3, or may be recorded in any recording medium (for example, a hard disk or a semiconductor memory) that is built in the control apparatus 3 or that is attachable to the control apparatus 3. Alternatively, the arithmetic apparatus may download the computer program that should be executed from an apparatus disposed at the outside of the control apparatus 3 through a network interface.

The control apparatus 3 may not be disposed in the processing system SYS, and may be disposed at the outside of the processing system SYS as a server or the like. In this case, the control apparatus 3 may be connected to the processing system SYS through a wired and/or wireless network (alternatively, a data bus and/or a communication line). A network using a serial-bus-type interface such as at least one of IEEE1394. RS-232x, RS-422, RS-423, RS-485 and USB may be used as the wired network. A network using a parallel-bus-type interface may be used as the wired network. A network using an interface that is compatible to Ethernet (a registered trademark) such as at least one of 10-BASE-T, 100BASE-TX or 1000BASE-T may be used as the wired network. A network using an electrical wave may be used as the wireless network. A network that is compatible to IEEE802.1x (for example, at least one of a wireless LAN and Bluetooth (registered trademark)) is one example of the network using the electrical wave. A network using an infrared ray may be used as the wireless network. A network using an optical communication may be used as the wireless network. In this case, the control apparatus 3 and the processing system SYS may be configured to transmit and receive various information through the network. Moreover, the control apparatus 3 may be configured to transmit information such as a command and a control parameter to the processing system SYS through the network. The processing system SYS may include a receiving apparatus that receives the information such as the command and the control parameter from the control apparatus 3 through the network. Alternatively, a first control apparatus that performs a part of the processing performed by the control apparatus 3 may be disposed in the processing system SYS and a second control apparatus that performs another part of the processing performed by the control apparatus 3 may be disposed at the outside of the processing system SYS.

Note that the recording medium recording therein the computer program that should be executed by the arithmetic apparatus may include an optical disc such as a CD-ROM, a CD-R, a CD-RW, a flexible disc, a MO, a DVD-ROM, a DVD-RAM, a DVD-R, a DVD+R, a DVD-RW, a DVD+RW and a Blu-ray (registered trademark), a magnetic disc such as a magnetic tape, an optical-magnetic disc, a semiconductor memory such as a USB memory, and another medium that is configured to store the program. The recording medium may include a device that is configured to record the computer program (for example, a device for a universal use or a device for an exclusive use in which the computer program is embedded to be executable in a form of at least one of a software, a firmware and the like). Moreover, each process or function included in the computer program may be realized by a logical process block that is realized in the control apparatus 3 by means of the control apparatus 3 (namely, a computer) executing the computer program, may be realized by a hardware such as a predetermined gate array (a FPGA, an ASIC) of the control apparatus 3, or may be realized in a form in which the logical process block and a partial hardware module that realizes an partial element of the hardware are combined.

(2) Riblet Structure RB

Figure 6A:
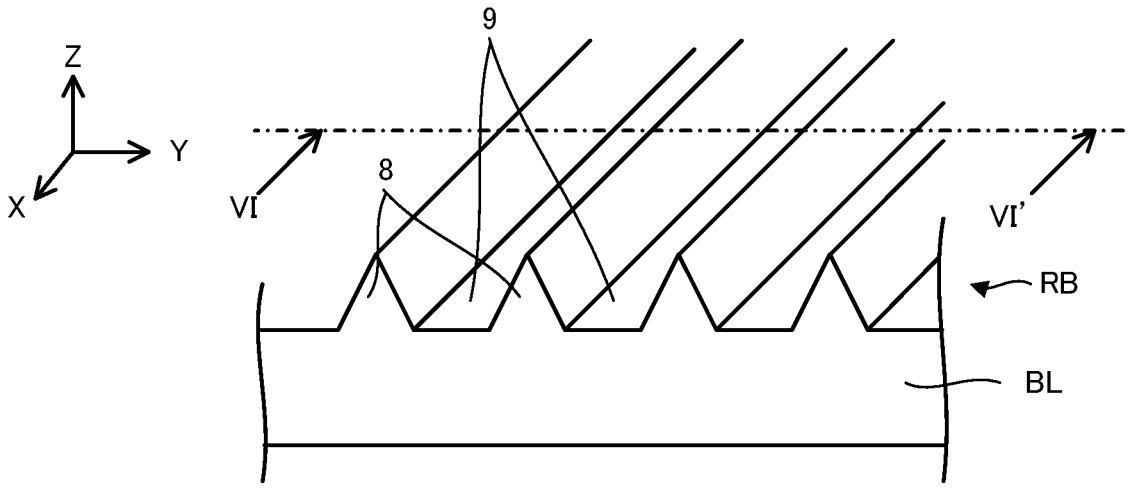
FIG. 6A is a perspective view that illustrates a riblet structure.
Figure 6B:
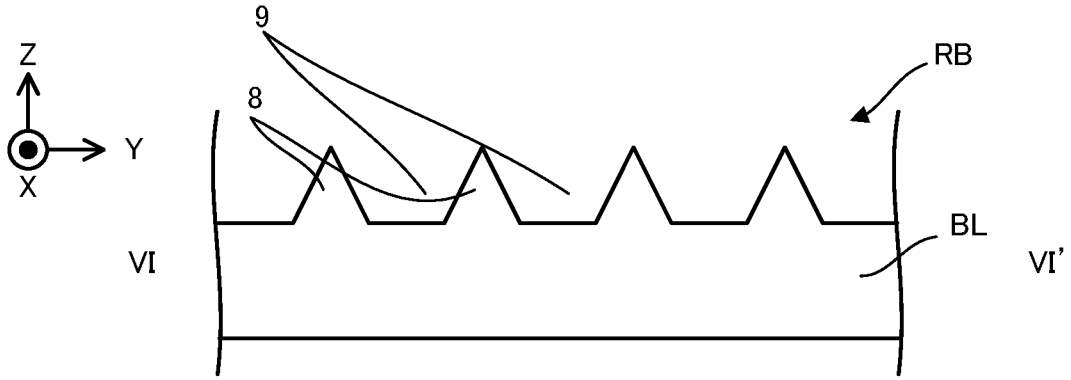
FIG. 6B is a cross-sectional view that illustrates the riblet structure (a VI-VI' cross-sectional view in FIG. 6A)
Figure 6C:
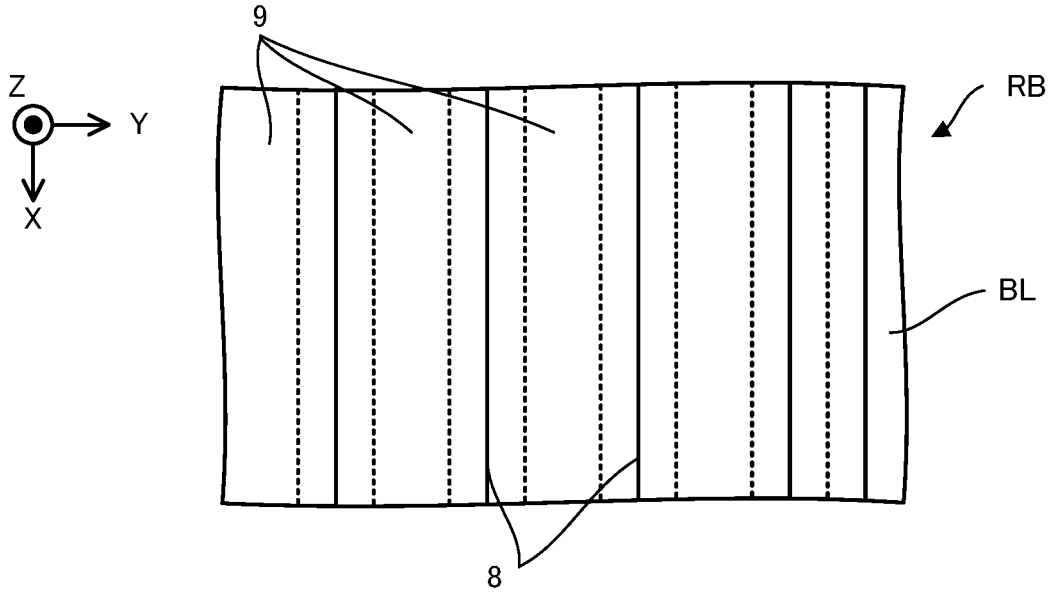
FIG. 6C is a top view that illustrates the riblet structure.

Next, with reference to FIG. 6A to FIG. 6B, the riblet structure RB formed on the workpiece W by the processing system SYS will be described. FIG. 6A is a perspective view that illustrates the riblet structure RB, FIG. 6B is a cross-sectional view that illustrates the riblet structure RB (a VI-VI' cross-sectional view in FIG. 6A), and FIG. 6C is a top view that illustrates the riblet structure RB. Incidentally, in the below-described description, the riblet structure RB formed on the turbine blade BL that is one specific example of the workpiece W will be described. However, the riblet structure RB formed on the workpiece W that is different from the turbine blade BL may has the structure described below.

As illustrated in FIG. 6A to FIG. 6*c*, the riblet structure RB may include a structure in which a plurality of grooves each of which extends along a first direction that is along the surface of the turbine blade BL are arranged along a second direction that is along the surface of the turbine blade BL and that intersects with the first direction. Namely, the riblet structure RB may include a structure in which a plurality of groove structures 9 each of which extends along the first direction are arranged along the second direction. In an example illustrated in FIG. 6A to FIG. 6C, the riblet structure RB includes a structure in which the plurality of groove structures 9 each of which extends along the X-axis direction are arranged along the Y-axis direction.

The groove structure 9 is a structure depressed along a direction that intersects with both of a direction along which the groove structure 9 extends and a direction along which the groove structures 9 are arranged. The groove structure 9 is a structure depressed from the surface of the turbine blade BL. In the examples illustrated in FIG. 6A to FIG. 6C, the groove structure 9 is depressed along the Z-axis direction.

A land structure 8, which protrudes compared to surroundings thereof, is formed between the adjacent groove structures 9. Thus, the riblet structure RB may include a plurality of land structures each of which extends along a first direction, which is along the surface of the turbine blade BL, and which are arranged along a second direction, which is along the surface of the turbine blade BL and which intersects with the first direction. Namely, the riblet structure RB may include a structure in which the plurality of land structures 8 each of which extends along the first direction are arranged along the second direction. The land structure 8 is a structure that protrudes along a direction that intersects with both of a direction along which the land structure 8 extends and a direction along which the land structures 8 are arranged. The land structure 8 is a structure protruding from the surface of the turbine blade BL. In the example illustrated in FIG. 6A to FIG. 6C, the land structure 8 is a structure that protrudes along the Z-axis direction. The land structure 8 may include a protrusion-shaped structure that projects against the surface of the turbine blade BL. The land structure 8 may include a convex-shaped structure that is convex with respect to the surface of the turbine blade BL. The land structure 8 may include a mountain-shaped structure that is a peak relative to the surface of the turbine blade BL.

Incidentally, the land structure 8 may be regarded to be a structure protruding from the groove structure 9. The land structure 8 may be regarded to be a structure that forms at least one of a protruding structure, a convex structure, and a mountain-shaped structure between two adjacent groove structures 9. The groove structure 9 may be regarded to be a structure depressed from the land structure 8. The groove structure 9 may be regarded to be a structure that forms a groove-shaped structure between two adjacent land structures 8.

As described above, the processing system SYS in the present example embodiment forms the riblet structure RB by performing the removal processing. Thus, the processing system SYS may form the riblet structure RB by performing the removal processing for removing a part of the turbine blade BL on which the groove structure 9 is formed. Namely, the processing system SYS may form the riblet structure RB by performing the removal processing for removing a part of the turbine blade BL so that a part of the turbine blade BL on which the land structure 8 is formed remains. For example, the processing system SYS may irradiate the turbine blade BL with the processing light EL so that a part of the surface of the turbine blade BL on which the groove structure 9 is formed is irradiated with the processing light EL. Specifically, the processing system SYS may form the riblet structure RB by repeating: a scan operation for irradiating the surface of the turbine blade BL with the processing light EL while moving the irradiation area EA (see FIG. 1) of the processing light EL along the X-axis direction along which the groove structure 9 extends; and a step operation for moving the irradiation area EA of the processing light EL along the Y-axis direction along which the groove structures 9 are arranged without irradiating the surface of the turbine blade BL with the processing light EL. In this case, it can be said that the processing system SYS forms the riblet structure RB (in other words, forms the land structures 8) by forming the groove structures 9.

(3) Specific Example of Operation for Forming Riblet Structure RB

Next, a specific example of an operation for forming the riblet structure RB will be described.

(3-1) First Specific Example of Operation for Forming Riblet Structure RB

Figure 7:
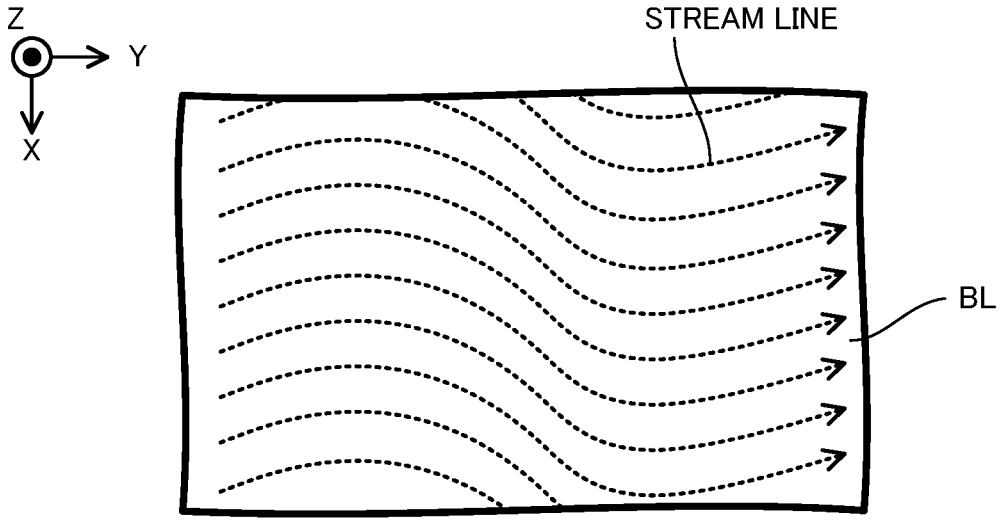
FIG. 7 is a planar view that schematically illustrates one example of a streamline on a surface of the turbine blade.

In a first specific example, the processing system SYS may form the riblet structure RB based on information related to the streamline of the turbine blade BL. For example, FIG. 7 is a planar view that schematically illustrates one example of the streamline on the surface of the turbine blade BL. Note that the streamline in the present example embodiment may mean a curved line whose tangent line corresponds to a velocity vector of the fluid at each part of the surface of the turbine blade BL (namely, the workpiece W) in a situation where the fluid flows on the surface of the turbine blade BL. Namely, the streamline in the present example embodiment may mean a curved line whose tangent line correspond to a velocity vector in a flow field on the surface of the turbine blade BL (namely, the workpiece W).

Figure 8:
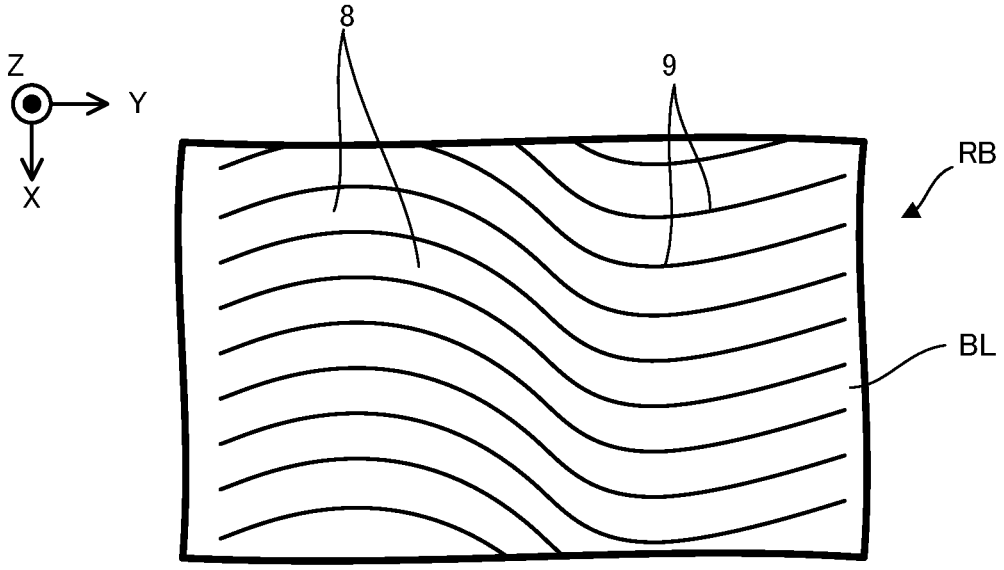
FIG. 8 is a planar view that schematically illustrates one example of the riblet structure formed based on information related to the streamline.

In the first specific example, the processing system SYS may form the riblet structure RB on the surface of the turbine blade BL based on this information related to the streamline of the turbine blade BL. For example, FIG. 8 is a planar view that schematically illustrates one example of the riblet structure RB formed based on the information related to the streamline. As illustrated in FIG. 8, the processing system SYS may form the riblet structure RB so that at least one of the plurality of groove structures 9 extends along the streamline. The processing system SYS may form the riblet structure RB so that at least a part of one groove structure 9 extends along the streamline. The processing system SYS may form the riblet structure RB so that at least one of the plurality of land structures 8 extends along the streamline. The processing system SYS may form the riblet structure RB so that at least a part of one land structure 8 extends along the streamline. The processing system SYS may form the riblet structure RB so that at least one of the plurality of groove structures 9 extends along a direction determined based on the streamline. The processing system SYS may form the riblet structure RB so that at least a part of one groove structure 9 extends along a direction determined based on the streamline. The processing system SYS may form the riblet structure RB so that at least one of the plurality of land structures 8 extends along a direction determined based on the streamline. The processing system SYS may form the riblet structure RB so that at least a part of one land structure 8 extends along a direction determined based on the streamline.

Figure 9:
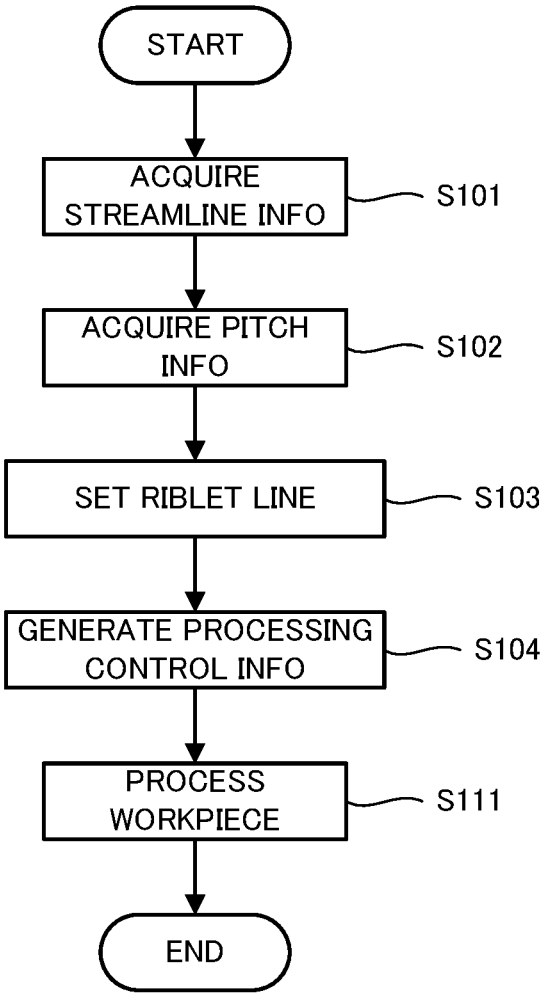
FIG. 9 is a flowchart that illustrates a flow of one example of an operation for forming the riblet structure formed based on the information related to the streamline.

Next with reference to FIG. 9, one example of the operation for forming the riblet structure RB based on the information related to the streamline will be described. FIG. 9 is a flowchart that illustrates one example of the operation for forming the riblet structure RB based on the information related to the streamline.

Figure 10:
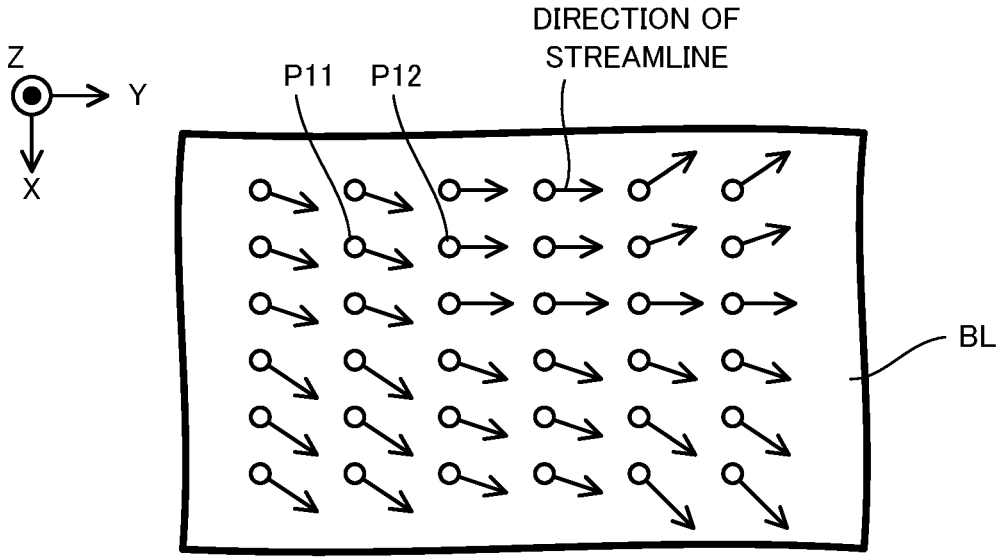
FIG. 10 schematically illustrates one example of streamline information.

As illustrated in FIG. 9, the control apparatus 3 acquires the information related to the streamline (hereinafter, it is referred to as "streamline information") (a step S101). The streamline information may include information indicating a direction of the streamline (namely, a direction of the velocity vector in the flow field). For example, FIG. 10 schematically illustrates one example of the streamline information. As illustrated in FIG. 10, the streamline information may include the information indicating the direction of the streamline at each position on the surface of the turbine blade BL. Especially, the streamline information may include the information indicating the direction of the streamline at each of a plurality of positions (namely, at least two positions) on the surface of the turbine blade BL. For example, as illustrated in FIG. 10, the streamline information may include the information indicating the direction of the streamline at a first position P11 on the surface of the turbine blade BL and the information indicating the direction of the streamline at a second position P12 on the surface of the turbine blade BL. However, the streamline information may include any information related to the streamline in addition to or instead of the information indicating the direction of the streamline.

For example, in a case where the streamline information is stored in the storage apparatus of the control apparatus 3, the control apparatus 3 may read the streamline information stored in the storage apparatus. For example, the control apparatus 3 may acquire the streamline information from a recording medium that is externally attachable to the processing system SYS by using an non-illustrated recording medium reading apparatus of the processing system SYS. For example, the control apparatus 3 may acquire (namely, download) the streamline information from an apparatus, which is external to the processing system SYS and which is configured to communicate with the processing system SYS, through a communication network by using a communication apparatus of the processing system SYS.

The control apparatus 3 may acquire the streamline information by generating the streamline information. Specifically, for example, the control apparatus 3 may calculate a shearing stress (for example, a wall shearing stress) acting on the surface of the turbine blade BL due to viscosity of the fluid, based on model information indicating a three-dimensional model of the turbine blade BL and characteristic information related to a characteristic of the fluid flowing on the surface of the turbine blade BL. Then, the control apparatus 3 may calculate the streamline at each position on the surface of the turbine blade BL based on the calculated wall shearing stress.

Again in FIG. 9, the control apparatus 3 acquires pitch information related to an arrangement pitch of the groove structures 9 in addition to the streamline information (a step S102). The arrangement pitch of the groove structures 9 corresponds to an interval between two adjacent groove structures 9. Incidentally, since the land structure 8 is formed between two adjacent groove structures 9 as described above, the arrangement pitch of the groove structure 9 may be regarded to be substantially equivalent to the arrangement pitch of the land structure 8. The arrangement pitch of the land structure 8 corresponds to an interval between two adjacent land structures 8.

Figure 11:
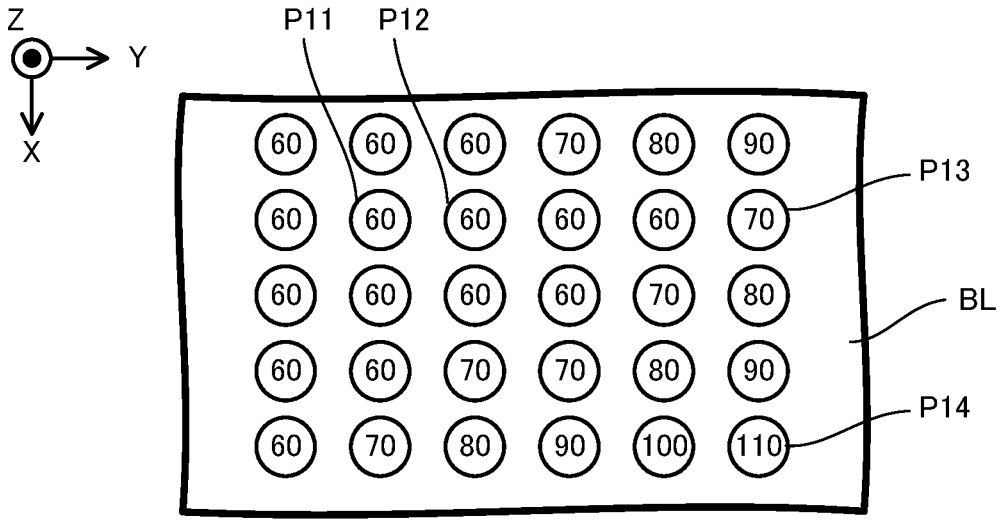
FIG. 11 schematically illustrates one example of pitch information.

FIG. 11 schematically illustrates one example of the pitch information. As illustrated in FIG. 11, the pitch information may include the information indicating the arrangement pitch at each position on the surface of the turbine blade BL. Especially, the pitch information may include the information indicating the arrangement pitch at each of a plurality of positions (namely, at least two positions) on the surface of the turbine blade BL. For example, as illustrated in FIG. 11, the pitch information may include the information indicating the arrangement pitch at a first position P11 on the surface of the turbine blade BL, the information indicating the arrangement pitch at a second position P12 on the surface of the turbine blade BL, the information indicating the arrangement pitch at a third position P13 on the surface of the turbine blade BL, and the information indicating the arrangement pitch at a fourth position P14 on the surface of the turbine blade BL. For example, in an example illustrated in FIG. 11, the pitch information indicates that the arrangement pitch at the first position P11 on the surface of the turbine blade BL is 60 micrometers, the arrangement pitch at the second position P12 on the surface of the turbine blade BL is 60 micrometers, the arrangement pitch at the third position P13 on the surface of the turbine blade BL is 70 micrometers, and the arrangement pitch at the third position P13 on the surface of the turbine blade BL is 110 micrometers.

For example, in a case where the pitch information is stored in the storage apparatus of the control apparatus 3, the control apparatus 3 may read the pitch information stored in the storage apparatus. For example, the control apparatus 3 may acquire the pitch information from a recording medium that is externally attachable to the processing system SYS by using an non-illustrated recording medium reading apparatus of the processing system SYS. For example, the control apparatus 3 may acquire (namely, download) the pitch information from an apparatus, which is external to the processing system SYS and which is configured to communicate with the processing system SYS, through a communication network by using a communication apparatus of the processing system SYS.

The control apparatus 3 may acquire the pitch information by generating the pitch information. Specifically, for example, the control apparatus 3 may calculate a proper arrangement pitch, which can reduce the resistance (especially, at least one of the frictional resistance and the turbulent frictional resistance) of the surface of the turbine blade BLW to fluid, based on model information indicating a three-dimensional model of the turbine blade BL and characteristic information related to a characteristic of the fluid flowing on the surface of the turbine blade BL.

Again in FIG. 9, then, the control apparatus 3 sets (namely, determines or calculates) a position at which the groove structure 9 is formed on the surface of the turbine blade BL (a step S103). As described above, the groove structure 9 extends lineally on the surface of the turbine blade BL. Thus, the control apparatus 3 may set, as the position at which the groove structure 9 is formed, a line representing a locus along which the groove structure 9 extends. In the below-described description, the line representing the locus along which the groove structure 9 extends is referred to as a "riblet line RL" for convenience of description.

Incidentally, since the land structure 8 is formed between two adjacent groove structures 9 as described above, the position at which the groove structure 9 is formed may be substantially regarded to indirectly indicate a position at which the land structure 8 is formed. Thus, the riblet line RL may be a line representing a locus along which the land structure 8 extends. The control apparatus 3 may set the riblet line RL that is the line representing the locus along which the land structure 8 extends, in addition to or instead of the riblet line RL that is the line representing the locus along which the groove structure 9 extends. Incidentally, in the below-described description, the riblet line RL that is the line representing the locus along which the groove structure 9 extends will be described for convenience of description. However, the below-described description may be used as a description related to the riblet line RL that corresponds to the line representing the locus along which the land structure 8 extends, by replacing the phrase "groove structure 9" with the phrase "land structure 8".

The control apparatus 3 sets the riblet line RL based on the streamline information acquired at the step S101 and the pitch information acquired at the step S102. Specifically, the control apparatus 3 determines the direction of the streamline at each position on the surface of the turbine blade BL based on the streamline information. Furthermore, the control apparatus 3 determines the arrangement pitch of the groove structures 9 formed at each position on the surface of the turbine blade BL based on the pitch information. Then, the control apparatus 3 sets, at each position on the surface of the turbine blade BL, a plurality of riblet lines RL each of which extends along the determined direction of the streamline and which are arranged in parallel along a direction intersecting with the determined direction of the streamline at the determined arrangement pitch. Namely, the control apparatus 3 sets, at each position on the surface of the turbine blade BL, a plurality of riblet lines RL that are parallel to each other so that the direction along which the plurality of riblet lines RL extend is same as the direction of the streamline indicated by the streamline information and the arrangement pitch of the riblet lines RL is same as the arrangement pitch indicated by the pitch information.

Figure 12:
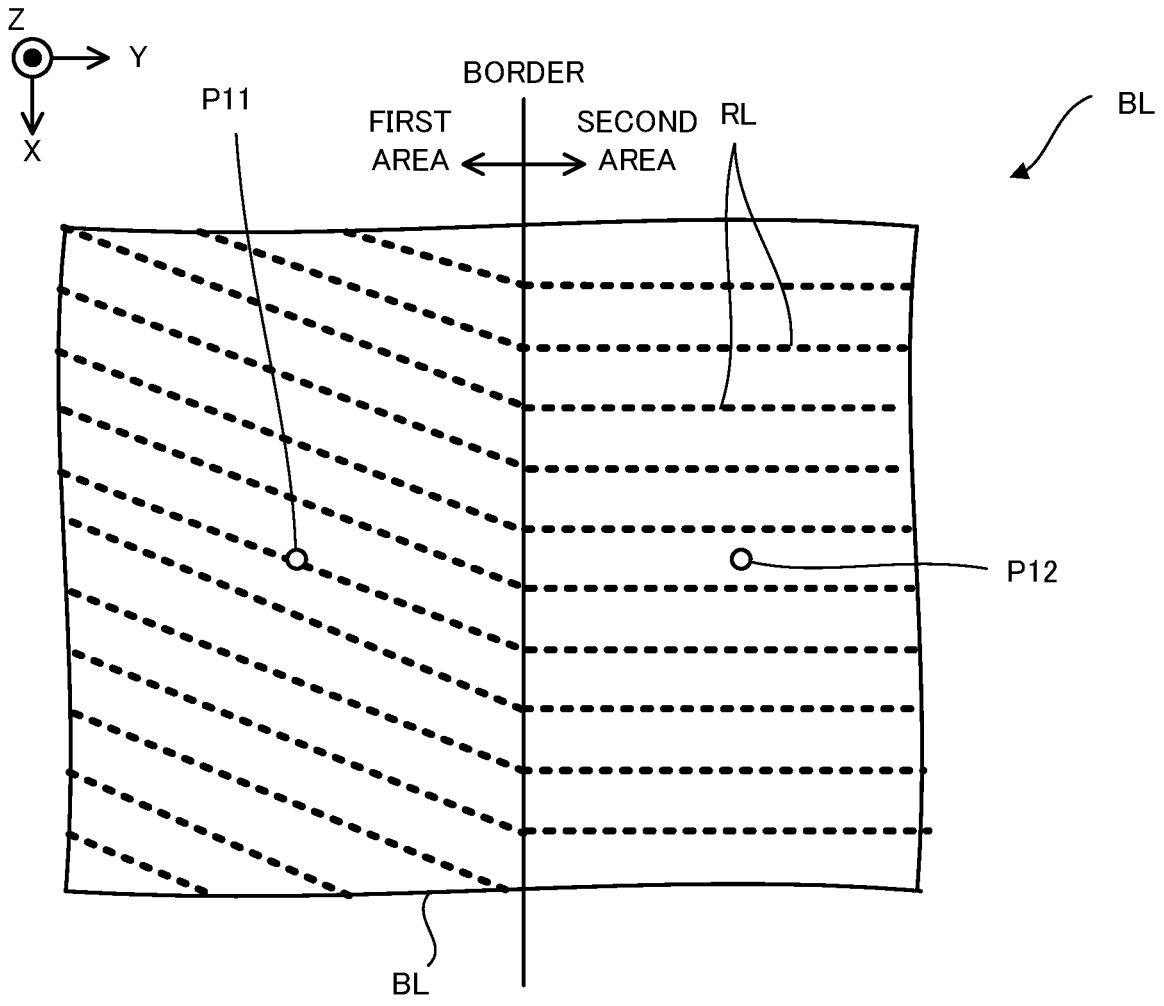
FIG. 12 schematically illustrates a riblet line.

Specifically, as illustrated in FIG. 12 that schematically illustrates the riblet lines RL, the control apparatus 3 sets, at the first position P11 on the surface of the turbine blade BL, the plurality of riblet lines RL that are parallel to each other so that the direction along which the plurality of riblet lines RL extend is same as the direction of the streamline at the first position P11 indicated by the streamline information and the arrangement pitch of the riblet lines RL is same as the arrangement pitch at the first position P11 indicated by the pitch information. For example, the control apparatus 3 may set, in an area on the surface of the turbine blade BL including the first position P11, the plurality of riblet lines RL that are parallel to each other so that the direction along which the plurality of riblet lines RL extend is same as the direction of the streamline at the first position P11 indicated by the streamline information and the arrangement pitch of the riblet lines RL is same as the arrangement pitch at the first position P11 indicated by the pitch information. Similarly, the control apparatus 3 sets, at the second position P12 on the surface of the turbine blade BL, the plurality of riblet lines RL that are parallel to each other so that the direction along which the plurality of riblet lines RL extend is same as the direction of the streamline at the second position P12 indicated by the streamline information and the arrangement pitch of the riblet lines RL is same as the arrangement pitch at the second position P12 indicated by the pitch information. For example, the control apparatus 3 may set, in an area on the surface of the turbine blade BL including the second position P12, the plurality of riblet lines RL that are parallel to each other so that the direction along which the plurality of riblet lines RL extend is same as the direction of the streamline at the second position P12 indicated by the streamline information and the arrangement pitch of the riblet lines RL is same as the arrangement pitch at the second position P12 indicated by the pitch information. However, the control apparatus 3 may set the plurality of riblet lines RL including at least two riblet lines RL that are not parallel (namely, that are non-parallel) to each other.

The control apparatus 3 may set the riblet line RL so that a size of a line segment constituting the riblet line RL (specifically, a size of a line segment of the riblet line RL in the direction along which the riblet line RL extends, and substantially a length) is larger than the arrangement pitch of the groove structures 9 (namely, the arrangement pitch of the riblet lines RL). The control apparatus 3 may set the riblet line RL so that the length of the line segment constituting the riblet line RL is several to several dozen times of the arrangement pitch of the groove structures 9 (namely, the arrangement pitch of the riblet lines RL). As one example, in a case where the arrangement pitch of the groove structures 9 is several tens of micrometers, the control apparatus 3 may set the riblet line RL so that the length of the line segment constituting the riblet line RL is several hundred micrometers to several millimeters.

As described above, the plurality of riblet lines RL, which are constituted from a plurality of line segments extending along the direction of the streamline at each position indicated by the streamline information and which are arranged at the arrangement pitch at each position indicated by the pitch information, are set at each position on the surface of the turbine blade BL. Thus, the control apparatus 3 may set the riblet line RL, which is constituted from the line segment that is longer than the arrangement pitch at each position indicated by the pitch information and that extends along the direction of the streamline at each position indicated by the streamline information, at each position on the surface of the turbine blade BL. For example, the control apparatus 3 may set the riblet line RL, which is constituted from the line segment that is longer than the arrangement pitch at the first position P11 indicated by the pitch information and that extends along the direction of the streamline at the first position P11 indicated by the streamline information, at the first position P11 on the surface of the turbine blade BL. For example, the control apparatus 3 may set the riblet line RL, which is constituted from the line segment that is longer than the arrangement pitch at the second position P12 indicated by the pitch information and that extends along the direction of the streamline at the second position P12 indicated by the streamline information, at the second position P12 on the surface of the turbine blade BL.

The direction of the streamline in a first area on the surface of the turbine blade BL may not be necessarily same as the direction of the streamline in a second area on the surface of the turbine blade BL adjacent to the first area. Thus, the direction along which the riblet line RL set in the first area on the surface of the turbine blade BL extends may not be necessarily same as the direction along which the riblet line RL set in the second area on the surface of the turbine blade BL extends. FIG. 12 illustrates an example in which the direction along which the riblet line RL set in the first area (an area including the first position P11 in an example illustrated in FIG. 12) on the surface of the turbine blade BL extends is different from the direction along which the riblet line RL set in the second area (an area including the second position P12 in the example illustrated in FIG. 12) on the surface of the turbine blade BL extends. Namely, FIG. 12 illustrates an example in which the riblet line RL set in the first area on the surface of the turbine blade BL is not parallel to the riblet line RL set in the second area on the surface of the turbine blade BL. However, the direction along which the riblet line RL set in the first area on the surface of the turbine blade BL extends may be same as the direction along which the riblet line RL set in the second area on the surface of the turbine blade BL extends. Namely, the riblet line RL set in the first area on the surface of the turbine blade BL may be parallel to the riblet line RL set in the first area on the surface of the turbine blade BL.

The arrangement pitch of the groove structures formed in the first area on the surface of the turbine blade BL may not be necessarily same as the arrangement pitch of the groove structures formed in the second area on the surface of the turbine blade BL adjacent to the first area. Thus, the arrangement pitch of the riblet line RL set in the first area on the surface of the turbine blade BL may not be necessarily same as the arrangement pitch of the riblet line RL set in the second area on the surface of the turbine blade BL. FIG. 12 illustrates an example in which the arrangement pitch of the riblet line RL set in the first area on the surface of the turbine blade BL is different from the arrangement pitch of the riblet line RL set in the second area on the surface of the turbine blade BL. In this case, at least one of the plurality of riblet lines RL set in the first area on the surface of the turbine blade BL may not be connected to any of the plurality of riblet lines RL set in the second area on the surface of the turbine blade BL. However, the arrangement pitch of the riblet line RL set in the first area on the surface of the turbine blade BL may be same as the arrangement pitch of the riblet line RL set in the second area on the surface of the turbine blade BL.

Figure 13:
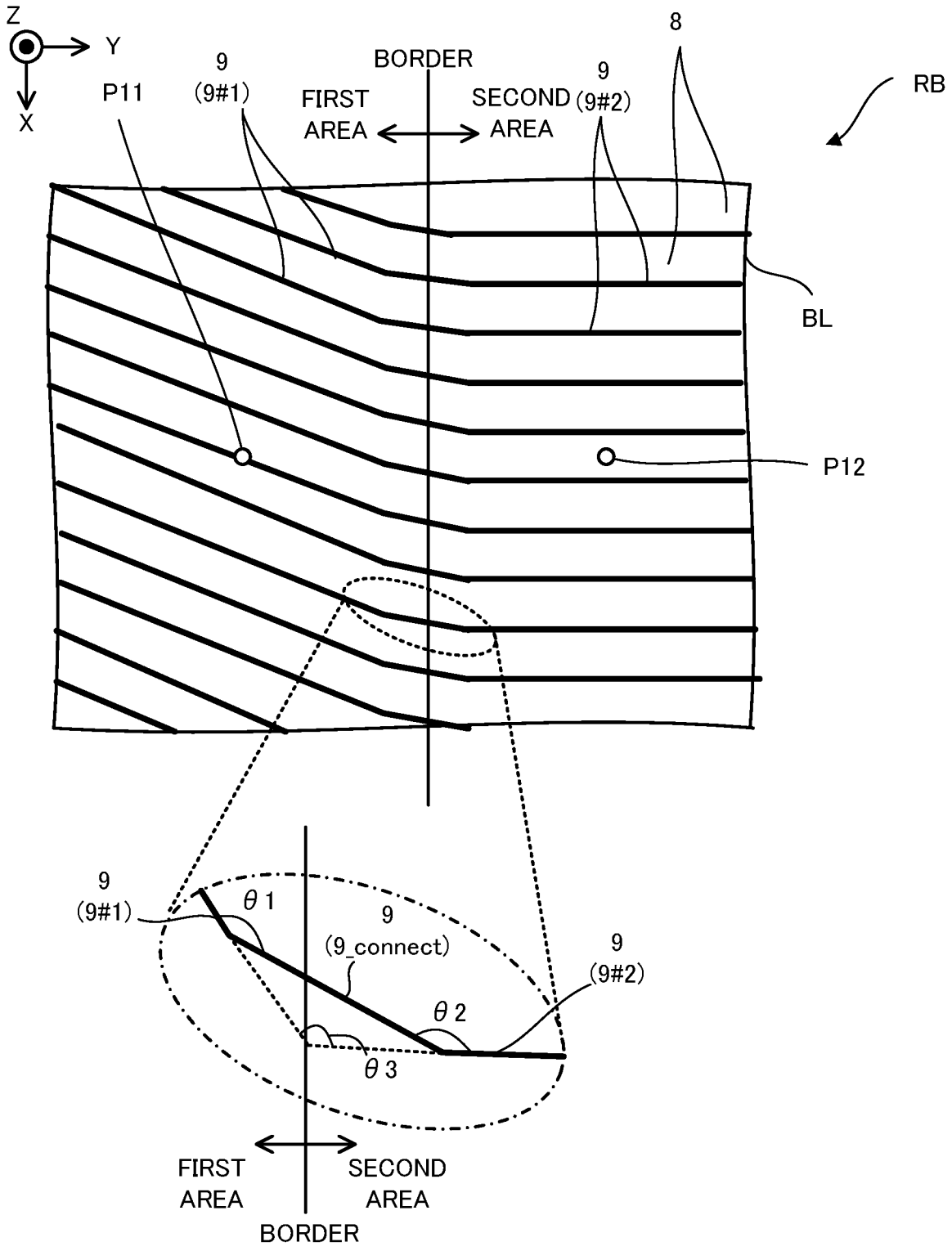
FIG. 13 is a planar view that illustrates the turbine blade on which the riblet structure is formed.

Then, the control apparatus 3 generates the processing control information for controlling the processing apparatus 1 to form the riblet structure RB including the groove structures 9 extending along the riblet lines RL set at the step S103 (a step S104). The processing control information may include, processing path information indicating a moving trajectory of the irradiation area EA of the processing light EL relative to the workpiece W on the surface of the workpiece W, for example. Then, the control apparatus 3 controls the processing apparatus 1 to form the riblet structure RB extending along the set riblet line RL based on the processing control information generated at the step S104 (a step S105). Namely, the processing apparatus 1 processes the turbine blade BL (namely, the workpiece W) to form the riblet structure RB extending along the set riblet line RL based on the processing control information generated at the step S104 (the step S105). As a result, the riblet structure RB extending along the set riblet line RL is formed, as illustrated in FIG. 13 that is a planar view illustrating the turbine blade BL on which the riblet structure RB is formed. Namely, the riblet structure RB that includes the plurality of groove structures 9, which extend along the directions along which the set riblet lines RL extend and which are arranged at the arrangement pitch same as the arrangement pitch of the set riblet lines RL, is formed.

In the example illustrated in FIG. 13, the plurality of groove structures 9, which extends along the direction of the streamline at the first position P11 indicated by the streamline information and are arranged at the arrangement pitch at the first position P11 indicated by the pitch information, are formed in the area on the surface of the turbine blade BL including the first position P11. Furthermore, the plurality of groove structures 9, which extends along the direction of the streamline at the second position P12 indicated by the streamline information and are arranged at the arrangement pitch at the second position P12 indicated by the pitch information, are formed in the area on the surface of the turbine blade BL including the second position P12 (namely, in the area adjacent to the area including the first position P11). Incidentally, in the below-described description, the groove structure 9 formed at the first position P11 is referred to as a "groove structure 9 #1" and the groove structure 9 formed at the second position P12 is referred to as a "groove structure 9 #2".

The processing system SYS may form the riblet structure RB so that at least one of the plurality of groove structures 9 formed in the first area on the surface of the turbine blade BL is smoothly connected to at least one of the plurality of groove structures 9 formed in the second area on the surface of the turbine blade BL adjacent the first area. structure RB may be formed. Specifically, the processing system SYS may form the riblet structure RB including a third groove structure 9 that connects a first groove structure 9 formed in the first area and a second groove structure 9 formed in the second area. Namely, the processing system SYS may form the riblet structure RB including the third groove structure 9 that constitutes a series of groove structures 9 together with the first groove structure 9 and the second groove structure between the first groove structure 9 formed in the first area and the second groove structure 9 formed in the second area. Incidentally, in the below-described description, the third groove structure 9 for connecting the first and second groove structures 9 that are formed in two adjacent areas, respectively, is referred to as a "groove structure 9_connect". For example, as illustrated in FIG. 13, the processing system SYS may form the riblet structure RB including the groove structure 9_connect that connects the groove structure 9 #1 and the groove structure 9 #2.

A direction along which the groove structure 9_connect extends may be different from directions along which the two groove structures 9 that are connected by the groove structure 9_connect extend. For example, as illustrated in FIG. 13, the processing system SYS may form the riblet structure RB that includes: the groove structure 9 #1; the groove structure 9 #2 that extends along a direction different from the direction along which the groove structure 9 #1 extends; and the groove structure 9_connect that extends along a direction different from the directions along which the groove structures 9 #1 and 9 #2 extend. For example, the processing system SYS may form the riblet structure RB that includes: the groove structure 9 #1; the groove structure 9 #2 that extends along a direction same as the direction along which the groove structure 9 #1 extends; and the groove structure 9_connect that extends along a direction different from the directions along which the groove structures 9 #1 and 9 #2 extend. However, the direction along which the groove structure 9_connect extends may be same as the direction along which at least one of the two groove structures 9 that are connected by the groove structure 9_connect extends. For example, the processing system SYS may form the riblet structure RB that includes: the groove structure 9 #1; the groove structure 9 #2 that extends along a direction same as or different from the direction along which the groove structure 9 #1 extends; and the groove structure 9_connect that extends along a direction same as the directions along which at least one of the groove structures 9 #1 and 9 #2 extends.

The processing system SYS may form the groove structure 9_connect satisfying an angular condition described below. The angle conditions that may be satisfied by the groove structure 9_connect connecting the groove structure 9 #1 and groove structure 9 #2 will be described below. The angle condition may include a condition related to an angle θ1 between the groove structure 9 #1 and the groove structure 9_connect, an angle θ2 between the groove structure 9 #2 and the groove structure 9_connect, and an angle θ3 between the groove structure 9 #1 and the groove structure 9 #2. The angle θ1 may be an angle between an axis along the direction along which the groove structure 9 #1 extends and an axis along the direction along which the groove structure 9_connect extends. The angle θ1 may be a larger angle (for example, an angle that is equal to or larger than 90 degrees) of two angles (for example, an angle that is equal to or larger than 90 degrees and an angle that is equal to or smaller than 90 degrees) between the groove structure 9 #1 and the groove structure 9_connect. The angle θ2 may be an angle between an axis along the direction along which the groove structure 9 #2 extends and the axis along the direction along which the groove structure 9_connect extends. The angle θ2 may be a larger angle (for example, an angle that is equal to or larger than 90 degrees) of two angles (for example, an angle that is equal to or larger than 90 degrees and an angle that is equal to or smaller than 90 degrees) between the groove structure 9 #2 and the groove structure 9_connect. The angle θ3 may be an angle between the axis along the direction along which the groove structure 9 #1 extends and the axis along the direction along which the groove structure 9 #2 extends. The angle θ3 may be a larger angle (for example, an angle that is equal to or larger than 90 degrees) of two angles (for example, an angle that is equal to or larger than 90 degrees and an angle that is equal to or smaller than 90 degrees) between the groove structure 9 #1 and the groove structure 9 #2. In this case, the angle condition may include such a condition that each of the angles θ1 and 02 is larger than the angle θ3. The angle condition may include such a condition that a sum of the angles θ1 and 02 is an angle obtained by adding 180 degrees to the angle θ3.

Figure 14:
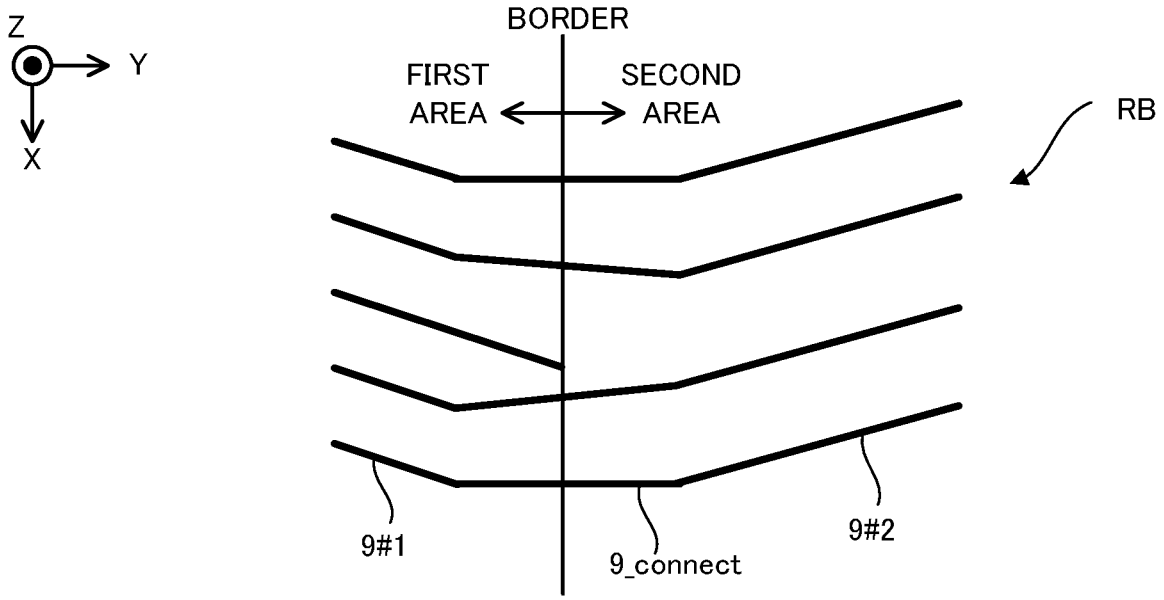
FIG. 14 is a planar view that illustrates the turbine blade on which the riblet structure is formed.

The processing system SYS may form the riblet structure RB so that at least one of the plurality of first groove structures 9 formed in the first area on the surface of the turbine blade BL is not connected to any of the plurality of second groove structures 9 formed in the second area on the surface of the turbine blade BL adjacent to the first area. The processing system SYS may form the riblet structure RB so that at least one of the plurality of first groove structures 9 formed in the first area is not connected to the groove structure 9_connect. For example, as illustrated in FIG. 14, the processing system SYS may form the riblet structure RB so that at least one of the plurality of groove structures 9 #1 is not connected (especially, is not connected at a boundary between the groove structure 9 #1 and the groove structure 9 #2, namely, near a boundary between the first area and the second area) to any of the plurality of groove structures 9 #2. The processing system SYS may form the riblet structure RB so that at least one of the plurality of groove structures 9 #1 is not connected to the groove structure 9_connect.

However, the processing system SYS may form the riblet structure RB so that the plurality of first groove structures 9 formed in the first area on the surface of the turbine blade BL are respectively connected to the plurality of second groove structures 9 formed in a second area on the surface of the turbine blade BL adjacent the first area. Namely, the processing system SYS may form the riblet structure RB so that the first groove structures 9 correspond to the groove structures 9_connect one-to-one and the second groove structures 9 correspond to the groove structures 9_connect one-to-one.

Figure 15:
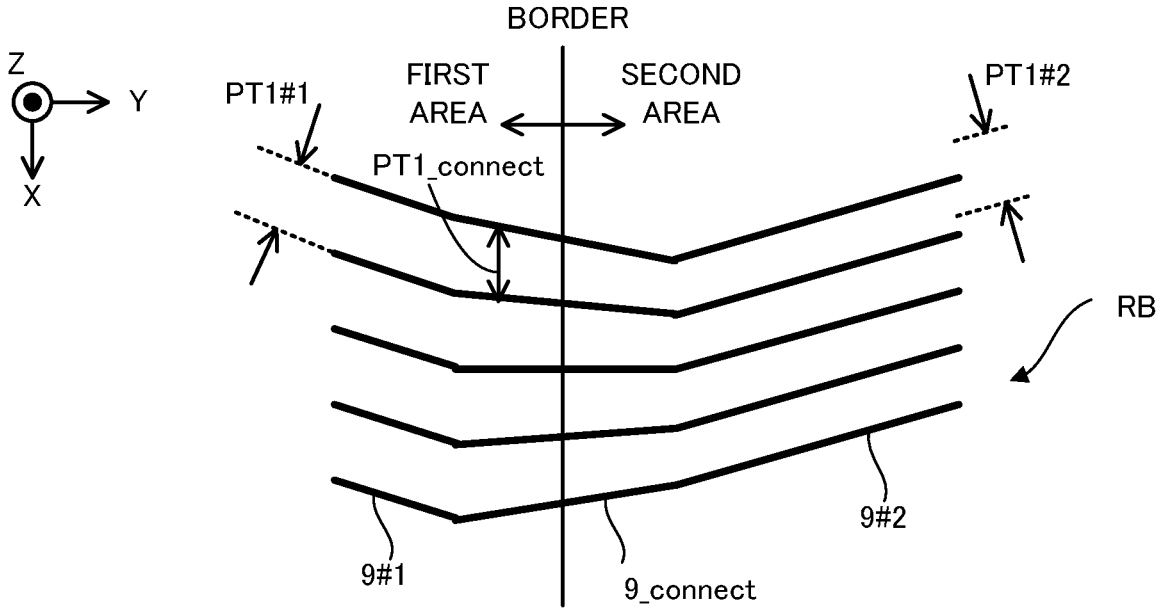
FIG. 15 is a planar view that illustrates the turbine blade on which the riblet structure is formed.

The processing system SYS may form the riblet structure RB so that the arrangement pitch of the plurality of first groove structures 9 formed in the first area on the surface of the turbine blade BL is different from the arrangement pitch of the plurality of second groove structures 9 formed in the second area on the surface of the turbine blade BL adjacent the first area. For example, as illustrated in FIG. 15, the processing system SYS may form the riblet structure RB so that the arrangement pitch PT1 #1 of the plurality of groove structures 9 #1 is different from the arrangement pitch PT1 #2 of the plurality of groove structures 9 #2. In this case, as illustrated in FIG. 15, at least two of the plurality of groove structures 9_connect that connects the plurality of first groove structures 9 (for example, the plurality of groove structures 9 #1 in FIG. 15) and the plurality of second groove structures 9 (for example, the plurality of groove structures 9 #2 in FIG. 15), respectively, may not be parallel (namely, may be non-parallel) to each other. Namely, at least two of the plurality of groove structures 9_connect that connects the plurality of first groove structures 9 (for example, the plurality of groove structures 9 #1 in FIG. 15) and the plurality of second groove structures 9 (for example, the plurality of groove structures 9 #2 in FIG. 15), respectively, may extend in direction that are different from each other (namely, one direction and another direction that is different from or intersects with the one direction). Typically, the plurality of groove structures 9_connect that connects the plurality of first groove structures 9 (for example, the plurality of groove structures 9 #1 in FIG. 15) and the plurality of second groove structures 9 (for example, the plurality of groove structures 9 #2 in FIG. 15), respectively, may not be parallel (namely, may be non-parallel) to each other. Namely, the plurality of groove structures 9_connect that connects the plurality of first groove structures 9 (for example, the plurality of groove structures 9 #1 in FIG. 15) and the plurality of second groove structures 9 (for example, the plurality of groove structures 9 #2 in FIG. 15), respectively, may extend in directions that are different from each other. In this case, the arrangement pitch of the groove structures 9_connect (for example, the arrangement pitch PT1_connect illustrated in FIG. 15) may vary depending on a position thereof along the direction along which the groove structure 9_connect extends (in the example illustrated in FIG. 15, the Y-0 axis direction). As one example, in a case where the arrangement pitch PT1 #1 of the plurality of groove structures 9 #1 is larger than the arrangement pitch PT1 #2 of the plurality of groove structures 9 #2, as illustrated in FIG. 15, the arrangement pitch of the groove structures 9_connect may be gradually smaller in the first area as it is closer to the boundary between the first area and the second area, and the arrangement pitch of the groove structures 9_connect may be gradually smaller in the second area as it is farther from the boundary between the first area and the second area. As another example, although it is not illustrated in the figure, in a case where the arrangement pitch PT1 #1 of the plurality of groove structures 9 #1 is smaller than the arrangement pitch PT1 #2 of the plurality of groove structures 9 #2, the arrangement pitch of the groove structures 9_connect may be gradually larger in the first area as it is closer to the boundary between the first area and the second area, and the arrangement pitch of groove structures 9_connect may be gradually larger in the second area as it is farther from the boundary between the first area and the second area.

However, the processing system SYS may form the riblet structure RB so that the arrangement pitch of the plurality of first groove structures 9 formed in the first area on the surface of the turbine blade BL is same as the arrangement pitch of the plurality of second groove structures 9 formed in the second area on the surface of the turbine blade BL adjacent to the first area. In this case, the arrangement pitch of the groove structures 9_connect (for example, the arrangement pitch PT1_connect illustrated in FIG. 15) may be constant regardless of the position thereof along the direction along which the groove structure 9_connect extends (in the example illustrated in FIG. 15, the Y-axis direction). Incidentally, in a case where the groove structure 9_connect is formed, the control apparatus 3 may set the riblet line RL corresponding to the groove structure 9_connect in advance. For example, the control apparatus 3 may set the riblet line RL so that the riblet line RL set in the first area is smoothly connected to at least one of the plurality of riblet lines RL set in the second area adjacent to the first area, instead of the riblet line RL illustrated in FIG. 12. For example, the control apparatus 3 may set another riblet line RL for connecting two riblet lines RL set in two adjacent areas, respectively (specifically, the riblet line RL for forming the groove structure 9_connect), instead of the riblet line RL illustrated in FIG. 12. In this case, the processing apparatus 1 may form the groove structure 9_connect based on the riblet line RL generated by the control apparatus 3.

Incidentally, the surface of the turbine blade BL (alternatively, any workpiece W) may include a curved surface. In this case, there is a possibility that the plurality of groove structures 9 extending along the plurality of mutually parallel riblet lines RL are not exactly parallel to each other on the surface of the turbine blade BL (alternatively, any workpiece W). However, even in this case, the plurality of groove structures 9 extending along the plurality of mutually parallel riblet lines RL may be regarded to be parallel to each other on the surface of the turbine blade BL (alternatively, any workpiece W). Alternatively, in a case where the plurality of groove structures 9 are parallel to each other on a predetermined plane when the plurality of groove structures 9 extending on the surface of the turbine blade BL (or any workpiece W) are projected (namely, projected) onto the predetermined plane, the plurality of riblet lines RL may be regarded to be parallel to each other.

As described above, in the first specific example, the processing system SYS forms the riblet structure RB based on the streamline information. As a result, the riblet structure RB that includes the groove structure 9 (furthermore, the land structure 8) extending along the direction determined based on the streamline (typically, the direction of the streamlines) is formed. Thus, it is possible to form the riblet structure RB by which the resistance of the surface of the workpiece W to the fluid is properly reducible.

Especially, in the first specific example, the groove structure 9_connect that connects the first and second groove structures 9 adjacent to each other is formed. Thus, compared to a case where the groove structure 9_connect is not formed, a series of groove structure 9 including the first and second groove structures 9 and the groove structure 9_connect extends more smoothly. As a result, it is possible to form the riblet structure RB by w % which the resistance of the surface of the workpiece W to the fluid is properly reducible.

Incidentally, in the above-described description, the control apparatus 3 of the processing system SYS sets the riblet line RL. However, an information processing apparatus external to the processing system SYS may set the riblet line RL. Namely, an information processing apparatus external to the processing system SYS may perform the operations from the step S101 to the step S105 in FIG. 9. In this case, the control apparatus 3 may acquire information related to the riblet line RL from the external information processing apparatus and generate the processing control information based on the acquired information related to the riblet line RL. Alternatively, the external information processing apparatus may set the riblet line RL and generate the processing control information. Namely, the information processing apparatus external to the processing system SYS may perform the operations from the step S101 to step S105 in FIG. 9. In this case, the control apparatus 3 may acquire the processing control information from the external information processing apparatus and control the processing apparatus 1 based on the acquired processing control information.

(3-2) Second Specific Example of Operation for Forming Riblet Structure RB

Next, in a second specific example, the processing system SYS may form the riblet structure RB that includes the groove structure 9 having a wavy shape. Namely, the processing system SYS may form the riblet structure RB that includes the groove structure 9 extending so that a shape thereof is the wavy shape. In a case where the shape of the groove structure 9 is the wavy shape, the land structure 8 located between two adjacent groove structures 9 also extends so that a shape thereof is a wavy shape. Thus, the processing system SYS may form the riblet structure RB that includes the land structure 8 having the wavy shape (namely, the land structure 8 that extends so that the shape thereof is the wavy shape). For this reason, the below-described description is usable a description related to the land structure 8 extending so that the shape thereof is the wavy shape by replacing the phrase "groove structure 9" with the phrase "land structure 8". Moreover, in the below-described description, the groove structure 9 extending so that the shape thereof is the wavy shape is referred to as a "wavy groove structure 9*w*" for convenience of description.

Figure 16:
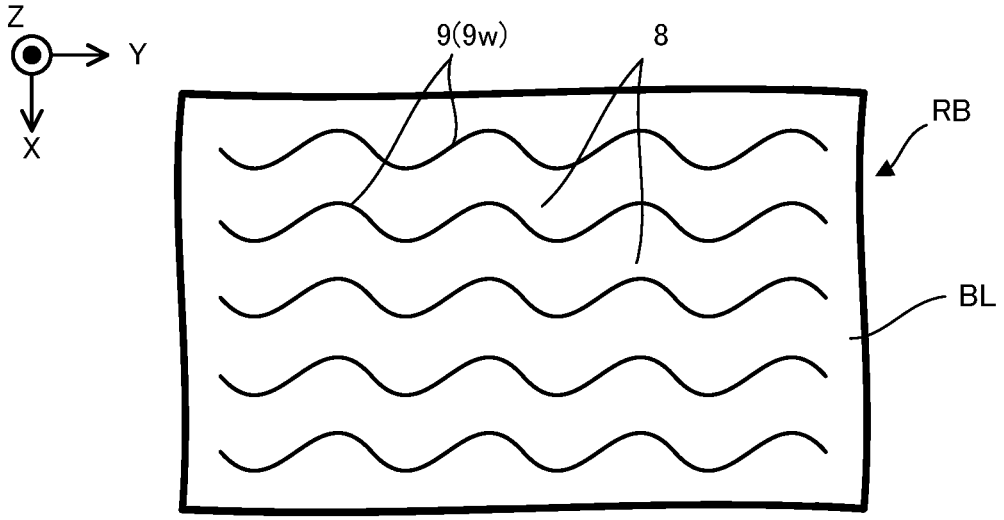
FIG. 16 is a planar view that illustrates the riblet structure including a wavy groove structure.

One example of the riblet structure RB including the wavy groove structure 9*w* is illustrated in FIG. 16. As illustrated in FIG. 16, the wavy groove structure 9*w* may mean a groove structure 9 extending to form a wave-shaped locus on a plane (in the example illustrated in FIG. 16, the XY plane) including a first direction (in the example illustrated in FIG. 16, the Y-axis direction) along which the wavy groove structure 9*w* extends and a second direction (in the example illustrated in FIG. 16, the X-axis direction) along which the plurality of wavy groove structures 9*w* are arranged. The groove structure 9*w* may be a groove structure 9*w* that extends along the first direction while oscillating along the second direction along which the plurality of wavy groove structures 9*w* are arranged. The wavy groove structure 9*w* may be a groove structure 9 the shape of which is a sinusoidal shape.

Figure 17:
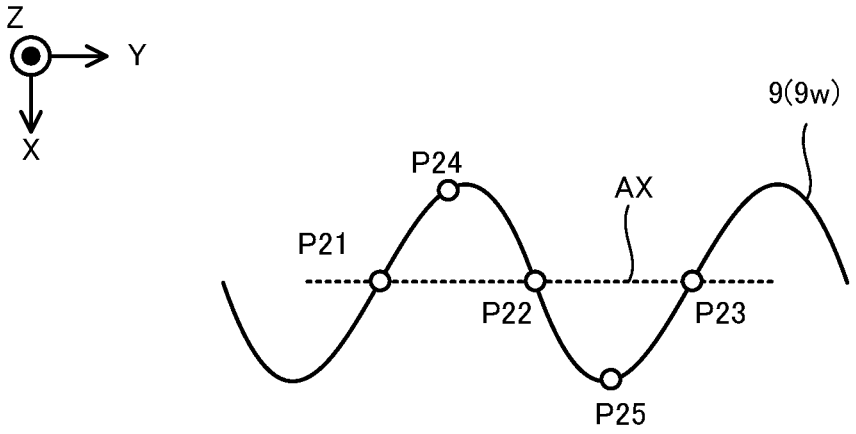
FIG. 17 is a planar view that illustrates the riblet structure including the wavy groove structure.

The wavy groove structure 9*w* may intersect with an axis AX, which extends along the first direction along which the wavy groove structure 9*w* extends, at at least three positions, as illustrated in FIG. 17 that illustrates the enlarged wavy groove structure 9*w*. In an example illustrated in FIG. 17, the wavy groove structure 9*w* intersects with the axis AX at each of positions P21, P22, and P23. Furthermore, a position P24 of the wavy groove structure 9*w* between the position P21 and the position P22 may be located at a position that is away from the axis AX toward one direction side (toward the −X side in the example illustrated in FIG. 17). Furthermore, a position P25 of the wavy groove structure 9*w* between the position P22 and the position P23 may be located at a position that is away from the axis AX toward another directional side (specifically, toward a side opposite to the one direction side, and toward the +X side in the example illustrated in FIG. 17).

The riblet structure RB may include a plurality of wavy groove structures 9*w* that are arranged at a first arrangement pitch and a plurality of wavy groove structures 9*w* that are arranged at a second arrangement pitch. In the below-described description, each of the plurality of wavy groove structures 9*w* arranged at the first arrangement pitch is referred to as a "wavy groove structure 9*w* #a", and each of the plurality of wavy groove structures 9*w* arranged at the second arrangement pitch is referred to as a "wavy groove structure 9*w* #*b*", for convenience of description.

The wavy groove structure 9*w* #*a* may satisfy a condition illustrated in FIG. 17. Namely, the wavy groove structure 9*w* #*a* may intersect with a first axis, which extends along a direction along which the wavy groove structure 9*w* #*a* extends, at each of a first position, a second position and a third position. Furthermore, a fourth position of the wavy groove structure 9*w* #*a* between the first position and the second position may be located at a position that is away from the first axis toward a first direction side. Furthermore, a fifth position of the wavy groove structure 9*w* #*a* between the second position and the third position may be located at a position that is away from the first axis toward a second direction side (specifically, toward a side opposite to the first direction side).

The wavy groove structure 9*w* #*b* may satisfy a condition illustrated in FIG. 17. Namely, the wavy groove structure 9*w* #*b* may intersect with a second axis, which extends along a direction along which the wavy groove structure 9*w* #*b* extends, at each of a sixth position, a seventh position and an eighth position. Furthermore, a ninth position of the wavy groove structure 9*w* #*b* between the sixth position and the seventh position may be located at a position that is away from the second axis toward a third direction side. Furthermore, a tenth position of the wavy groove structure 9*w* #*b* between the seventh position and the eighth position may be located at a position that is away from the second axis toward a fourth direction side (specifically, toward a side opposite to the third direction side).

In a case where the riblet structure RB includes the wavy groove structures 9*w* #*a* and 9*w* #*b*, the riblet structure RB may include the wavy groove structure 9*w* that connects the wavy groove structure 9*w* #*a* and the wavy groove structure 9*w* #*b*. In the below-described description, the wavy groove structure 9*w* that connects the wavy groove structure 9*w* #*a* and the wavy groove structure 9*w* #*b* is referred to as a "wavy groove structure 9*w*_connect", for convenience of description. The wavy groove structure 9*w*_connect is typically formed between the wavy groove structure 9*w* #*a* and the wavy groove structure 9*w* #*b*. In a case where the riblet structure RB includes the plurality of wavy groove structures 9*w* #*a* and the plurality of wavy groove structures 9*w* #*b* as described above, the riblet structure RB may include a plurality of wavy groove structures 9*w*_connect that connect the plurality of wavy groove structures 9*w* #*a* and the plurality of wavy groove structures 9*w* #*b*, respectively. Namely, the riblet structure RB may include the plurality of wavy groove structures 9*w*_connect respective one of which connects respective one wavy groove structure 9*w* #*a* of the plurality of wavy groove structures 9*w* #*a* and respective one wavy groove structure 9*w* #*b* of the plurality of wavy groove structures 9*w* #*b*.

The wavy groove structure 9*w*_connects may satisfy a condition illustrated in FIG. 17. Namely, the wavy groove structure 9*w*_connect may intersect with a third axis, which extends along a direction along which the wavy groove structure 9*w*_connect extends, at each of an eleventh position, a twelfth position, and a thirteenth position. Furthermore, a fourteenth position of the wavy groove structure 9*w*_connect between the eleventh position and the twelfth position may be located at a position that is away from the third axis toward a fifth direction side. Further, a fifteenth position of the wavy groove structure 9*w*_connect between the twelfth position and the thirteenth position may be located at a position that is away from the third axis toward a sixth direction side (specifically, toward a side opposite to the fifth direction side).

Figure 18:
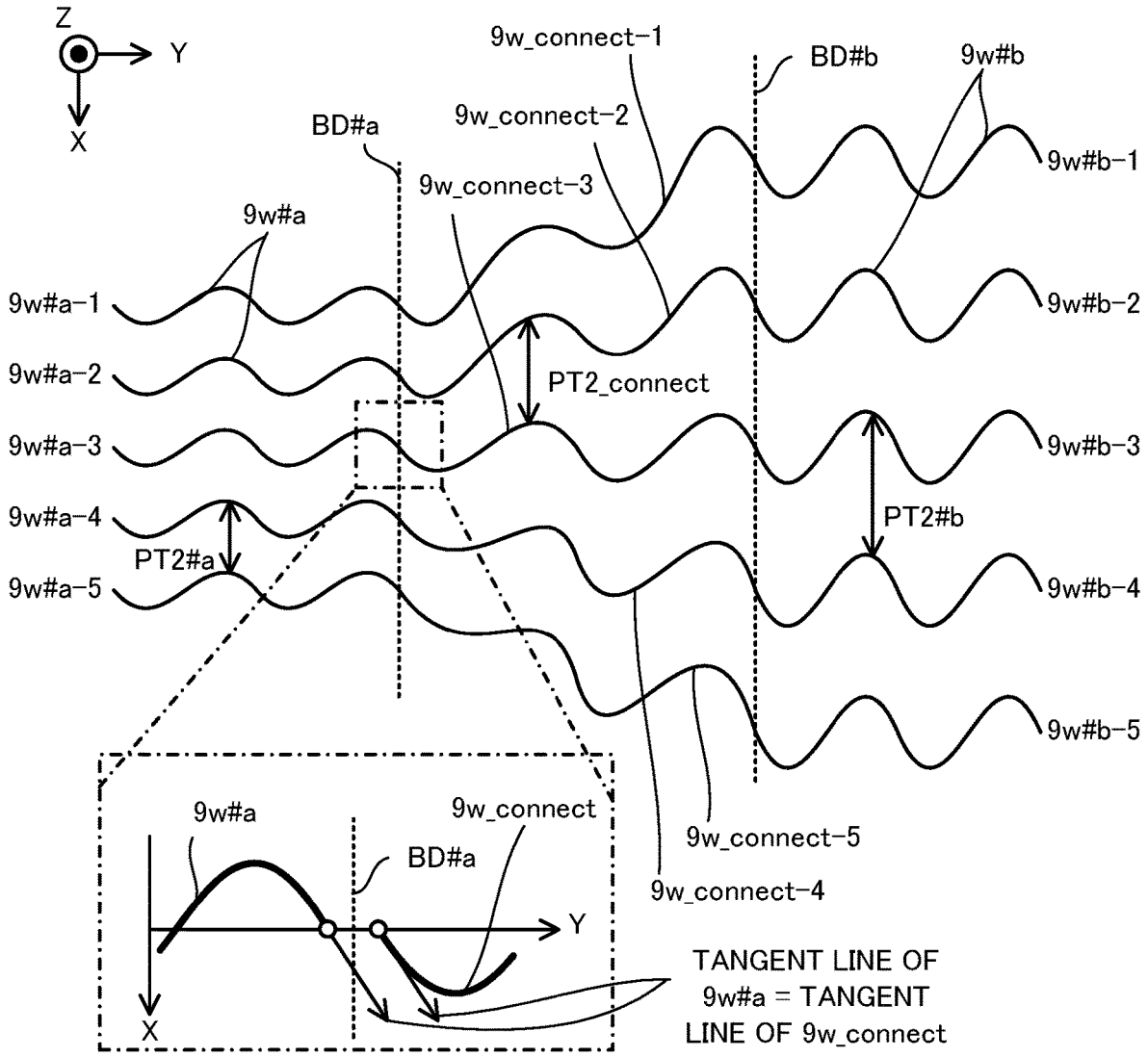
FIG. 18 is a planar view that illustrates the riblet structure including the wavy groove structure.

Next, with reference to FIG. 18, the riblet structure RB including the wavy groove structures 9*w* #a, 9*w* #*b*, and 9*w*_connect will be described. FIG. 18 is a planar view that schematically illustrates the riblet structure RB including the wavy groove structures 9*w* #a, 9*w* #*b*, and 9*w*_connect. Incidentally, in the below-described description, the wavy groove structure 9*w*_connect formed in a case where the arrangement pitch of the wavy groove structure 9*w* #*a* is different from the arrangement pitch of the wavy groove structure 9*w* #*b* will be described. However, the same can be applied to the wavy groove structure 9*w*_connect formed in a case where the arrangement pitch of the wavy groove structure 9*w* #*a* is same as the arrangement pitch of the wavy groove structure 9*w* #*b*.

As illustrated in FIG. 18, one edge part of one wavy groove structure 9*w*_connect, which connects one wavy groove structure 9*w* #*a* and one wavy groove structure 9*w* #*b*, is connected to an edge part of the one wavy groove structure 9*w* #a. In this case, the one wavy groove structure 9*w* #*a* and the one wavy groove structure 9*w*_connect may be connected smoothly at a boundary BD #a between the one wavy groove structure 9*w* #*a* and the one wavy groove structure 9*w*_connect. For example, the one wavy groove structure 9*w* #*a* and the one wavy groove structure 9*w*_connect may be connected so that a direction of a tangent line (namely, a direction along which the tangent line extends) of the one wavy groove structure 9*w* #*a* is same as a direction of a tangent line of the one wavy groove structure 9*w*_connect at the boundary BD #a. In this case, the one wavy groove structure 9*w* #*a* and the one wavy groove structure 9*w*_connect may be regarded to be connected smoothly, compared to a case where the direction of the tangent line of the one wavy groove structure 9*w* #*a* is different from the direction of the tangent line of the one wavy groove structure 9*w*_connect.

Furthermore, the other edge part of the one wavy groove structure 9*w*_connect is connected to an edge part of the one wavy groove structure 9*w* #*b*. In this case, the one wavy groove structure 9*w* #*b* and the one wavy groove structure 9*w*_connect may be connected smoothly at a boundary BD #b between the one wavy groove structure 9*w*1 #b and the one wavy groove structure 9*w*_connect. For example, the one wavy groove structure 9*w* #*b* and the one wavy groove structure 9*w*_connect may be connected so that a direction of a tangent line of the one wavy groove structure 9*w* #*b* is same as a direction of a tangent line of the one wavy groove structure 9*w*_connect at the boundary BD #a. In this case, the one wavy groove structure 9*w* #*b* and the one wavy groove structure 9*w*_connect may be regarded to be connected smoothly, compared to a case where the direction of the tangent line of the one wavy groove structure 9*w* #*b* is different from the direction of the tangent line of the one wavy groove structure 9*w* connect.

At least one of the plurality of wavy groove structures 9*w*_connect may extend along a direction intersecting with the direction along which the wavy groove structures 9*w #a* and 9*w #b*, to which the at least one wavy groove structure 9*w*_connect is connected, extend. In this case, all of the plurality of wavy groove structures 9*w*_connect may extend along the direction intersecting with the direction along which the wavy groove structures 9*w #a* and 9*w #b* extend. Alternatively, at least one of the plurality of wavy groove structures 9*w*_connects may extend along a direction parallel to the direction along which the wavy groove structures 9*w #a* and 9*w #b*, to which the at least one wavy groove structure 9*w*_connect is connected, extend. In the example illustrated in FIG. 18, the riblet structure RB includes: a wavy groove structure 9*w*_connect-1 that connects wavy groove structures 9*w* #a-1 and 9*w #b*-1 and that extends in a direction different from a direction along which the wavy groove structures 9*w* #a-1 and 9*w #b*-1 extend; a wavy groove structure 9*w*_connect-2 that connects wavy groove structures 9*w* #a-2 and 9*w #b*-2 and that extends in a direction different from a direction along which the wavy groove structures 9*w* #a-2 and 9*w #b*-2 extend; a wavy groove structure 9*w*_connect-3 that connects wavy groove structures 9*w* #a-3 and 9*w #b*-3 and that extends in a direction parallel to the direction along which the wavy groove structures 9*w* #a-1 and 9*w #b*-1 extend; a wavy groove structure 9*w*_connect-4 that connects wavy groove structures 9*w* #a-4 and 9*w #b*-4 and that extends in a direction different from a direction along which the wavy groove structures 9*w* #a-4 and 9*w #b*-4 extend; and a wavy groove structure 9*w*_connect-5 that connects wavy groove structures 9*w* #a-5 and 9*w #b*-5 and that extends in a direction different from a direction along which the wavy groove structures 9*w*#a-5 and 9*w #b*-5 extend.

The plurality of wavy groove structures 9*w*_connect may include at least two wavy groove structures 9*w*_connect extending along different directions. Namely, at least one of the plurality of wavy groove structures 9*w*_connect may extend along one direction and at least other one of the plurality of wavy groove structures 9*w*_connect may extend along another direction different from the one direction. In the example illustrated in FIG. 18, the directions along which the wavy groove structures 9*w*_connect-1 to 9*w*_connect-5 extend, respectively, are different from one another.

Incidentally, in the example illustrated in FIG. 18, the plurality of wavy groove structures 9*w #a* and the plurality of wavy groove structures 9*w #b* extend along the same direction (in the example illustrated in FIG. 18, the Y-axis direction). However, the plurality of wavy groove structures 9*w #a* may include at least two wavy groove structures 9*w #a* extending along different directions. The plurality of wavy groove structures 9*w #b* may include at least two wavy groove structures 9*w #b* extending along different directions. At least one of the plurality of wavy groove structures 9*w #a* may extend along a direction that intersects with a direction along which at least one of the plurality of wavy groove structures 9*w #b* extends.

In a case where the plurality of wavy groove structures 9*w*_connect include at least two wavy groove structures 9*w*_connect extending along the different directions, the arrangement pitch PT2_connect of the wavy groove structures 9*w*_connect may vary depending on the position thereof in the direction along which the wavy groove structure 9*w*_connect extend. However, the arrangement pitch PT2_connect may be constant regardless of the position thereof in the direction along which the wavy groove structure 9*w*_connect extends. In this case, typically, the plurality of wavy groove structures 9*w*_connect extend along the same direction.

Incidentally, the arrangement pitch PT2 #a of the wavy groove structure 9*w #a* may vary depending on the position thereof in the direction along which the wavy groove structure 9*w* #a extends. Alternatively, the arrangement pitch PT2 #a may be constant regardless of the position thereof in the direction along which the wavy groove structure 9*w #a* extends. Moreover, the arrangement pitch PT2 #b of the wavy groove structure 9*w #b* may vary depending on the position thereof in the direction along which the wavy groove structure 9*w #b* extends. Alternatively, the arrangement pitch PT2 #b may be constant regardless of the position thereof in the direction along which the wavy groove structure 9*w #b* extends.

An amplitude cycle (namely, a cycle of a wave) of the wavy groove structure 9*w*_connect may vary depending on the position thereof in the direction along which the wavy groove structure 9*w*_connect extends. For example, in a case where an amplitude cycle of the wavy groove structure 9*w #a* is different from an amplitude cycle of the wavy groove structure 9*w #b*, the amplitude cycle of the wavy groove structure 9*w*_connect may vary along the direction along which the wavy groove structure 9*w*_connect extends so as to vary (for example, vary in a continuous manner or in a stepwise manner) from the amplitude cycle of the wavy groove structure 9*w #a* to the amplitude cycle of the wavy groove structure 9*w #b*. For example, in a case where the amplitude cycle of the wavy groove structure 9*w #a* is different from the amplitude cycle of the wavy groove structure 9*w #b*, the amplitude cycle of the wavy groove structure 9*w*_connect may vary along the direction along which the wavy groove structure 9*w*_connect extends so that the amplitude cycle of the wavy groove structure 9*w #a* is same as the amplitude cycle of the wavy groove structure 9*w #a* at the boundary BD #a and the amplitude cycle of the wavy groove structure 9*w #a* is same as the amplitude cycle of the wavy groove structure 9*w #b* at the boundary BD #b. Alternatively, the amplitude cycle of the wavy groove structure 9*w*_connect may be constant regardless of the position thereof in the direction along which the wavy groove structure 9*w*_connect extends.

Note that the amplitude cycle of the wavy groove structure 9*w #a* may vary depending on the position thereof in the direction along which the wavy groove structure 9*w #a* extends. Alternatively, the amplitude cycle of the wavy groove structure 9*w #a* may be constant regardless of the position thereof in the direction along which the wavy groove structure 9*w* #a extends. Moreover, the amplitude cycle of the wavy groove structure 9*w #b* may vary depending on the position thereof in the direction along which the wavy groove structure 9*w #b* extends. Alternatively, the amplitude cycle of the wavy groove structure 9*w #b* may be constant regardless of the position thereof in the direction along which the wavy groove structure 9*w #b* extends.

An amplitude (namely, a range of an oscillation of the wave) of the wavy groove structure 9*w*_connect may vary depending on the position thereof in the direction along which the wavy groove structure 9*w*_connect extends. For example, in a case where an amplitude of the wavy groove structure 9*w #a* is different from an amplitude of the wavy groove structure 9*w #b*, the amplitude of the wavy groove structure 9*w*_connect may vary along the direction along which the wavy groove structure 9*w*_connect extends so as to vary (for example, vary in a continuous manner or in a stepwise manner) from the amplitude of the wavy groove structure 9*w #a* to the amplitude of the wavy groove structure 9*w #b*. For example, in a case where the amplitude of the wavy groove structure 9*w #a* is different from the amplitude of the wavy groove structure 9*w #b*, the amplitude of the wavy groove structure 9*w*_connect may vary along the direction along which the wavy groove structure 9*w*_connect extends so that the amplitude of the wavy groove structure 9*w #a* is same as the amplitude of the wavy groove structure 9*w* #a at the boundary BD #a and the amplitude of the wavy groove structure 9*w #a* is same as the amplitude of the wavy groove structure 9*w #b* at the boundary BD #b. Alternatively, the amplitude of the wavy groove structure 9*w*_connect may be constant regardless of the position thereof in the direction along which the wavy groove structure 9*w*_connect extends.

Note that the amplitude of the wavy groove structure 9*w #a* may vary depending on the position thereof in the direction along which the wavy groove structure 9*w #a* extends. Alternatively, the amplitude of the wavy groove structure 9*w #a* may be constant regardless of the position thereof in the direction along which the wavy groove structure 9*w #a* extends. Moreover, the amplitude of the wavy groove structure 9*w #b* may vary depending on the position thereof in the direction along which the wavy groove structure 9*w #b* extends. Alternatively, the amplitude of the wavy groove structure 9*w #b* may be constant regardless of the position thereof in the direction along which the wavy groove structure 9*w #b* extends.

The processing apparatus 1 may form the riblet structure RB including the wavy groove structures 9*w* #a, 9*w #b*, and 9*w*_connect as described below under the control of the control apparatus 3. Specifically, the processing apparatus 1 may first form the wavy groove structure 9*w* #a. Then, the processing apparatus 1 may form the wavy groove structure 9*w*_connect that is connected to the wavy groove structure 9*w* #a. In this case, the processing apparatus 1 may form the wavy groove structure 9*w*_connect while adjusting a characteristic of the wavy groove structure 9*w*_connect so that the wavy groove structure 9*w #a* and the wavy groove structure 9*w*_connect are smoothly connected to each other. For example, the processing apparatus 1 may form the wavy groove structure 9*w*_connect while adjusting the characteristic of the wavy groove structure 9*w*_connect so that the direction of the tangent line of the wavy groove structure 9*w #a* is same as the direction of the tangent line of the wavy groove structure 9*w*_connect at the boundary BD #a. The characteristic of the wavy groove structure 9*w*_connect may include at least one of the amplitude cycle, the amplitude, a phase, and a length of the wavy groove structure 9*w*_connect, for example. Then, the processing apparatus 1 may form the wavy groove structure 9*w #b* that is connected to the wavy groove structure 9*w*_connect. In this case, the processing apparatus 1 may form the wavy groove structure 9*w #b* while adjusting a characteristic of the wavy groove structure 9*w #b* so that the wavy groove structure 9*w #b* and the wavy groove structure 9*w*_connect are smoothly connected to each other. For example, the processing apparatus 1 may form the wavy groove structure 9*w #b* while adjusting the characteristic of the wavy groove structure 9*w #b* so that the direction of the tangent line of the wavy groove structure 9*w #b* is same as the direction of the tangent line of the wavy groove structure 9*w*_connect at the boundary BD #b. The characteristic of the wavy groove structure 9*w #b* may include at least one of the amplitude cycle, the amplitude, a phase, and a length of the wavy groove structure 9*w #b*, for example.

As described above, in the second specific example, the processing system SYS forms the riblet structure RB including the wavy groove structure 9*w*. Especially, the processing system SYS forms the riblet structure RB including the wavy groove structure 9*w*_connect that is formed between the wavy groove structures 9*w #a* and 9*w #b* so that the wavy groove structures 9*w #a* and 9*w #b* having different characteristics such as the arrangement pitch are smoothly connected to each other. As a result, it is possible to form the wavy groove structure 9*w* that extends more smoothly, compared to a case where the wavy groove structures 9*w #a* and 9*w #b* having the different characteristics such as the arrangement pitch are directly connected to each other (namely, without using the wavy groove structure 9*w*_connect). Thus, it is possible to form the riblet structure RB by which the resistance of the surface of the workpiece W to the fluid is properly reducible.

Incidentally, in the above-described description, the wavy groove structure 9*w*_connect connects the wavy groove structure 9*w #a* and the wavy groove structure 9*w #b*. However, the wavy groove structure 9*w*_connect may connect the wavy groove structure 9*w #a* and the groove structure extending linearly (namely, without having the wavy shape). Incidentally, in the below-described description, the groove structure 9 that extends linearly and that is connected to the wavy groove structure 9*w*_connect is referred to as a "non-wavy groove structure 9*n #b*". The non-wavy groove structure 9*n #b* is different from the wavy groove structure 9*w #b* having the wavy shape in that it does not have the wavy shape. Other feature of the non-wavy groove structure 9*n #b* may be same as other feature of the wavy groove structure 9*w #b*.

Figure 19:
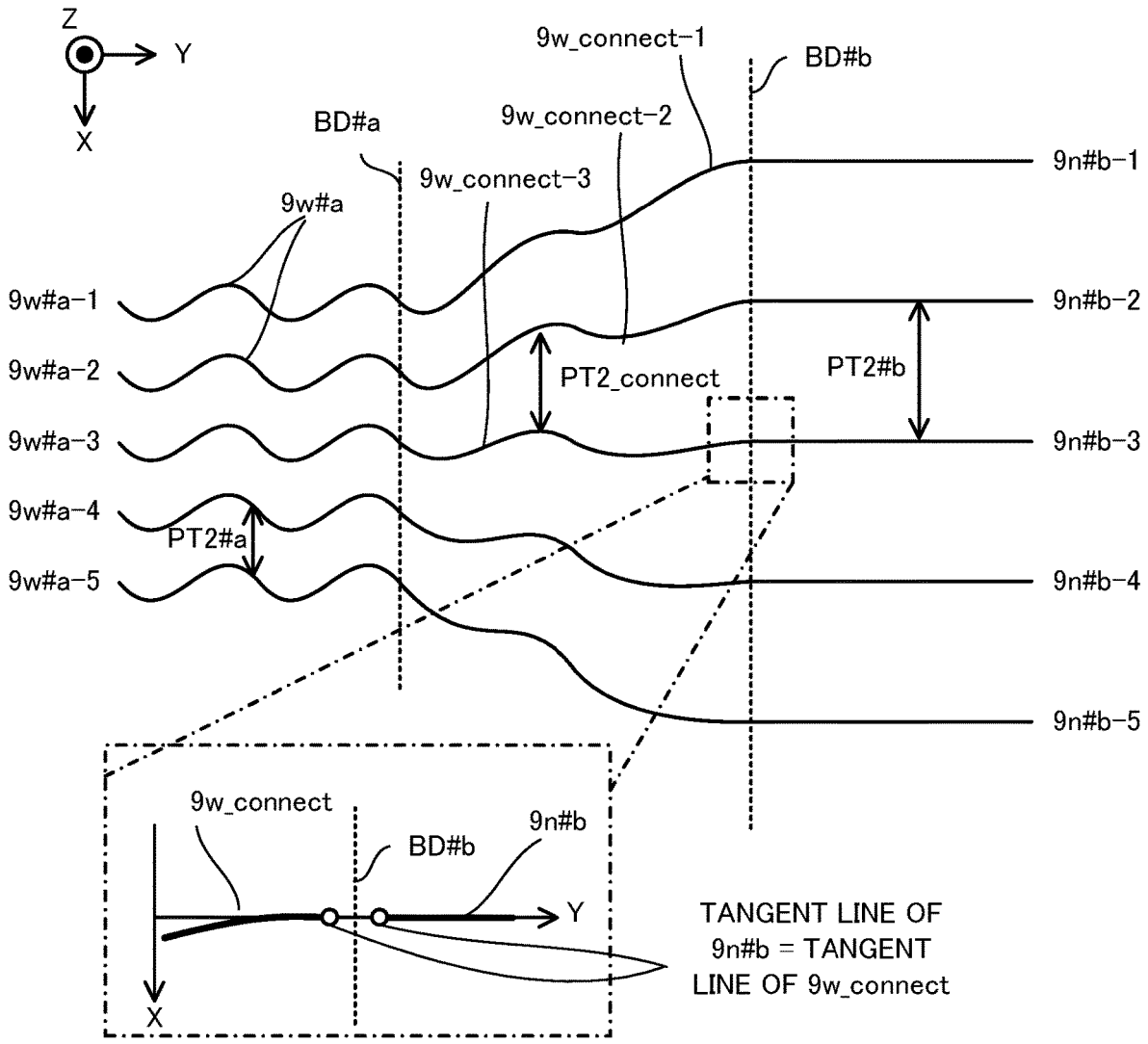
FIG. 19 is a planar view that illustrates the riblet structure including the wavy groove structure.

Even in this case, as illustrated in FIG. 19 that illustrates the wavy groove structure 9*w*_connect connecting the wavy groove structure 9*w #a* and the non-wavy groove structure 9*n #b*, one non-wavy groove structure 9*n #b* and one wavy groove structure 9*w*_connect may be connected smoothly at a boundary BD #b between the one non-wavy groove structure 9*w #b* and the one wavy groove structure 9*w*_connect. For example, the one non-wavy groove structure 9*n #b* and the one wavy groove structure 9*w*_connect may be connected so that a direction of a tangent line of the one non-wavy groove structure 9*n #b* is same as the direction of the tangent line of the one wavy groove structure 9*w*_connect at the boundary BD #a.

The amplitude of the wavy groove structure 9*w*_connect connected to the non-wavy groove structure 9*n #b* may vary depending on the position thereof in the direction along which the wavy groove structure 9*w*_connect extends. For example, the amplitude of the wavy groove structure 9*w*_connect may vary along the direction along which the wavy groove structure 9*w*_connect extends so as to be smaller as it is closer to the boundary BD #b. For example, the amplitude of the wavy groove structure 9*w*_connect may vary along the direction along which the wavy groove structure 9*w*_connect extends so that the amplitude of the wavy groove structure 9*w*_connect is zero at the boundary BD #b.

(3-3) Third Specific Example of Operation for Forming Riblet Structure RB

Figure 20A:
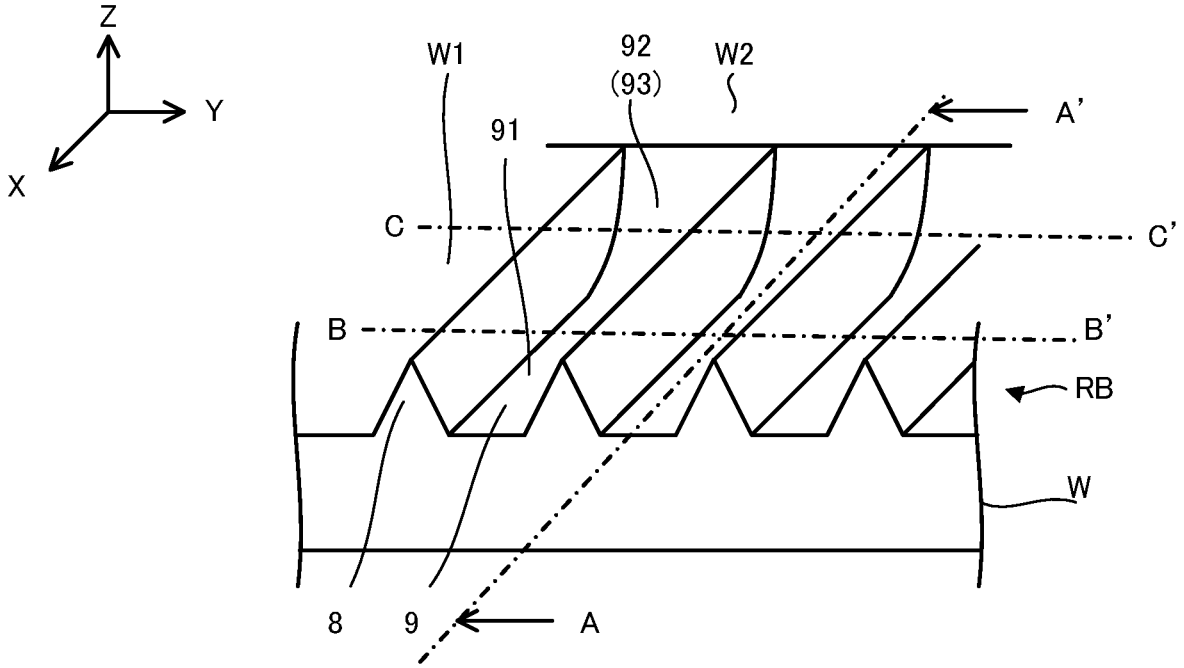
FIG. 20A is a perspective view that illustrates the riblet structure including a groove structure on which a terminal process has been performed.

Next, in a third specific example, the processing system SYS may form the riblet structure RB including the groove structure 9 on which a terminal process has been performed. Next, with reference to FIG. 20A and FIG. 20B, one example of the riblet structure RB including the groove structure 9 on which the terminal process is performed will be described. FIG. 20A is a perspective view that illustrates the riblet structure RB including the groove structure 9 on which the terminal process has been performed, and FIG. 20B is a cross-sectional view (especially, an A-A' cross-sectional view of FIG. 20A) that illustrates the riblet structure RB including the groove structure 9 on which the terminal process has been performed.

Figure 20B:
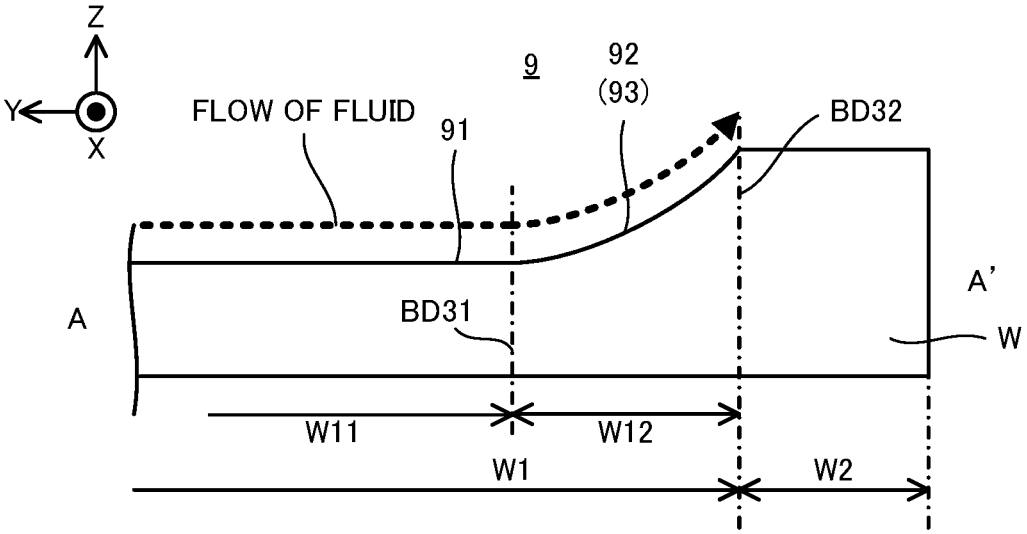
FIG. 20B is a cross-sectional view that illustrates the riblet structure including a groove structure on which the terminal process has been performed.

As illustrated in FIG. 20A and FIG. 20B, the groove structure 9 on which the terminal process has been performed is the groove structure 9 including a terminal structure 93 in which a depth of the groove varies depending on the position thereof in the direction along which the groove structure 9 extends. In this case, the processing system SYS may form the riblet structure RB that includes the groove structure 9 including the terminal structure 93 in which the depth of the groove varies depending on the position thereof in the direction along which the groove structure 9 extends. Thus, the terminal process may include a process for changing the depth of the groove structure 9 at an end edge of the groove structure 9 depending on the position thereof in the direction along which the groove structure 9 extends. Note that the "depth of the groove structure 9 (namely, the depth of the groove formed by the groove structure 9)" here may represent the position (in an example illustrated in FIG. 20A and FIG. 20B, the position in the Z-axis direction) of the bottom of the groove structure 9 relative to the peak of the land structure 8.

Specifically, the workpiece W includes a forming area W1 in which the riblet structure RB is formed (namely, the groove structure 9 is formed) and a non-forming area W2 in which the riblet structure RB is not formed (namely, the groove structure 9 is not formed). Furthermore, the forming area W1 includes a forming area W11 and a forming area W12 that are adjacent to each other along the direction along which the groove structure 9 extends. A part of the groove structure 9 is formed in the forming area W11. In the below-described description, the groove structure 9 formed in the forming area W11 is referred to as a "groove structure 91", for convenience of description. The forming area W12 is located between the forming area W11 and the non-forming area W2 along the direction along which the groove structure 9 extends. Another part of the groove structure 9, which is connected to a part of the groove structure 9 (namely, the groove structure 91) formed in the forming area W11, is formed in the forming area W12. In the below-described description, the groove structure 9 formed in the forming area W12 is referred to as a "groove structure 92", for convenience of description.

The processing system SYS changes the depth of the groove structure 92 formed in the forming area W12 depending on the position thereof in the direction along which the groove structure 9 extends. Namely, the processing system SYS forms the groove structure 92 in the forming area W12 so that the depth of the groove structure 92 formed in the forming area W12 varies depending on the position thereof in the direction along which the groove structure 9 extends. Thus, the groove structure 92 may constitute the terminal structure 93 described above.

Especially in the present example embodiment, the processing system SYS varies the depth of the groove structure 92 so that the depth of the groove structure 9 is shallower as the groove structure 92 is closer to the non-forming area W2 from the forming area W11 along the direction along which the groove structure 92 extends. Specifically, the processing system SYS changes the depth of the groove structure 92 depending on the position thereof in the direction along which the groove structure 9 extends so that the depth of the groove structure 92 at a second position, which is closer to the non-forming area W2 than a first position is, is shallower than the depth of the groove structure 92 at the first position. Thus, the terminal process may include a process for make the depth of the groove structure 9 be shallower as the groove structure 92 is closer to the non-forming area W2 from the forming area W11 along the direction along which the groove structure 92 extends.

Figure 21A:
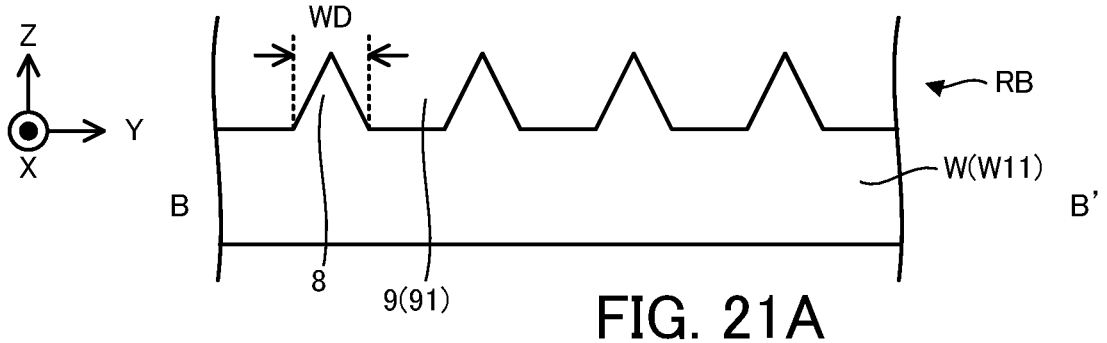
FIG. 21A is a cross-sectional view that illustrates a cross-section of the groove structure (especially, a B-B' cross-sectional view in FIG. 20A)
Figure 21B:
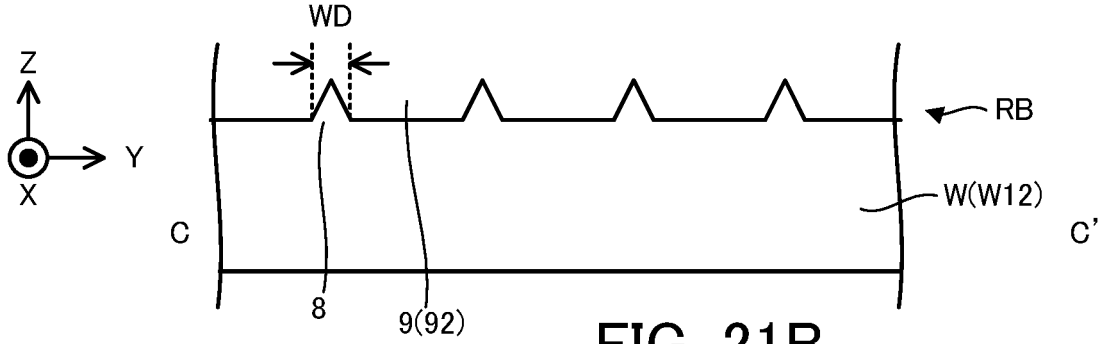
FIG. 21B is a cross-sectional view that illustrates a cross-section of the groove structure (especially, a C-C' cross-sectional view in FIG. 20A).
Figure 22A:
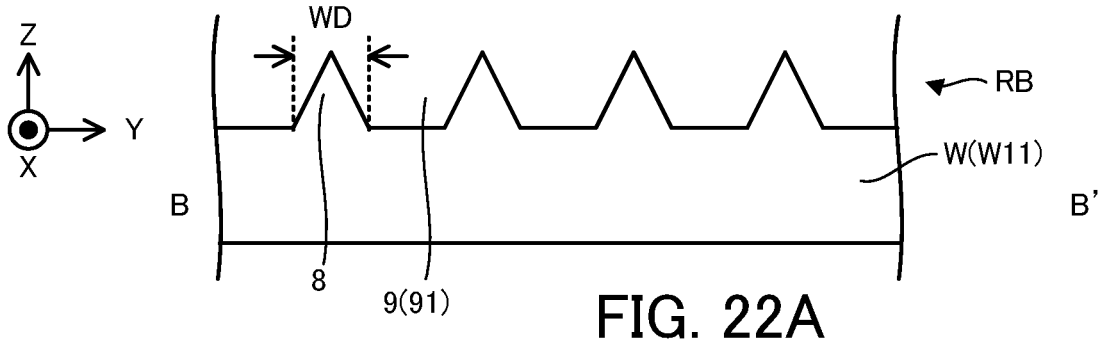
FIG. 22A is a cross-sectional view that illustrates a cross-section of the groove structure (especially, a B-B' cross-sectional view in FIG. 20A)
Figure 22B:
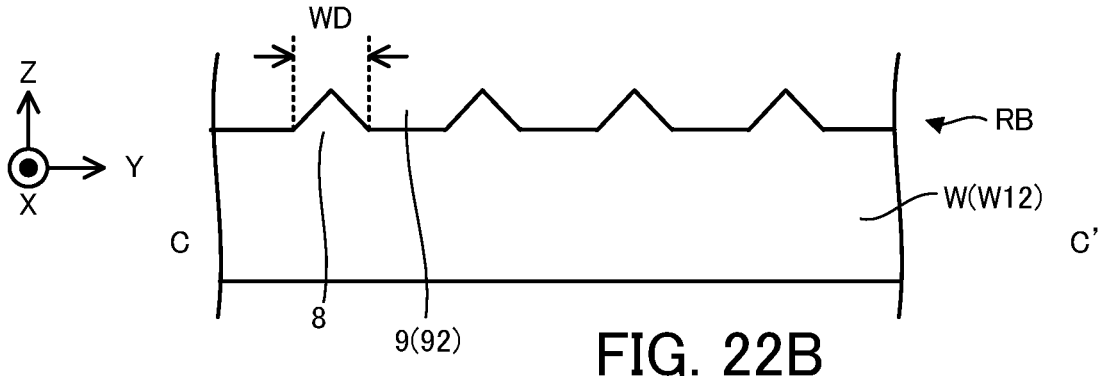
FIG. 22B is a cross-sectional view that illustrates a cross-section of the groove structure (especially, a C-C' cross-sectional view in FIG. 20A).

As illustrated in FIG. 21A that is a cross-sectional view illustrating a cross-section of the groove structure 91 (especially, a B-B' cross-sectional view in FIG. 20A), and FIG. 21B that is a cross-sectional view illustrating a cross-section of the groove structure 92 (especially, a C-C' cross-sectional view in FIG. 20A), the processing system may form the groove structure 92 so that a width WD of the groove structure 92 is smaller than a width WD of the groove structure 91. In this case, the processing system SYS may form the groove structure 92 so that the width WD of the groove structure 92 is smaller as the depth of the groove structure 92 is shallower. The processing system SYS may form the groove structure 92 so that the width WD of the groove structure 92 is smaller as the groove structure 92 is closer to the non-forming area W2 from the forming area W11 along the direction along which the groove structure 92 extends. Alternatively, illustrated in FIG. 22A that is a cross-sectional view illustrating a cross-section of the groove structure 91 (especially, a B-B' cross-sectional view in FIG. 20A), and FIG. 22B that is a cross-sectional view illustrating a cross-section of the groove structure 92 (especially, a C-C' cross-sectional view in FIG. 20A), the processing system may form the groove structure 92 so that the width WD of the groove structure 92 is equal to the width WD of the groove structure 91. In this case, the processing system SYS may form the groove structure 92 so that the width WD of the groove structure 92 is constant regardless of the depth of the groove structure 92. The processing system SYS may form the groove structure 92 so that the width WD of the groove structure 92 is constant regardless of the position thereof in the direction along which the groove structure 92 extends. Note that the "width WD of the groove structure 91" herein may mean a size of the groove structure 91 in a direction that intersects with the direction along which the groove structure 91 extends (namely, a size of the groove structure 91 in the direction along which the plurality of groove structures 91 are arranged). Similarly, the "width WD of the groove structure 92" herein may mean a size of the groove structure 92 in a direction that intersects with the direction along which the groove structure 92 extends (namely, a size of the groove structure 92 in the direction along which the plurality of groove structures 92 are arranged).

On the other hand, the processing system SYS may not form, in the forming area W11, the groove structure 91 whose depth is smaller as it is closer to the non-forming area W2. Namely, the depth of the groove structure 91 formed in the forming area W11 may not be shallower as the groove structure 91 is closer to the non-forming area W2. In this case, the processing system SYS may not change the depth of the groove structure 91 depending on the position thereof in the direction along which the groove structure 9 extends. For example, the processing system SYS may form the groove structure 91 in the forming area W11 so that the depth of the groove structure 91 is constant regardless of the position thereof in the direction along which the groove structure 9 extends.

The groove structure 92 and the groove structure 91 are connected to each other at a boundary BD31 between the forming area W11 and the forming area W12. In this case, the depth of the groove structure 92 may be equal to the depth of the groove structure 91 at the boundary BD31. Namely, the depth of the groove structure 92 at an edge part of the forming area W12 that is connected to an edge part of the forming area W11 may be the equal to the depth of the groove structure 91 at the edge part of the forming area W11 that is connected to the edge part of the forming area W12 in the direction along which the groove structure 9 extends.

The groove structure 92 may not exist at a boundary BD32 between the forming area W12 and the non-forming area W2. Namely, the processing system SYS may form the groove structure 92 in the forming area W12 so that the groove structure 92 does not exist at the boundary BD32. In this case, a height of the forming area W12 may be equal to a height of the non-forming area W2 at the boundary BD32. Namely, the height of an edge part of the forming area W12 that is connected to an edge part of the non-forming area W2 may be equal to the height of the edge part of the non-forming area W2 that is connected to the edge part of the forming area W12 in the direction along which the groove structure 9 extends.

Figure 23:
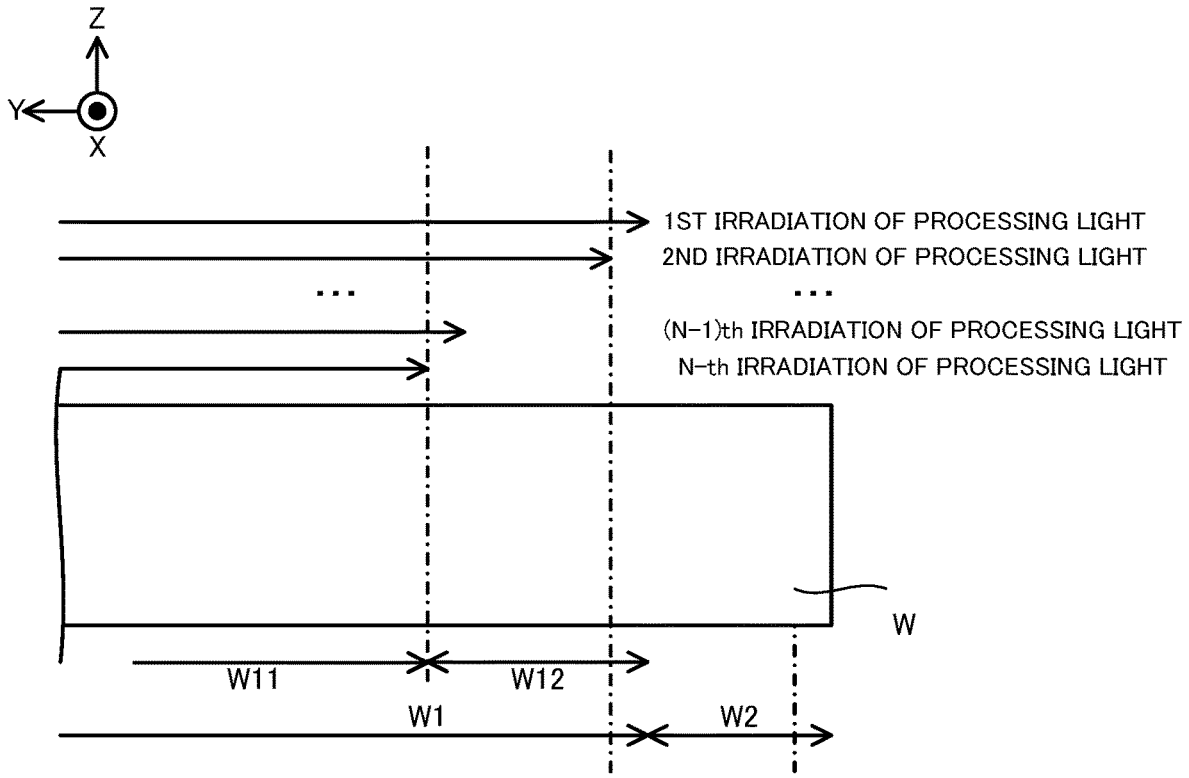
FIG. 23 illustrates the number of times of an irradiation of processing light relative to a formation area.

In order to form the groove structure 92 whose depth varies, the processing system SYS may control the number of times of the irradiation of the processing light EL under the control of the control apparatus 3. For example, the processing system SYS usually irradiates the same position on the workpiece W with the processing light EL a plurality of times in order to form the groove structure 92 having a certain depth. Specifically, in a case where the processing system SYS is configured to remove a structural part whose thickness is d from the workpiece W by the single irradiation of the processing light EL, the processing system SYS irradiates the same position on the workpiece W with the processing light EL D/d times in order to form the groove structure 92 whose depth is D. In this case, the depth of the formed groove structure 92 is shallower as the number of times of the irradiation of the processing light EL is smaller. Thus, as illustrated in FIG. 23 that illustrates the number of times of the irradiation of the processing light EL relative to the forming area W12, the processing system SYS may irradiate the forming area W12 with the processing light EL so that the number of times of the irradiation of the processing light EL relative to the forming area W12 is smaller as the irradiation position of the processing light EL is closer to the non-forming area W2. Namely, the processing system SYS may irradiate the forming area W12 with the processing light EL so that an area that is irradiated with the processing light EL in the forming area W12 is gradually smaller each time the workpiece W is irradiated with the processing light EL. The processing system SYS may irradiate the forming area W12 with the processing light EL so that an edge part on the non-forming area W2 side of the area that is irradiated with the processing light EL in the forming area W12 is gradually farther from the non-forming area W2.

Figure 24:
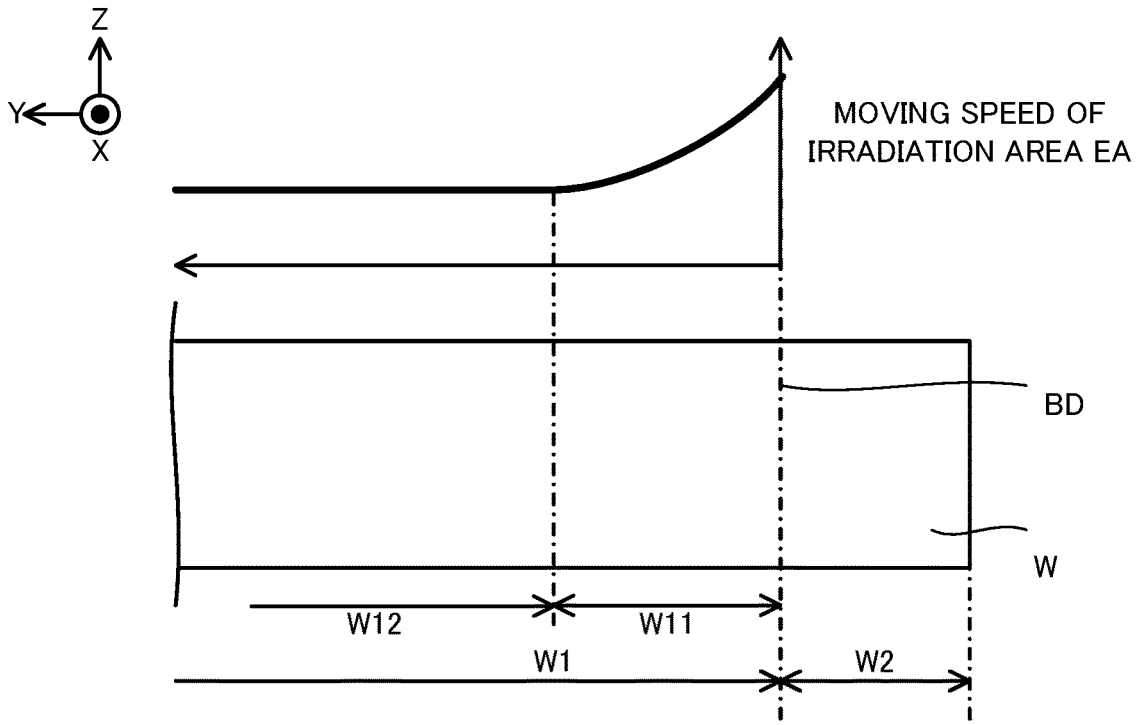
FIG. 24 illustrates a moving speed of an irradiation area in the formation area.
Figure 25:
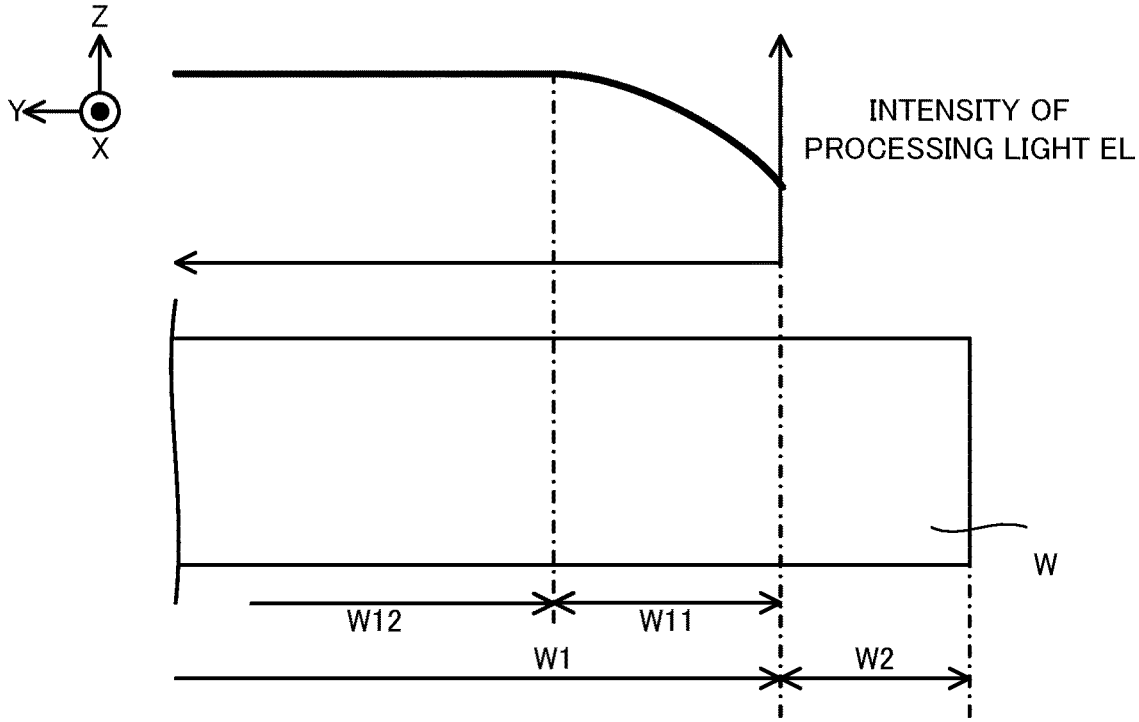
FIG. 25 illustrates an intensity of the processing light in the formation area.

In order to form the groove structure 92 whose depth varies, the processing system SYS may control a moving speed of the irradiation area EA of the processing light EL (namely, a sweeping speed of the processing light EL) under the control of the control apparatus 3. For example, an amount of an energy that is transferred from the processing light EL to the workpiece W per unit area or per unit time is lower as the moving speed of the irradiation area EA is faster. As a result, the thickness of the structural part that is removable from the workpiece W by the single irradiation of the processing light EL is thinner. Namely, the depth of the groove structure 9 formed in the workpiece W by the single irradiation of the processing light EL is shallower. Thus, as illustrated in FIG. 24 that illustrates the moving speed of the irradiation area EA in the forming area W12, the processing system SYS may irradiate the forming area W12 with the processing light EL so that the moving speed of the irradiation area EA in the forming area W12 is faster as the irradiation position of the processing light EL is closer to the non-forming area W2.

In order to form the groove structure 92 whose depth varies, the processing system SYS may control the intensity of the processing light EL under the control of the control apparatus 3. For example, the amount of the energy that is transferred from the processing light EL to the workpiece W per unit area or per unit time is lower as the intensity of the processing light EL is lower. As a result, the thickness of the structural part that is removable from the workpiece W by the single irradiation of the processing light EL is thinner. Namely, the depth of the groove structure 9 formed in the workpiece W by the single irradiation of the processing light EL is shallower. Thus, as illustrated in FIG. 24 that illustrates the intensity of the processing light EL in the forming area W12, the processing system SYS may irradiate the forming area W12 with the processing light EL so that the intensity of the processing light EL in the forming area W12 is lower as the irradiation position of the processing light EL is closer to the non-forming area W2.

Figure 26:
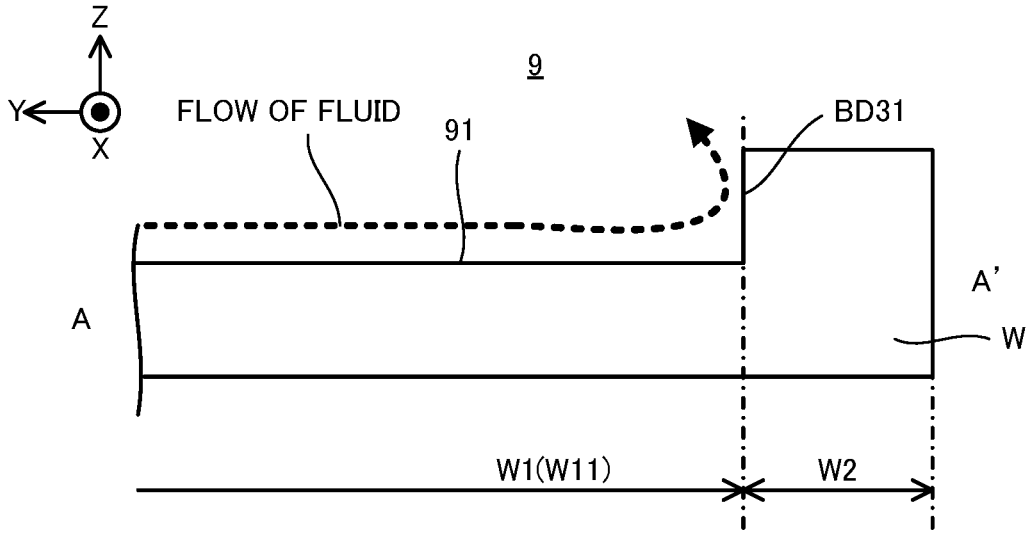
FIG. 26 is a cross-sectional view that illustrates the riblet structure not including the groove structure.

In a case where the riblet structure RB including the groove structure 92 whose depth varies is formed in this manner, a technical effect described below is achievable. First, in a comparative example in which the riblet structure RB that does not include the groove structure 92 is formed, as illustrated in FIG. 26 that is a cross-sectional view illustrating the riblet structure RB that does not include the groove structure 92, the fluid flowing along the groove structure 9 is blocked by a wall (typically, a wall that protrudes to block the flow of the fluid) that is formed by the non-forming area W2 at an edge part of the forming area W1 (W11) in which the groove structure 9 is formed. Thus, the fluid flowing along the groove structure 9 cannot easily flow out smoothly from the groove structure 9. As a result, the flow of the fluid is disturbed and thus the effect of reducing the resistance of the surface of the workpiece W to the fluid is reduced. On the other hand, in the present example embodiment in which the riblet structure RB including the groove structure 92 whose depth varies is formed, as illustrated in FIG. 20B, the fluid flowing along the groove structure 9 flows out smoothly from the groove structure 9 through the groove structure 92 that constitutes the terminal structure 93 of the groove structure 9. Thus, in the present example embodiment, the flow of fluid is less likely to be disturbed. As a result, in the present example embodiment, it is possible to form the riblet structure RB by which the resistance of the surface of the workpiece W to the fluid is properly reducible.

Figure 27:
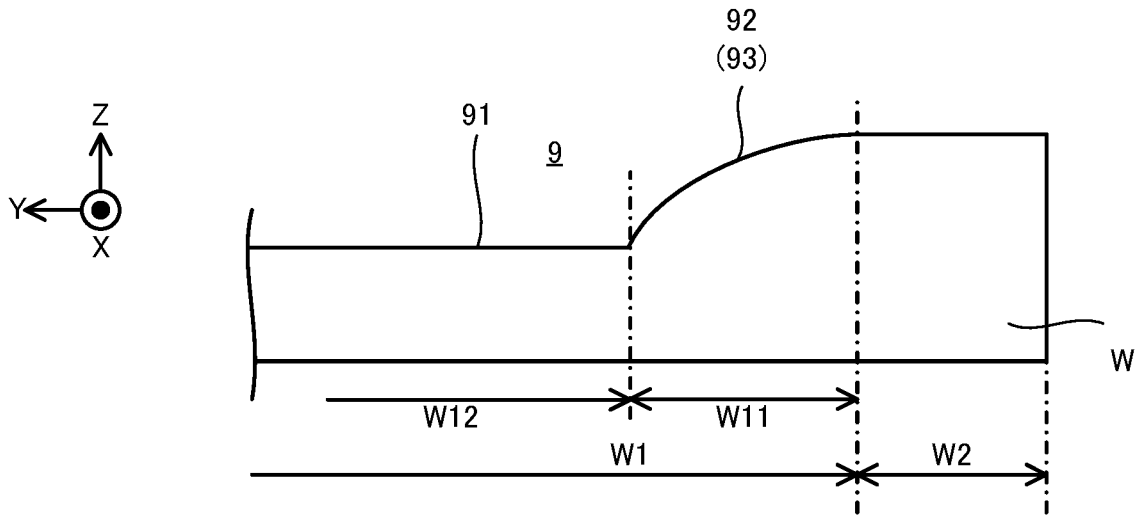
FIG. 27 is a cross-sectional view that illustrates the riblet structure including another example of the groove structure on which the terminal process has been performed.
Figure 28:
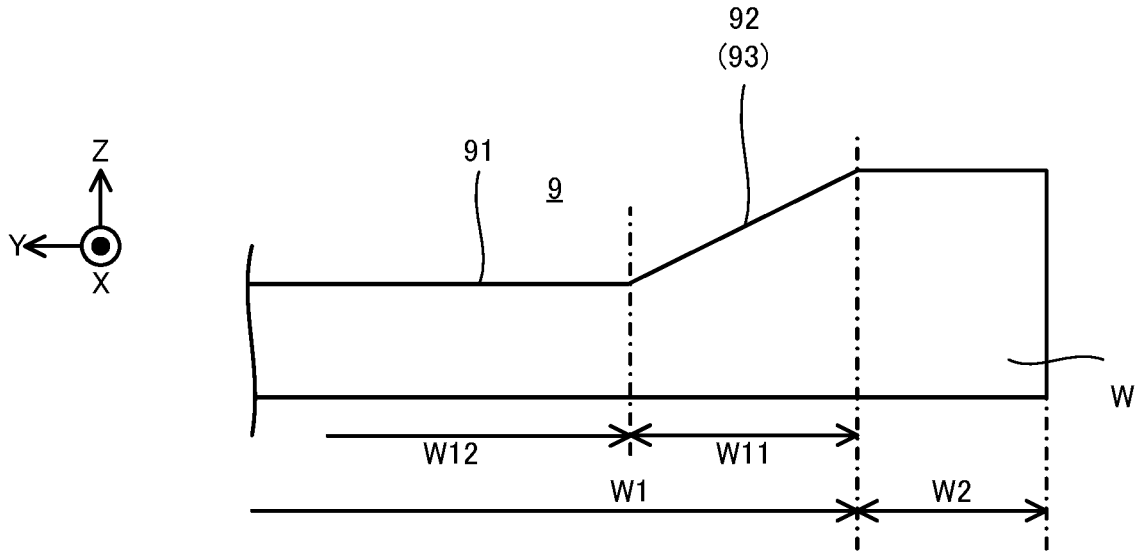
FIG. 28 is a cross-sectional view that illustrates the riblet structure including another example of the groove structure on which the terminal process has been performed.

Incidentally, in an example illustrated in FIG. 20A and FIG. 20B, the depth of the groove structure 92 varies so that a variation rate of the depth of the groove structure 9 is larger as the groove structure 92 is closer to the non-forming area W12. However, as illustrated in FIG. 27, the depth of the groove structure 92 may vary so that the variation rate of the depth of the groove structure 9 is smaller as the groove structure 92 is closer to the non-forming area W12. Alternatively, as illustrated in FIG. 28, the depth of the groove structure 92 may be constant regardless of the position thereof in the direction along which the groove structure 92 extends.

Figure 29:
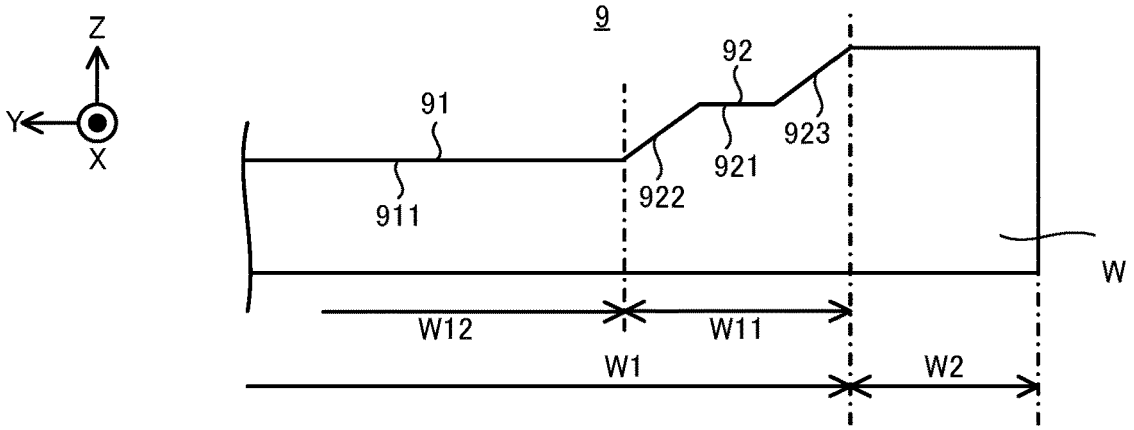
FIG. 29 is a cross-sectional view that illustrates the riblet structure including another example of the groove structure on which the terminal process has been performed.
Figure 30:
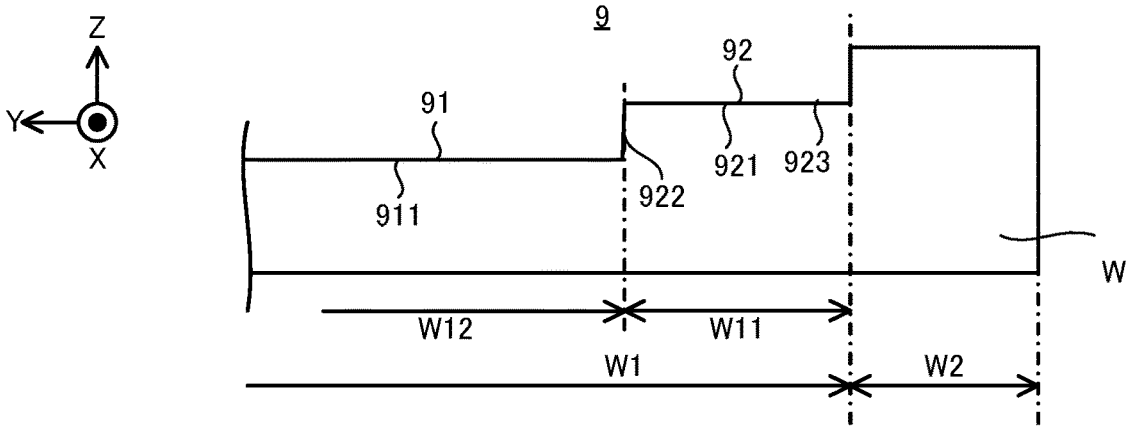
FIG. 30 is a cross-sectional view that illustrates the riblet structure including another example of the groove structure on which the terminal process has been performed.

Moreover, in the examples illustrated in FIG. 20A to FIG. 20B and FIG. 27 to FIG. 28, the depth of the groove structure 92 is shallower in a continuous manner as the groove structure 92 is closer to the non-forming area W12. However, as illustrated in FIG. 29 and FIG. 30, the depth of the groove structure 92 may be shallower in a stepwise manner as the groove structure 92 is closer to the non-forming area W12 from the forming area W11. In this case, as illustrated in FIG. 29 and FIG. 30, the groove structure 92 may include a bottom surface 921, a side surface 922, and a side surface 923. The bottom surface 921 may be parallel to the bottom surface 911 of the groove structure 91. The side surface 922 may be a surface extending upwardly (toward the +Z side in an example illustrated in FIG. 29) from an edge part at the non-forming area W2 side of the bottom surface 921 along a direction that is inclined with respect to the bottom surface 921, as illustrated in FIG. 29. Alternatively, the side surface 922 may be a surface extending upwardly (toward the +Z side in an example illustrated in FIG. 30) from the edge part at the non-forming area W2 side of the bottom surface 921 along a direction that is perpendicular to the bottom surface 921, as illustrated in FIG. 30. The side surface 923 may be a surface extending downwardly (toward the −Z side in the example illustrated in FIG. 29) from an edge part at the forming area W11 side of the bottom surface 921 along a direction that is inclined with respect to the bottom surface 921, as illustrated in FIG. 29. Alternatively, the side surface 923 may be a surface extending downwardly (toward the −Z side in the example illustrated in FIG. 29) from the edge part at the forming area W11 side of the bottom surface 921 along a direction that is perpendicular to the bottom surface 921, as illustrated in FIG. 30. Even in this case where the depth of the groove structure 92 is shallower in the stepwise manner, as with the case where the depth of the groove structure 92 is shallower in the continuous manner, it is possible to form the riblet structure RB by which the resistance of the surface of the workpiece W to the fluid is properly reducible, compared to a comparison example in which the riblet structure RB that does not include the groove structure 92 is formed.

Figure 31:
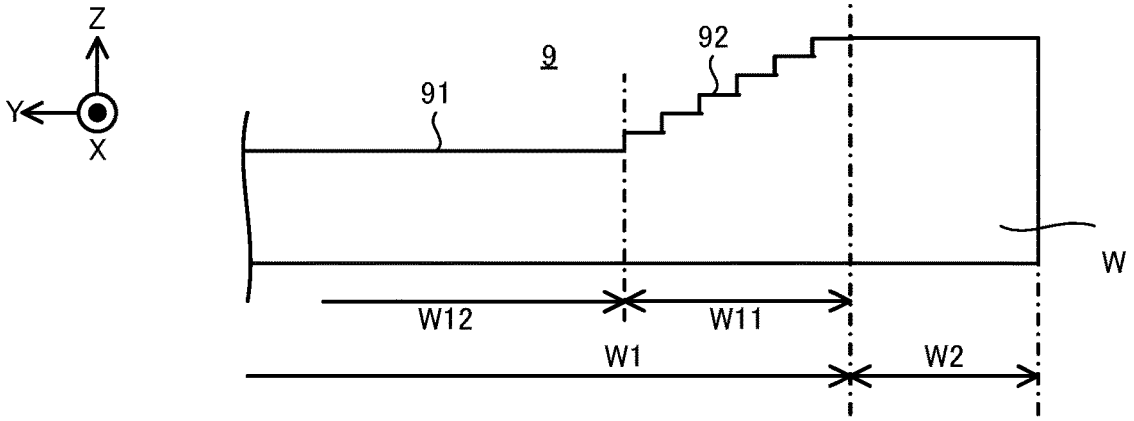
FIG. 31 is a cross-sectional view that illustrates the riblet structure including another example of the groove structure on which the terminal process is performed.

However, in a case where the depth of the groove structure 92 is shallower in the stepwise manner, the side surfaces 922 and 923, which may serve as the wall that blocks the flow of the fluid flowing through the groove structure 9, is formed as described above. Especially, in a case where the side surfaces 922 and 923 extend along the direction perpendicular to the bottom surface 921, there is a relatively high possibility that the side surfaces 922 and 923 serve as the wall that blocks the flow of the fluid flowing through the groove structure 9. Thus, in a case where the depth of the groove structure 92 is shallower in the stepwise manner, the groove structure 92 may be formed so that the height (namely, a size in the Z-axis direction) of the side surfaces 922 and 923 is relatively low, as illustrated in FIG. 31. Namely, the groove structure 92 may be formed so that a height of the wall (namely, a step) that blocks the flow of the fluid flowing through the groove structure 9 is relatively low. In this case, typically, the groove structure 92 may be formed so that a plurality of steps formed by the side surfaces 922 and 923 are formed (namely, a number of steps having low heights are formed).

(4) Modified Example (4-1) First Modified Example

The control apparatus 3 may generate the processing control information (for example, the processing path information) based on riblet information related to the riblet structure RB that should be formed on the workpiece W. Note that the riblet information related to the riblet structure RB may include at least one of information related to the riblet line RL, information related to the direction along which the groove structure 9 extends, information related to the size of the groove structure 9 (for example, at least one of the depth and the width of the groove), information related to the direction along which the land structure 8 extends, information related to the size of the land structure 8 (for example, information related to at least one of the height and the width of the mountain), information related to the arrangement pitch of the groove structure 9, and information related to the arrangement pitch of the land structure 8, for example.

The control apparatus 3 may acquire the riblet information from an outside of the processing system SYS and generate the processing control information based on the acquired riblet information. In this case, the control apparatus 3 may modify the acquired riblet information and generate the processing control information based on the modified riblet information. For example, the control apparatus 3 may modify the acquired riblet information based on a constraint condition caused by the processing apparatus 1 (namely, a constraint condition caused by the operation for processing the workpiece W). For example, the control apparatus 3 may modify the acquired riblet information based on a constraint conditions caused by the workpiece W. Next, an example of a modification of the riblet information will be described.

Figure 32:
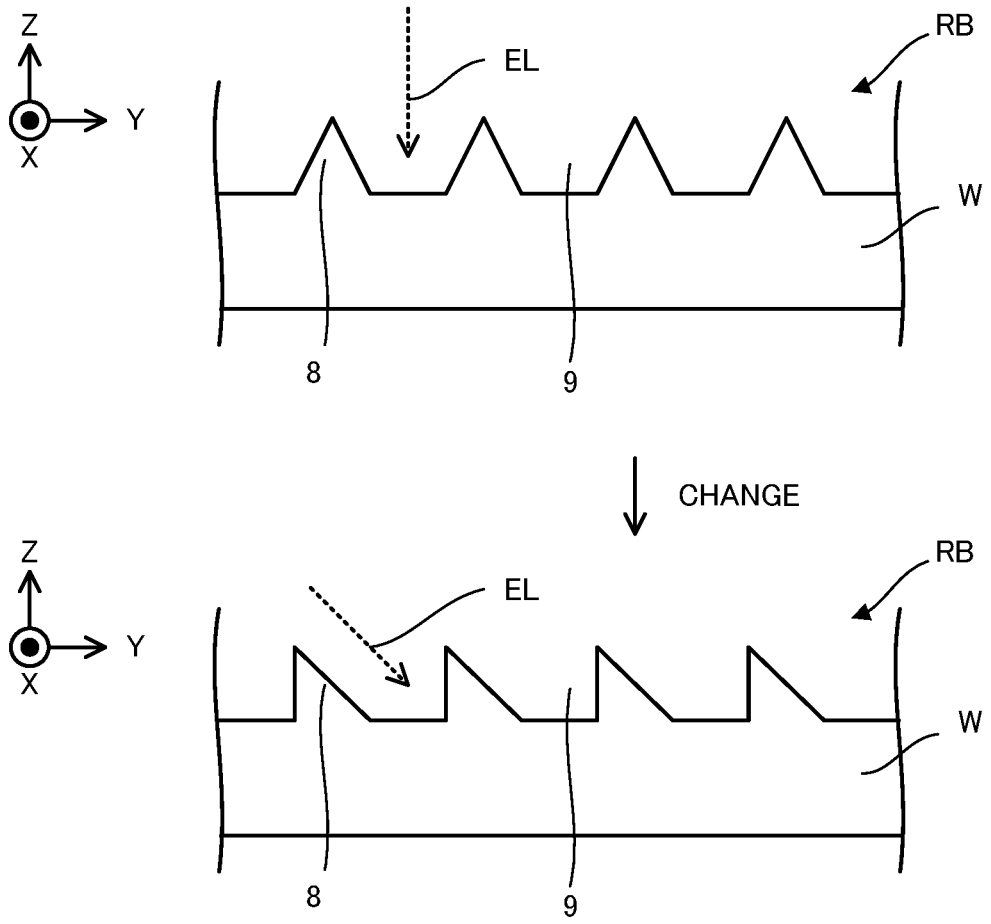
FIG. 32 is a cross-sectional view that illustrates the riblet structure indicated by non-corrected riblet information and the riblet structure indicated by corrected riblet information.

As described above, the processing apparatus 1 processes the workpiece W by irradiating the workpiece W with the processing light EL. Thus, in a case where a desired position of the workpiece W cannot be irradiated with the processing light EL although the desires position should be processed, the processing apparatus 1 cannot process the workpiece W properly. For example, there is a possibility that the processing light EL with which a first part of the workpiece W is irradiated to process the first part of the workpiece W is shielded by a second part of the workpiece W. In this case, the processing apparatus 1 cannot form the riblet structure RB indicated by the acquired riblet information by processing the first part of the workpiece W. Thus, in this case, the processing apparatus 1 may form the riblet structure RB that can be formed by the processing light EL with which the first part of the workpiece W is irradiated from a direction along which the processing light EL is not shielded by the second part of the workpiece W, instead of the riblet structure RB indicated by the acquired riblet information. In this case, the control apparatus 3 may modify the acquired riblet information to generate the riblet information related to the riblet structure RB that can be formed by the processing light EL with which the first part of the workpiece W is irradiated from the direction along which the processing light EL is not shielded by the second part of the workpiece W. As one example, in a case where the processing light EL that is emitted to vertically enter the first part of the workpiece W to process the first part of the workpiece W is shielded by the second part of the workpiece W, the control apparatus 3 may modify the acquired riblet information to generate the riblet information related to the riblet structure RB that can be formed by the processing light EL that is emitted to obliquely enter the first part of the workpiece W. Namely, as illustrated in FIG. 32, the control apparatus 32 may modify the riblet information related to the riblet structure RB (see an upper part of FIG. 32) formed by the processing light EL that vertically enters the workpiece W to generate the riblet structure RB (see a lower part of FIG. 32) formed by the processing light EL that obliquely enters the workpiece W.

Figure 33:
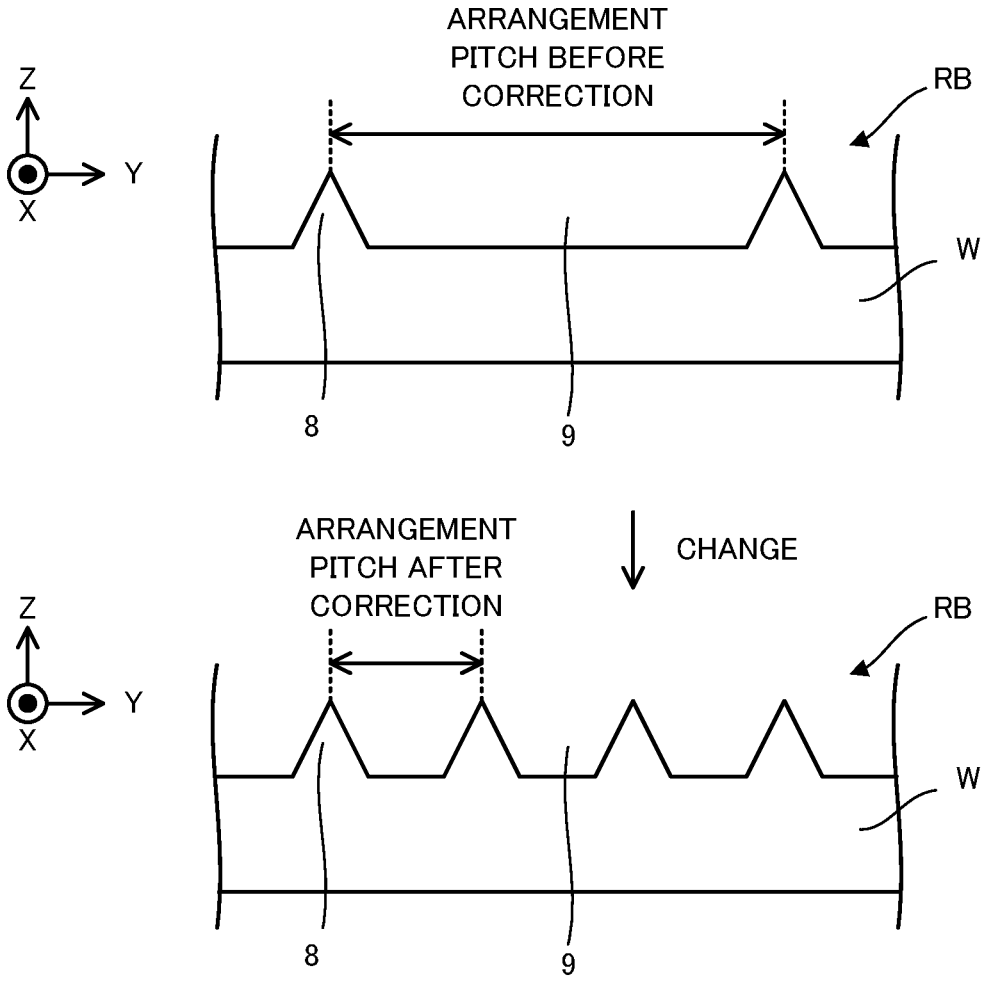
FIG. 33 is a cross-sectional view that illustrates the riblet structure indicated by the non-corrected riblet information and the riblet structure indicated by the corrected riblet information.

The control apparatus 3 may modify the riblet information so as to change the arrangement pitch of the groove structure 9 (alternatively, the arrangement pitch of the land structure 8, hereinafter the same is applied to the first modified example) indicated by the riblet information. For example, the time required to form the riblet structure RB is longer as the arrangement pitch is larger. Thus, as illustrated in FIG. 33, the control apparatus 3 may modify the riblet information so that the arrangement pitch of the groove structure 9 indicated by the riblet information decreases. As a result, the time required to form the riblet structure RB is reduced. Namely, a throughput for forming the riblet structure RB is improved. Alternatively, depending on a characteristic of the processing apparatus 1, there is a possibility that the processing apparatus 1 cannot form the plurality of groove structures 9 that are arranged at the arrangement pitch indicated by the riblet information. This is because the processing apparatus 1 is required to have a higher processing accuracy as the arrangement pitch is smaller, and thus, the arrangement pitch of the groove structures 9 that can be formed by the processing apparatus 1 has a lower limit value (a lower limit pitch) due to the characteristic of the processing apparatus 1 (for example, the processing accuracy). Thus, in a case where the arrangement pitch of the groove structure 9 indicated by the acquired riblet information is smaller than the lower limit pitch, the control apparatus 3 may modify the riblet information so that the arrangement pitch of the groove structure 9 indicated by the riblet information is changed to be equal to the lower limit pitch (alternatively, larger than the lower limit pitch). As a result, the processing apparatus 1 can properly form the riblet structure RB on the workpiece W without requiring an expensive optical system or the like to improve the processing accuracy. However, in a case where the arrangement pitch of the groove structures 9 indicated by the acquired riblet information is much smaller than the lower limit pitch (for example, less than N (wherein, N is a variable number that is larger than 0 and smaller than 100, for example, a variable number smaller than 60) % of the lower limit pitch), there is a possibility that the effect of reducing the resistance of the surface of the workpiece W to the fluid is reduced or is not achieved even when the plurality of groove structures 9 that are arranged at the lower limit pitch are formed. Thus, in a case where the arrangement pitch of the groove structures 9 indicated by the acquired riblet information is much smaller than the lower limit pitch, the processing apparatus 1 may not form the riblet structures RB on the workpiece W. In this case, the control apparatus 3 may output an alert that the riblet structure RB cannot be formed.

Figure 34:
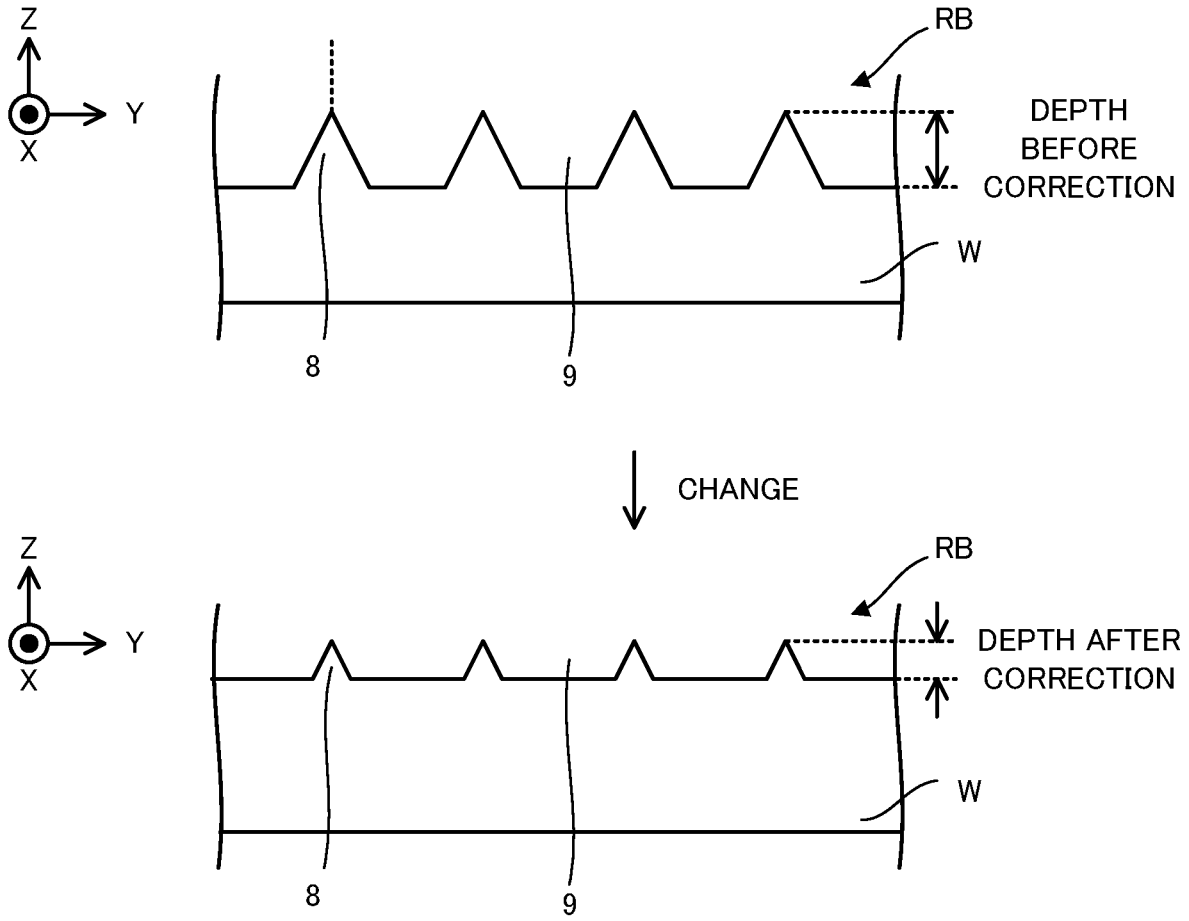
FIG. 34 is a cross-sectional view that illustrates the riblet structure indicated by the non-corrected riblet information and the riblet structure indicated by the corrected riblet information.

The control apparatus 3 may modify the riblet information so as to change the size of the groove structure 9 (alternatively, the size of the land structure 8, hereinafter the same is applied to the first modified example) indicated by the riblet information. For example, the time required to form the riblet structure RB is longer as the groove formed by the groove structure 9 is deeper. Thus, as illustrated in FIG. 34, the control apparatus 3 may modify the riblet information so that the depth of the groove structure 9 indicated by the riblet information decrease. As a result, the time required to form the riblet structure RB is reduced. Namely, the throughput for forming the riblet structure RB is improved. Alternatively, depending on a characteristic (for example, a size) of the workpiece W, there is a possibility that the processing apparatus 1 cannot form the groove structure 9 having the size (for example, the depth) indicated by the riblet information. There is a possibility that a quality of the workpiece W is excessively deteriorated (for example, a strength or composition of the workpiece W is excessively deteriorated) even when the groove structure 9 having the size (for example, the depth) indicated by the riblet information can be formed on the workpiece W. Thus, the control apparatus 3 may modify the riblet information so that the depth of the groove structure 9 indicated by the riblet information is changed to be a realistic depth that can be formed on the workpiece W. As a result, the processing apparatus 1 can properly form the riblet structure RB on the workpiece W while maintaining the quality of the workpiece W.

Incidentally, the control apparatus 3 may change the size of the groove structure 9 (for example, at least one of the width and the depth of the groove) together in changing the arrangement pitch of the groove structures 9. For example, the control apparatus 3 may change the size of the groove structure 9 together in changing the arrangement pitch of the groove structures 9 so that the changed arrangement pitch and the changed size satisfy a predetermined numerical condition. For example, the control apparatus 3 may change the size of the groove structure 9 together in changing the arrangement pitch of the groove structures 9 so that a ratio of the changed arrangement pitch to the changed size is a predetermined ratio. For example, the control apparatus 3 may change the size of the groove structure 9 together in changing the arrangement pitch of the groove structures 9 so that the ratio of the changed arrangement pitch to the changed size is 2:1.

Similarly, the control apparatus 3 may change the arrangement pitch of the groove structure 9 together in changing the size of the groove structures 9. For example, the control apparatus 3 may change the arrangement pitch of the groove structure 9 together in changing the size of the groove structures 9 so that so that the changed arrangement pitch and the changed size satisfy a predetermined numerical condition. For example, the control apparatus 3 may change the arrangement pitch of the groove structure 9 together in changing the size of the groove structures 9 so that a ratio of the changed arrangement pitch to the changed size is a predetermined ratio. For example, the control apparatus 3 may change the arrangement pitch of the groove structure 9 together in changing the size of the groove structures 9 so that the ratio of the changed arrangement pitch to the changed size is 2:1.

Figure 35:
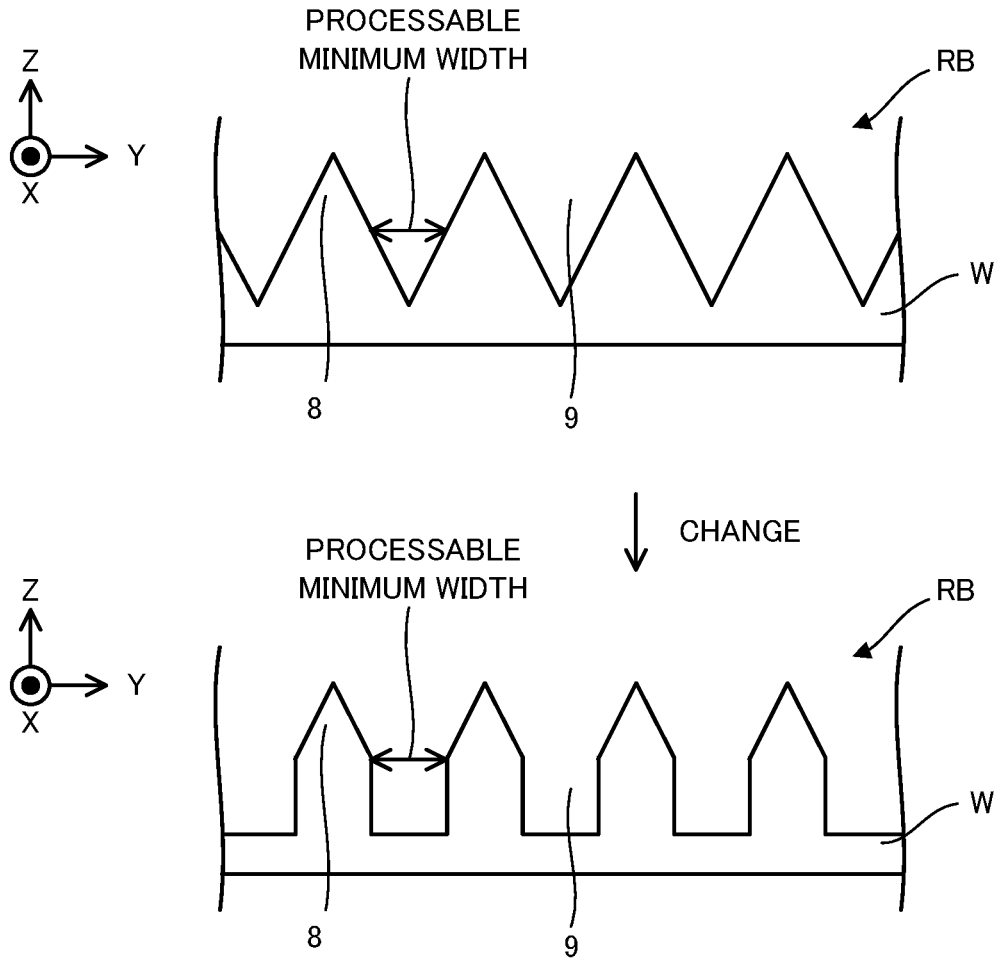
FIG. 35 is a cross-sectional view that illustrates the riblet structure indicated by the non-corrected riblet information and the riblet structure indicated by the corrected riblet information.

The control apparatus 3 may modify the riblet information so as to change a cross-sectional shape of the groove structure 9 (alternatively, a cross-sectional shape of the land structure 8, hereinafter the same is applied to the first modified example) indicated by the riblet information. For example, depending on the characteristic of the processing apparatus 1, there is a possibility that the processing apparatus 1 cannot form the groove structure 9 having the cross-sectional shape indicated by the riblet information. As one example, as illustrated in an upper part of FIG. 35, in a case where there is a minimum value of the width (a minimum width) of the groove that can be formed by the processing apparatus 1 due to the processing accuracy of the processing apparatus 1 although the riblet information indicating the groove structure 9 forming a V-shaped groove whose cross-sectional shape is an inverted triangle is acquired, the processing apparatus 1 cannot form the groove structure 9 indicated by the riblet information. Thus, the control apparatus 3 may modify the riblet information so that the cross-sectional shape of the groove structure 9 indicated by the riblet information is changed to be a realistic cross-sectional shape that can be formed by the processing apparatus 1. As one example, as illustrated in a lower part of FIG. 35, the processing apparatus 1 may modify the riblet information so that the width of the groove structure 9 indicated by the riblet information is changed not to be smaller than the minimum width that can be formed by the processing apparatus 1. As a result, the processing apparatus 1 can properly form the riblet structure RB on the workpiece W without requiring an expensive optical system or the like to improve the processing accuracy.

The control apparatus 3 may modify the riblet information so as to change a connection point between the groove structures 9 (alternatively, a connection point between the land structures 8, hereinafter the same is applied to the first modified example) indicated by the riblet information. For example, in a case where the length of the groove structure 9 is longer than a predetermined length, there is a possibility that the processing apparatus 1 cannot form the groove structure 9 at once. In this case, the processing apparatus 1 may form a first structural part of the groove structure 9 and then form a second structural part of the groove structure 9 so that it is connected to the first structural part. However, there is a possibility that a step may be formed at the connection point between the first structural part and the second structural part (namely, the connection between the groove structures 9). Thus, the control apparatus 3 may modify the riblet information so that the connection point between the groove structures 9 is located at a position on the surface of the workpiece W aw which the step of the groove structure 9 is allowed to exist. As a result, the processing apparatus 1 can properly form the riblet structure RB on the workpiece W.

As described above, the riblet information (especially, the information related to the riblet line RL described above) may be generated based on the direction of the streamline. On the other hand, depending on the shape of the workpiece W, there is a possibility that the directions of the streamlines are extremely complexly distributed on the surface of the workpiece W. The riblet information generated in such a situation that the streamlines extremely complexly distributed indicates the groove structures 9 (alternatively, the land structures 8) distributed in an extremely complex pattern on the surface of the workpiece W. As a result, there is a possibility that the processing apparatus cannot properly form the groove structures 9. Thus, the control apparatus 3 may modify the riblet information so that the directions along which the groove structures 9 (alternatively, the land structures 8) extend are averaged. The control apparatus 3 may modify the riblet information so that the groove structures 9 (alternatively, the land structures 8) extend along a direction along which the groove structures 9 (alternatively, the land structures 8) distributed in a complex pattern extend on average. As a result, the processing apparatus 1 can properly form the riblet structure RB on the workpiece W.

(4-2) Other Modified Example

The processing apparatus 1 may process the workpiece W to form a mold constituted by the processed workpiece W. In this case, the processing apparatus 1 may form the having a draft under the control of the control apparatus 3. Namely, the processing apparatus 1 may form the mold having a surface that is inclined toward a direction along which the mold is opened (namely, a direction along which a molded product formed by the mold is released) under the control of the control apparatus 3.

In the above-described description, the processing apparatus 1 includes the head driving system 12. However, the processing apparatus 1 may not include the head driving system 12. Namely, the processing head 11 may not be movable. Moreover, in the above-described description, the processing apparatus 1 includes the stage driving system 14. However, the processing apparatus 1 may not include the stage driving system 14. Namely, the stage 13 may not be movable.

In the above-described description, the example in which the processing apparatus 1 forms the riblet structure RB on the metallic workpiece W (namely, the base member) and the example in which the processing apparatus 1 forms the riblet structure RB on a coat coated on the surface of the workpiece W are described. However, the processing performed by processing apparatus 1 is not limited to the examples described above. For example, the processing apparatus 1 may form the riblet structure RB on the surface of the workpiece W, and the surface of the workpiece W on which the riblet structure RB has been formed may be coated with a coat. For example, in a case where the processing apparatus 1 forms the riblet structure RB on the coat coating the surface of the workpiece W, the coat on which the riblet structure RB has been formed may be further coated with another coat. In both examples, the riblet structure RB may be coated with the coat. In this case, a thickness of the coat may be determined so that the function of the riblet structure RB is not reduced by the coat in a case where the riblet structure RB is buried in the coat. For example, the thickness of the coat may be determined so that the riblet structure RB is not buried in the coat, because there is a possibility that the function of the riblet structure RB is reduced by the coat in a case where the riblet structure RB is buried in the coat. The coat may be formed along the shape of the riblet structure RB (for example, along the groove structure 9 or the land structure 8) so that the function of the riblet structure RB is not reduced by the coat coating the riblet structure RB.

The processing apparatus 1 may form the riblet structure RB on the surface of a film by using the workpiece W on the surface of which the film is formed. The film may be a resinous film, a metallic film, or a film made from another material.

A material of the coat (alternatively, the film) described above may be a material including at least one of CrN, TiN, TiLN, $Y_2O_3$, $ZrO_2$, MCrALY (alternatively, MCrAlY), NiCr, Wc (alternatively, WC), $Al_2O_3$—$TiO_2$, $Cr_2O_3$ and soluble aluminum or may be any other material. The coat coating on the surface of the metal workpiece W may have a plurality of layers. In this case, the material of a first layer of the plurality of layers may be the same as or different from the material of a second layer, which is be different from the first layer, of the plurality of layers. For example, the material of at least one of the first layer and the second layer may include or may not include at least one of CrN, TiN, TiLN, $Y_2O_3$, $ZrO_2$, MCrALY (alternatively, MCrAlY), NiCr, Wc (alternatively, WC), $Al_2O_3$—$TiO_2$, $Cr_2O_3$ and soluble aluminum.

An effect caused by coating the workpiece W with the coat (especially, an effect on the workpiece W) may include at least one of an effect of protecting the workpiece W, an effect of improving a heat shielding property of the workpiece W, an effect of improving a heat resistance of the workpiece W, an effect of improving a corrosion resistance of the workpiece W, an effect of improving an wear resistance of the workpiece W and an effect of improving an oxidation resistance of the workpiece W. An effect caused by forming the coat on the riblet structure RB (namely, an effect realized by the coat) may include at least one of an effect of protecting the riblet structure RB, an effect of improving a heat shielding property of the riblet structure RB, an effect of improving a heat resistance of the riblet structure RB, an effect of improving a corrosion resistance of the riblet structure RB, an effect of improving an wear resistance of the riblet structure RB and an effect of improving an oxidation resistance of the riblet structure RB. An effect caused by forming the plurality of layers of different materials on the workpiece W (for example, forming the coat including the plurality of layers of different materials) may include an anti-peeling effect. For example, the coat formed on the workpiece W may be selected based on a difference in a characteristic of thermal expansion between the coat close to the workpiece W and the workpiece W, and a difference in a characteristic of thermal expansion between the coat far from the workpiece W and the workpiece W. In a case where the difference in the characteristic of the thermal expansion between the coat close to the workpiece W and the workpiece W is smaller than the difference in the characteristic of the thermal expansion between the coat far from the workpiece W (for example, the coat on which the riblet structure RB is formed) and the workpiece W, it is possible to prevent the riblet structure RB from being peeled due to a spreading of the coat by heat.

In the above-described description, the processing system SYS forms the riblet structure RB that has the function of reducing the resistance of the surface of the workpiece W to the fluid. However, the processing system SYS may form, on the workpiece W, a structure that has a function different from the function of reducing the resistance of the surface of the workpiece W to the fluid. For example, the processing system SYS may form, on the workpiece W, a riblet structure that reduces noise generated when the fluid the surface of the workpiece W relative move. For example, the processing system SYS may form, on the workpiece W, a riblet structure that generates swirl relative to the flow of the fluid on the surface of the workpiece W. For example, the processing system SYS may form, on the workpiece W, a structure that provides hydrophobic property to the surface of the workpiece W.

In the above described description, the processing system SYS forms the riblet structure RB on the surface of the workpiece W. However, the processing system SYS may form any structure having any shape on the surface of the workpiece W A structure that generates a swirl relative to a flow of the fluid on the surface of the workpiece W is one example of any structure. A structure that provides hydrophobic property to the surface of the workpiece W is one example of any structure. A fine texture structure (typically, a concave and convex structure including a land structure and a groove structure) that is formed regularly or irregularly in a micro/nano-meter order is one example of any structure. The fine texture structure may include at least one of a shark skin structure or a dimple structure that has a function of reducing a resistance from a fluid (a liquid and/or a gas). The fine texture structure may include a lotus leaf surface structure that has at least one of a liquid repellent function and a self-cleaning function (for example, has a lotus effect). The fine texture structure may include at least one of a fine protrusion structure that has a liquid transporting function (US2017/0044002A1), a concave and convex structure that has a lyophile effect, a concave and convex structure that has an antifouling effect, a moth eye structure that has at least one of a reflectance reduction function and a liquid repellent function, a concave and convex structure that intensifies only light of a specific wavelength by interference to have a structural color, a pillar array structure that has an adhesion function using van der Waals force, a concave and convex structure that has an aerodynamic noise reduction function, a honeycomb structure that has a droplet collection function, a concave and convex structure that improves an adherence to a layer formed on a surface, a concave and convex structure for reducing a friction resistance, and so on. Even in this case, the groove structure included in the concave and convex structure may have a structure that is same as the groove structure 9 included in the riblet structure RB described above. The land structure included in the concave and convex structure may have a structure that is same as the land structure 8 included in the riblet structure RB described above. Note that the fine texture structure may not have any function.

In the above described description, the processing system SYS processes the workpiece W by irradiating the workpiece W with the processing lights EL. However, the processing system SYS may process the workpiece W by irradiating the workpiece W with any energy beam that is different from the light. In this case, the processing system SYS may include a beam irradiation apparatus that is configured to emit any energy beam in addition to or instead of the processing light source 2. At least one of a charged particle beam, an electromagnetic wave and the like is one example of any energy beam. A least one of an electron beam, an ion beam and the like is one example of the charged particle beam.

(5) Supplementary Note

Regarding the above-described embodiment, below-described supplementary notes are further disclosed.

[Supplementary Note 1]

A blade member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction.

the third groove structure extends along a third direction that is different from the first and second directions, and is formed between one first groove structure of the plurality of first groove structures and one second groove structure of the plurality of second groove structures.

[Supplementary Note 2]

The blade member according to the Supplementary Note 1, wherein each of a first angle and a second angle is larger than a third angle, the first angle corresponds to a larger angle of angles between a first axis extending along the first direction and a third axis extending along the third direction, the second angle corresponds to a larger angle of angles between a second axis extending along the second direction and the third axis, the third angle corresponds to a larger angle of angles between the first axis and the second axis.

[Supplementary Note 3]

The blade member according to the Supplementary Note 2, wherein a sum of the first angle and the second angle is an angle obtained by adding 180 degrees to the third angle.

[Supplementary Note 4]

The blade member according to any one of the Supplementary Notes 1 to 3, wherein a plurality of third groove structures are formed, at least two of the plurality of third groove structures extend along the third direction.

[Supplementary Note 5]

The blade member according to any one of the Supplementary Notes 1 to 4, wherein the plurality of first groove structures are parallel to each other, the plurality of second groove structures are parallel to each other,

[Supplementary Note 6]

The blade member according to the Supplementary Note 4, wherein an arrangement pitch of the plurality of third groove structures is constant regardless of a position thereof along the third direction.

[Supplementary Note 7]

The blade member according to any one of the Supplementary Notes 1 to 3, wherein a plurality of third groove structures are formed, at least one of the plurality of third groove structures extends along the third direction, at least other one of the plurality of third groove structures extends along a fourth direction that is different from the third direction.

[Supplementary Note 8]

The blade member according to any one of the Supplementary Notes 1 to 7, wherein an arrangement pitch of the plurality of first groove structures is different from an arrangement pitch of the plurality of second groove structures.

[Supplementary Note 9]

The blade member according to any one of the Supplementary Notes 1 to 3 and 7 to 8, wherein a plurality of third groove structures are formed, an arrangement pitch of two of the plurality of first groove structures connected to at least two of the plurality of third groove structures is different from an arrangement pitch of two of the plurality of second groove structures connected to at least two of the plurality of third groove structures.

[Supplementary Note 10]

The blade member according to the Supplementary Note 7 or 9, wherein an arrangement pitch of the plurality of third groove structures varies depending on a position thereof.

[Supplementary Note 11]

The blade member according to any one of the Supplementary Notes 1 to 10, wherein a structure having at least one of a protrusion-shape, a convex-shape, and a mountain-shape is included between adjacent two among the plurality of first groove structures, the plurality of second groove structures, and the third groove structure.

[Supplementary Note 12]

A blade member on a surface of which a groove structure is formed, wherein the groove structure includes a plurality of first groove structures, a plurality of second groove structures, and a third groove structure, the plurality of first groove structures have a first wavy shape extending in a first direction and are formed to be arranged along a direction intersecting with the first direction at a first arrangement pitch, the plurality of second groove structures have a second wavy shape extending in a second direction and are formed to be arranged along a direction intersecting with the second direction at a second arrangement pitch that is different from the first arrangement pitch.

the third groove structure has a third wavy shape extending in a third direction and is formed between one first groove structure of the plurality of first groove structures and one second groove structure of the plurality of second groove structures.

[Supplementary Note 13]

The blade member according to the Supplementary Note 12, wherein the one first groove structure and the third groove structure are connected to each other so that a direction of a tangent line of the one first groove structure is same as a direction of a tangent line of the third groove structure at a boundary between the one first groove structure and the third groove structure, the one second groove structure and the third groove structure are connected to each other so that a direction of a tangent line of the one second groove structure is same as a direction of a tangent line of the third groove structure at a boundary between the one second groove structure and the third groove structure.

[Supplementary Note 14]

The blade member according to the Supplementary Note 12 or 13, wherein a plurality of third groove structures are formed, at least one of the plurality of third groove structures extends along the third direction, at least other one of the plurality of third groove structures extends along a fourth direction that is different from the third direction.

[Supplementary Note 15]

The blade member according to any one of the Supplementary Notes 12 to 14, wherein an amplitude cycle of the third wavy shape varies depending on a position thereof along the third direction.

[Supplementary Note 16]

The blade member according to any one of the Supplementary Notes 12 to 15, w % herein an amplitude cycle of the third wavy shape is fixed regardless of a position thereof along the third direction.

[Supplementary Note 17]

The blade member according to any one of the Supplementary Notes 12 to 16, w % herein the third groove structure extends along a direction intersecting with the first and second directions.

[Supplementary Note 18]

The blade member according to any one of the Supplementary Notes 12 to 17, wherein the third groove structure extends along a direction parallel to the first and second directions.

[Supplementary Note 19]

The blade member according to any one of the Supplementary Notes 12 to 18, wherein an amplitude of the third wavy shape vanes depending on a position thereof along the third direction.

[Supplementary Note 20]

The blade member according to any one of the Supplementary Notes 12 to 19, wherein an amplitude of the third wavy shape is fixed regardless of a position thereof along the third direction.

[Supplementary Note 21]

A blade member on a surface of which a groove structure is formed, wherein the blade member comprises:

a first area in which a groove structure extending along a first direction is formed;

a second area in which the groove structure is not formed; and a third area which is located between the first area and the second area and in which a groove structure connected to the groove structure in the first area is formed, a depth of the groove structure formed in the third area is shallower as it is closer to the second area from the first area.

[Supplementary Note 22]

The blade member according to the Supplementary Note 21, wherein the depth of the groove structure formed in the third area is shallower in a continuous manner as it is closer to the second area from the first area along the first direction.

[Supplementary Note 23]

The blade member according to the Supplementary Note 21 or 22, wherein the depth of the groove structure formed in the third area is shallower in a stepwise manner as it is closer to the second area from the first area along the first direction.

[Supplementary Note 24]

The blade member according to any one of the Supplementary Notes 21 to 23, wherein a depth of the groove structure at an edge part of the first area is same as the depth of the groove structure at an edge part of the third area that is connected to the edge part of the first area.

[Supplementary Note 25]

The blade member according to any one of the Supplementary Notes 21 to 24, wherein a height of an edge part of the third area that is connected to the second area is same as a height of an edge part of the second area that is connected to the third area.

[Supplementary Note 26]

The blade member according to any one of the Supplementary Notes 21 to 25, wherein the groove structure including two grooves, which are arranged along a second direction intersecting with the first direction to form at least one of a protrusion-shape, a convex-shape, and a mountain-shape, is formed in the first area.

[Supplementary Note 27]

The blade member according to any one of the Supplementary Notes 21 to 26, wherein the groove structure including two grooves, which are arranged along a second direction intersecting with the first direction to form at least one of a protrusion-shape, a convex-shape, and a mountain-shape, is formed in at least a part of the third area.

[Supplementary Note 28]

The blade member according to the Supplementary Note 26 or 27, wherein a depth of the groove represents a position of a bottom of the groove relative to a peak of at least one of the protrusion-shape, the convex-shape, and the mountain-shape.

[Supplementary Note 29]

A structural member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction, the third groove structure extends along a third direction and is formed between one first groove structure of the plurality of first groove structures and one second groove structure of the plurality of second groove structures.

[Supplementary Note 30]

The structural member according to the Supplementary Note 30, wherein each of a first angle and a second angle is larger than a third angle, the first angle corresponds to a larger angle of angles between a first axis extending along the first direction and a third axis extending along the third direction, the second angle corresponds to a larger angle of angles between a second axis extending along the second direction and the third axis, the third angle corresponds to a larger angle of angles between the first axis and the second axis.

[Supplementary Note 31]

The structural member according to the Supplementary Note 29, wherein the third direction is a direction that is different from the first and second directions.

[Supplementary Note 32]

The structural member according to any one of the Supplementary Notes 29 to 31, wherein a plurality of third groove structures are formed.

at least two of the plurality of third groove structures extend along the third direction.

[Supplementary Note 33]

The structural member according to any one of the Supplementary Notes 29 to 32, wherein a plurality of third groove structures are formed, directions along which at least two of the plurality of third groove structures extend, respectively, are parallel to each other.

[Supplementary Note 34]

The structural member according to any one of the Supplementary Notes 29 to 33, wherein an arrangement pitch of the plurality of third groove structures is constant regardless of a position thereof along a direction along which the plurality of third groove structures extend.

[Supplementary Note 35]

The structural member according to any one of the Supplementary Notes 29 to 34, wherein a plurality of third groove structures are formed.

at least one of the plurality of third groove structures extends along the third direction, at least other one of the plurality of third groove structures extends along a fourth direction that intersects with the third direction.

[Supplementary Note 36]

The structural member according to any one of the Supplementary Notes 29 to 35, wherein a plurality of third groove structures are formed, directions along which at least two of the plurality of third groove structures extend, respectively, are non-parallel to each other.

[Supplementary Note 37]

The structural member according to the Supplementary Note 36, wherein an arrangement pitch of two of the plurality of first groove structures connected to at least two of the plurality of third groove structures is different from an arrangement pitch of two of the plurality of second groove structures connected to at least two of the plurality of third groove structures.

[Supplementary Note 38]

The structural member according to any one of the Supplementary Notes 29 to 37, wherein a plurality of third groove structures are formed, an arrangement pitch of the plurality of third groove structures varies depending on a position thereof along a direction along which the plurality of third groove structures extend.

[Supplementary Note 39]

The structural member according to any one of the Supplementary Notes 29 to 38, wherein a structure having at least one of a protrusion-shape, a convex-shape, and a mountain-shape is included between adjacent two among the plurality of first groove structures, the plurality of second groove structures, and the third groove structure.

[Supplementary Note 40]

The structural member according to any one of the Supplementary Notes 29 to 39, wherein the first direction is different from the second direction.

[Supplementary Note 41]

The structural member according to any one of the Supplementary Notes 29 to 40, wherein the first direction is same as the second direction.

[Supplementary Note 42]

The structural member according to any one of the Supplementary Notes 29 to 41, wherein an arrangement pitch of the first groove structures is different from an arrangement pitch of the second groove structures.

[Supplementary Note 43]

The structural member according to any one of the Supplementary Notes 29 to 42, wherein an arrangement pitch of the first groove structures is same as an arrangement pitch of the second groove structures.

[Supplementary Note 44]

The structural member according to any one of the Supplementary Notes 29 to 43, wherein the first direction is a direction along which a streamline in the first area of the surface, in which the plurality of first groove structures are formed, extends, the second direction is a direction along which a streamline in the second area of the surface, in which the plurality of second groove structures are formed, extends.

[Supplementary Note 45]

The structural member according to any one of the Supplementary Notes 29 to 44, wherein a structure having at least one of a protrusion-shape, a convex-shape, and a mountain-shape is included between adjacent two among the plurality of first groove structures, the plurality of second groove structures, and the third groove structure.

[Supplementary Note 46]

A structural member on a surface of which a groove structure is formed, wherein the groove structure includes a plurality of first groove structures, a plurality of second groove structures, and a third groove structure, the plurality of first groove structures have a first wavy shape extending in a first direction and are formed to be arranged along a direction intersecting with the first direction at a first arrangement pitch, the plurality of second groove structures have a second wavy shape extending in a second direction and are formed to be arranged along a direction intersecting with the second direction at a second arrangement pitch, the third groove structure has a third wavy shape extending in a third direction and is formed between one first groove structure of the plurality of first groove structures and one second groove structure of the plurality of second groove structures.

[Supplementary Note 47]

A structural member on a surface of which a groove structure is formed, wherein the groove structure includes: a plurality of first groove structures that extend in a first direction and that are arranged along a direction intersecting with the first direction at a first arrangement pitch; a plurality of second groove structures that extend in a second direction and that are arranged along a direction intersecting with the second direction at a second arrangement pitch; and a third groove structure that extends along a third direction.

the first groove structure intersects with a first axis, which is along the first direction, at first to third positions, a fourth position of the first groove structure between the first position and the second position is located at a position that is away from the first axis toward a fourth direction side, a fifth position of the first groove structure between the second position and the third position is located at a position that is away from the first axis toward a fifth direction side opposite to the fourth direction side, the second groove structure intersects with a second axis, which is along the second direction, at sixth to eighth positions, a ninth position of the second groove structure between the sixth position and the seventh position is located at a position that is away from the second axis toward a sixth direction side, a tenth position of the second groove structure between the seventh position and the eighth position is located at a position that is away from the second axis toward a seventh direction side opposite to the sixth direction side, the third groove structure intersects with a third axis, which is along the third direction, at eleventh to thirteenth positions, a fourteenth position of the third groove structure between the eleventh position and the twelfth position is located at a position that is away from the third axis toward a eighth direction side, a fifteenth position of the third groove structure between the twelfth position and the thirteenth position is located at a position that is away from the third axis toward a ninth direction side opposite to the eighth direction side, the third groove structure is formed between one first groove structure of the plurality of first groove structures and one second groove structure of the plurality of second groove structures.

[Supplementary Note 48]

The structural member according to the Supplementary Note 46 or 47, wherein the one first groove structure and the third groove structure are smoothly connected to each other at a boundary between the one first groove structure and the third groove structure, the one second groove structure and the third groove structure are smoothly connected to each other at a boundary between the one first groove structure and the third groove structure.

[Supplementary Note 49]

The structural member according to any one of the Supplementary Notes 46 to 48, wherein the one first groove structure and the third groove structure are connected to each other so that a direction of a tangent line of the one first groove structure is same as a direction of a tangent line of the third groove structure at a boundary between the one first groove structure and the third groove structure, the one second groove structure and the third groove structure are connected to each other so that a direction of a tangent line of the one second groove structure is same as a direction of a tangent line of the third groove structure at a boundary between the one second groove structure and the third groove structure.

[Supplementary Note 50]

A structural member on a surface of which a groove structure is formed, wherein the groove structure includes a plurality of first groove structures, a plurality of second groove structures, and a third groove structure, the plurality of first groove structures have a first wavy shape extending in a first direction and are formed to be arranged along a direction intersecting with the first direction at a first arrangement pitch, the plurality of second groove structures extend along a second direction and are formed to be arranged along a direction intersecting with the second direction at a second arrangement pitch, the third groove structure has a third wavy shape extending in a third direction and is formed between one first groove structure of the plurality of first groove structures and one second groove structure of the plurality of second groove structures.

[Supplementary Note 51]

A structural member on a surface of which a groove structure is formed, wherein the groove structure includes: a plurality of first groove structures that extend in a first direction and that are arranged along a direction intersecting with the first direction at a first arrangement pitch; a plurality of second groove structures that extend in a second direction and that are arranged along a direction intersecting with the second direction at a second arrangement pitch; and a third groove structure that extends along a third direction, the first groove structure intersects with a first axis, which is along the first direction, at first to third positions, a fourth position of the first groove structure between the first position and the second position is located at a position that is away from the first axis toward a fourth direction side, a fifth position of the first groove structure between the second position and the third position is located at a position that is away from the first axis toward a fifth direction side opposite to the fourth direction side, the third groove structure intersects with a second axis, which is along the third direction, at sixth to eighth positions, a ninth position of the third groove structure between the sixth position and the seventh position is located at a position that is away from the second axis toward a sixth direction side, a tenth position of the third groove structure between the seventh position and the eighth position is located at a position that is away from the second axis toward a seventh direction side opposite to the sixth direction side, the third groove structure is formed between one first groove structure of the plurality of first groove structures and one second groove structure of the plurality of second groove structures.

[Supplementary Note 52]

The structural member according to the Supplementary Note 50 or 51, wherein an edge part of the one second groove structure and an edge part of the third groove structure are located at the same position along a direction intersecting with the second direction at a boundary between the one second groove structure and the third groove structure.

[Supplementary Note 53]

The structural member according to any one of the Supplementary Notes 50 to 52, wherein the one second groove structure linearly extend along the second direction.

[Supplementary Note 54]

The structural member according to any one of the Supplementary Notes 50 to 53, wherein an amplitude of the third wavy shape is smaller as the third groove structure is closer to a boundary between the first second groove structure and the third groove structure.

[Supplementary Note 55]

The structural member according to the Supplementary Note 54, wherein the one first groove structure and the third groove structure are connected to each other so that a direction of a tangent line of the one first groove structure is same as a direction of a tangent line of the third groove structure at a boundary between the one first groove structure and the third groove structure, the one second groove structure and the third groove structure are connected to each other so that a direction of a tangent line of the one second groove structure is same as a direction of a tangent line of the third groove structure at a boundary between the one second groove structure and the third groove structure.

[Supplementary Note 56]

The structural member according to any one of the Supplementary Notes 46 to 49, wherein an amplitude cycle of the third wavy shape varies depending on a position thereof along the third direction.

[Supplementary Note 57]

The structural member according to any one of the Supplementary Notes 46 to 56, wherein an amplitude cycle of the third wavy shape is fixed regardless of a position thereof along the third direction.

[Supplementary Note 58]

The structural member according to any one of the Supplementary Notes 46 to 57, wherein an amplitude of the third wavy shape varies depending on a position thereof along the third direction.

[Supplementary Note 59]

The structural member according to any one of the Supplementary Notes 46 to 49, wherein an amplitude of the third wavy shape is fixed regardless of a position thereof along the third direction.

[Supplementary Note 60]

The structural member according to any one of the Supplementary Notes 46 to 59, wherein the third groove structure extends along a direction intersecting with the first and second directions.

[Supplementary Note 61]

The structural member according to any one of the Supplementary Notes 46 to 60, wherein the third groove structure extends along a direction parallel to the first and second directions.

[Supplementary Note 62]

A structural member on a surface of which a groove structure is formed, wherein the groove structure includes a plurality of third groove structures, one third groove structure of the plurality of third groove structures has a third wavy shape extending in a third direction, another third groove structure of the plurality of third groove structures has a fourth wavy shape extending in a fourth direction that is different from the third direction, an arrangement pitch of the plurality of third groove structures varies depending on a position thereof.

[Supplementary Note 63]

A structural member on a surface of which a groove structure is formed, wherein the groove structure includes a plurality of first groove structures and a plurality of third groove structures, the plurality of first groove structures have a first wavy shape extending in a first direction and are formed to be arranged along a direction intersecting with the first direction at a first arrangement pitch, the plurality of third groove structures includes one third groove structure having a third wavy shape extending in a third direction and another third groove structure having a fourth wavy shape extending in a fourth direction that is different from the third direction, and are formed to be connected to the plurality of first groove structures, respectively.

[Supplementary Note 64]

A structural member on a surface of which a groove structure is formed, wherein the structural member comprises:

a first area in which a groove structure extending in a first direction is formed;

a second area in which the groove structure is not formed; and a third area which is located between the first area and the second area and in which a groove structure connected to the groove structure in the first area is formed, a depth of the groove structure formed in the third area is shallower as it is closer to the second area from the first area.

[Supplementary Note 65]

The structural member according to the Supplementary Note 64, wherein the depth of the groove structure formed in the third area is shallower in a continuous manner as it is closer to the second area from the first area along the first direction.

[Supplementary Note 66]

The structural member according to the Supplementary Note 64 or 65, wherein the depth of the groove structure formed in the third area is shallower in a stepwise manner as it is closer to the second area from the first area along the first direction.

[Supplementary Note 67]

The structural member according to any one of the Supplementary Notes 64 to 66, wherein a depth of the groove structure at an edge part of the first area is same as the depth of the groove structure at an edge part of the third area that is connected to the edge part of the first area.

[Supplementary Note 68]

The structural member according to any one of the Supplementary Notes 64 to 67, wherein a height of an edge part of the third area that is connected to the second area is same as a height of an edge part of the second area that is connected to the third area.

[Supplementary Note 69]

The structural member according to any one of the Supplementary Notes 64 to 68, wherein the groove structure including two grooves, which are arranged along a second direction intersecting with the first direction to form at least one of a protrusion-shape, a convex-shape, and a mountain-shape, is formed in the first area.

[Supplementary Note 70]

The structural member according to any one of the Supplementary Notes 64 to 69, wherein the groove structure including two grooves, which are arranged along a second direction intersecting with the first direction to form at least one of a protrusion-shape, a convex-shape, and a mountain-shape, is formed in at least a part of the third area.

[Supplementary Note 71]

The structural member according to the Supplementary Note 64 or 70, wherein a depth of the groove represents a position of a bottom of the groove relative to a peak of at least one of the protrusion-shape, the convex-shape, and the mountain-shape.

[Supplementary Note 72]

The structural member according to the Supplementary Note 64 or 71, wherein the structural member includes at least one of a blade member that is a part of a rotational object, a body of a movable object, and a wing part of a flying object.

[Supplementary Note 73]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes: a plurality of first groove structures that extend in a first direction; a plurality of second groove structures that extend in a second direction that is different from the first direction; and a third groove structure that extends along a third direction and that is formed between one first groove structure of the plurality of first groove structures and one second groove structure of the plurality of second groove structures.

[Supplementary Note 74]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes: a plurality of first groove structures that have a first wavy shape extending in a first direction and are arranged along a direction intersecting with the first direction at a first arrangement pitch; a plurality of second groove structures that have a second wavy shape extending in a second direction and are arranged along a direction intersecting with the second direction at a second arrangement pitch; and a third groove structure that has a third wavy shape extending in a third direction and is formed between one first groove structure of the plurality of first groove structures and one second groove structure of the plurality of second groove structures.

[Supplementary Note 75]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes: a plurality of first groove structures that extend in a first direction and that are arranged along a direction intersecting with the first direction at a first arrangement pitch; a plurality of second groove structures that extend in a second direction and that are arranged along a direction intersecting with the second direction at a second arrangement pitch; and a third groove structure that extends along a third direction and is formed between one first groove structure of the plurality of first groove structures and one second groove structure of the plurality of second groove structures, the first groove structure intersects with a first axis, which is along the first direction, at first to third positions, a fourth position of the first groove structure between the first position and the second position is located at a position that is away from the first axis toward a fourth direction side, a fifth position of the first groove structure between the second position and the third position is located at a position that is away from the first axis toward a fifth direction side opposite to the fourth direction side, the second groove structure intersects with a second axis, which is along the second direction, at sixth to eighth positions, a ninth position of the second groove structure between the sixth position and the seventh position is located at a position that is away from the second axis toward a sixth direction side, a tenth position of the second groove structure between the seventh position and the eighth position is located at a position that is away from the second axis toward a seventh direction side opposite to the sixth direction side, the third groove structure intersects with a third axis, which is along the third direction, at eleventh to thirteenth positions, a fourteenth position of the third groove structure between the eleventh position and the twelfth position is located at a position that is away from the third axis toward a eighth direction side, a fifteenth position of the third groove structure between the twelfth position and the thirteenth position is located at a position that is away from the third axis toward a ninth direction side opposite to the eighth direction side.

[Supplementary Note 76]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes: a plurality of first groove structures that have a first wavy shape extending in a first direction and are arranged along a direction intersecting with the first direction at a first arrangement pitch; a plurality of second groove structures that extend in a second direction and are arranged along a direction intersecting with the second direction at a second arrangement pitch; and a third groove structure that has a third wavy shape extending in a third direction and is formed between one first groove structure of the plurality of first groove structures and one second groove structure of the plurality of second groove structures.

[Supplementary Note 77]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes: a plurality of first groove structures that extend in a first direction and that are arranged along a direction intersecting with the first direction at a first arrangement pitch, a plurality of second groove structures that extend in a second direction and that are arranged along a direction intersecting with the second direction at a second arrangement pitch, and a third groove structure that extends along a third direction and is formed between one first groove structure of the plurality of first groove structures and one second groove structure of the plurality of second groove structures, the first groove structure intersects with a first axis, which is along the first direction, at first to third positions, a fourth position of the first groove structure between the first position and the second position is located at a position that is away from the first axis toward a fourth direction side, a fifth position of the first groove structure between the second position and the third position is located at a position that is away from the first axis toward a fifth direction side opposite to the fourth direction side, the third groove structure intersects with a second axis, which is along the third direction, at sixth to eighth positions, a ninth position of the third groove structure between the sixth position and the seventh position is located at a position that is away from the second axis toward a sixth direction side, a tenth position of the third groove structure between the seventh position and the eighth position is located at a position that is away from the second axis toward a seventh direction side opposite to the sixth direction side.

[Supplementary Note 78]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes a plurality of third groove structures, one third groove structure of the plurality of third groove structures has a third wavy shape extending in a third direction, another third groove structure of the plurality of third groove structures has a fourth wavy shape extending in a fourth direction that is different from the third direction, an arrangement pitch of the plurality of third groove structures varies depending on a position thereof.

[Supplementary Note 79]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form the groove structure that includes: a plurality of first groove structures that have a first wavy shape extending in a first direction and are arranged along a direction intersecting with the first direction at a first arrangement pitch; and a plurality of third groove structures that includes one third groove structure having a third wavy shape extending in a third direction and another third groove structure having a fourth wavy shape extending in a fourth direction different from the third direction, and that are connected to the plurality of first groove structures, respectively.

[Supplementary Note 80]

A processing system comprising:

a processing apparatus that is configured to process an object by irradiating the object with an energy beam; and a control apparatus that is configured to control the processing apparatus to form a groove structure on a surface of the object by processing the object, wherein the control apparatus is configured to control the processing apparatus to form a groove structure extending in a first direction in a first area of the surface, and to form a groove structure connected to the groove structure in the first area in a third area of the surface that is located between the first area and a second area in which the groove structure is not formed, a depth of the groove structure formed in the third area is shallower as it is closer to the second area from the first area.

[Supplementary Note 81]

A processing method for processing an object to form a groove structure on a surface of the object by irradiating the object with an energy beam, wherein the groove structure includes a plurality of first groove structures, a plurality of second groove structures, and a third groove structure, the processing method includes:

forming the plurality of first groove structures that extend in a first direction:

forming the plurality of second groove structures that extend in a second direction that is different from the first direction; and forming a third groove structure that extends along a third direction and that is formed between one first groove structure of the plurality of first groove structures and one second groove structure of the plurality of second groove structures.

[Supplementary Note 82]

A processing method for processing an object to form a groove structure on a surface of the object by irradiating the object with an energy beam, wherein the groove structure includes a plurality of first groove structures, a plurality of second groove structures, and a third groove structure, the processing method includes:

forming the plurality of first groove structures that have a first wavy shape extending in a first direction and are arranged along a direction intersecting with the first direction at a first arrangement pitch:

forming the plurality of second groove structures that have a second wavy shape extending in a second direction and are arranged along a direction intersecting with the second direction at a second arrangement pitch; and forming the third groove structure that extends in a third direction and is formed between one first groove structure of the plurality of first groove structures and one second groove structure of the plurality of second groove structures.

[Supplementary Note 83]

A processing method for processing an object to form a groove structure on a surface of the object by irradiating the object with an energy beam, wherein the groove structure includes a plurality of first groove structures, a plurality of second groove structures, and a third groove structure, the processing method includes:

forming the plurality of first groove structures that extend in a first direction and that are arranged along a direction intersecting with the first direction at a first arrangement pitch;

forming the plurality of second groove structures that extend in a second direction and that are arranged along a direction intersecting with the second direction at a second arrangement pitch; and forming the third groove structure that extends along a third direction and is formed between one first groove structure of the plurality of first groove structures and one second groove structure of the plurality of second groove structures, the first groove structure intersects with a first axis, which is along the first direction, at first to third positions, a fourth position of the first groove structure between the first position and the second position is located at a position that is away from the first axis toward a fourth direction side, a fifth position of the first groove structure between the second position and the third position is located at a position that is away from the first axis toward a fifth direction side opposite to the fourth direction side, the second groove structure intersects with a second axis, which is along the second direction, at sixth to eighth positions, a ninth position of the second groove structure between the sixth position and the seventh position is located at a position that is away from the second axis toward a sixth direction side, a tenth position of the second groove structure between the seventh position and the eighth position is located at a position that is away from the second axis toward a seventh direction side opposite to the sixth direction side, the third groove structure intersects with a third axis, which is along the third direction, at eleventh to thirteenth positions, a fourteenth position of the third groove structure between the eleventh position and the twelfth position is located at a position that is away from the third axis toward a eighth direction side, a fifteenth position of the third groove structure between the twelfth position and the thirteenth position is located at a position that is away from the third axis toward a ninth direction side opposite to the eighth direction side.

[Supplementary Note 84]

A processing method for processing an object to form a groove structure on a surface of the object by irradiating the object with an energy beam.

wherein the groove structure includes a plurality of first groove structures, a plurality of second groove structures, and a third groove structure, the processing method includes:

forming the plurality of first groove structures that have a first wavy shape extending in a first direction and are arranged along a direction intersecting with the first direction at a first arrangement pitch;

forming the plurality of second groove structures that extend in a second direction and are arranged along a direction intersecting with the second direction at a second arrangement pitch; and forming the third groove structure that has a third wavy shape extending in a third direction and is formed between one first groove structure of the plurality of first groove structures and one second groove structure of the plurality of second groove structures.

[Supplementary Note 85]

A processing method for processing an object to form a groove structure on a surface of the object by irradiating the object with an energy beam, wherein the groove structure includes a plurality of first groove structures, a plurality of second groove structures, and a third groove structure, the processing method includes:

forming the plurality of first groove structures that extend in a first direction and that are arranged along a direction intersecting with the first direction at a first arrangement pitch;

forming the plurality of second groove structures that extend in a second direction and that are arranged along a direction intersecting with the second direction at a second arrangement pitch; and forming the third groove structure that extends along a third direction and is formed between one first groove structure of the plurality of first groove structures and one second groove structure of the plurality of second groove structures, the first groove structure intersects with a first axis, which is along the first direction, at first to third positions, a fourth position of the first groove structure between the first position and the second position is located at a position that is away from the first axis toward a fourth direction side, a fifth position of the first groove structure between the second position and the third position is located at a position that is away from the first axis toward a fifth direction side opposite to the fourth direction side, the third groove structure intersects with a second axis, which is along the third direction, at sixth to eighth positions, a ninth position of the third groove structure between the sixth position and the seventh position is located at a position that is away from the second axis toward a sixth direction side, a tenth position of the third groove structure between the seventh position and the eighth position is located at a position that is away from the second axis toward a seventh direction side opposite to the sixth direction side.

[Supplementary Note 86]

A processing method for processing an object to form a groove structure on a surface of the object by irradiating the object with an energy beam, wherein the groove structure includes a plurality of third groove structures, the processing method form the plurality of third groove structures so that one third groove structure of the plurality of third groove structures has a third wavy shape extending in a third direction, another third groove structure of the plurality of third groove structures has a fourth wavy shape extending in a fourth direction that is different from the third direction, and an arrangement pitch of the plurality of third groove structures varies depending on a position thereof.

[Supplementary Note 87]

A processing method for processing an object to form a groove structure on a surface of the object by irradiating the object with an energy beam, wherein the groove structure includes a plurality of first groove structures and a plurality of third groove structures, the processing method includes:

forming the plurality of first groove structures that have a first wavy shape extending in a first direction and are arranged along a direction intersecting with the first direction at a first arrangement pitch; and forming the plurality of third groove structures that includes one third groove structure having a third wavy shape extending in a third direction and another third groove structure having a fourth wavy shape extending in a fourth direction different from the third direction, and that are connected to the plurality of first groove structures, respectively.

[Supplementary Note 88]

A processing method for processing an object to form a groove structure on a surface of the object by irradiating the object with an energy beam, wherein the processing method includes:

forming a groove structure extending in a first direction in a first area of the surface; and forming a groove structure connected to the groove structure in the first area in a third area of the surface that is located between the first area and a second area in which the groove structure is not formed, a depth of the groove structure formed in the third area is shallower as it is closer to the second area from the first area.

[Supplementary Note A1]

A blade member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction, the third groove structure extends along a third direction that is different from the first and second directions, and is formed between one first groove structure of the plurality of first groove structures and one second groove structure of the plurality of second groove structures.

[Supplementary Note A2]

The blade member according to Supplementary Note A1, wherein each of a first angle and a second angle is larger than a third angle, the first angle corresponds to a larger angle of angles between a first axis extending along the first direction and a third axis extending along the third direction, the second angle corresponds to a larger angle of angles between a second axis extending along the second direction and the third axis, the third angle corresponds to a larger angle of angles between the first axis and the second axis.

[Supplementary Note A3]

The blade member according to Supplementary Note A2, wherein a sum of the first angle and the second angle is an angle obtained by adding 180 degrees to the third angle.

[Supplementary Note A4]

The blade member according to any one of Supplementary Notes A1 to A3, wherein a plurality of third groove structures are formed, at least two of the plurality of third groove structures extend along the third direction.

[Supplementary Note A5]

The blade member according to any one of Supplementary Notes A1 to A4, wherein the plurality of first groove structures are parallel to each other.

the plurality of second groove structures are parallel to each other.

[Supplementary Note A6]

The blade member according to Supplementary Note A4, wherein an arrangement pitch of the plurality of third groove structures is constant regardless of a position thereof along the third direction.

[Supplementary Note A7]

The blade member according to any one of Supplementary Notes A1 to A3, wherein a plurality of third groove structures are formed, at least one of the plurality of third groove structures extends along the third direction, at least other one of the plurality of third groove structures extends along a fourth direction that is different from the third direction.

[Supplementary Note A8]

The blade member according to any one of Supplementary Notes A1 to A7, wherein an arrangement pitch of the plurality of first groove structures is different from an arrangement pitch of the plurality of second groove structures.

[Supplementary Note A9]

The blade member according to any one of Supplementary Notes A1 to A3 and A7 to A8, wherein a plurality of third groove structures are formed, an arrangement pitch of two of the plurality of first groove structures connected to at least two of the plurality of third groove structures is different from an arrangement pitch of two of the plurality of second groove structures connected to at least two of the plurality of third groove structures.

[Supplementary Note A10]

The blade member according to Supplementary Notes A7 or A9, wherein an arrangement pitch of the plurality of third groove structures varies depending on a position thereof.

[Supplementary Note A11]

The blade member according to any one of Supplementary Notes A1 to A10, wherein a structure having at least one of a protrusion-shape, a convex-shape, and a mountain-shape is included between adjacent two among the plurality of first groove structures, the plurality of second groove structures, and the third groove structure.

[Supplementary Note A12]

A blade member on a surface of which a groove structure is formed, wherein the groove structure includes a plurality of first groove structures, a plurality of second groove structures, and a third groove structure, the plurality of first groove structures have a first wavy shape extending in a first direction and are formed to be arranged along a direction intersecting with the first direction at a first arrangement pitch, the plurality of second groove structures have a second wavy shape extending in a second direction and are formed to be arranged along a direction intersecting with the second direction at a second arrangement pitch that is different from the first arrangement pitch, the third groove structure has a third wavy shape extending in a third direction and is formed between one first groove structure of the plurality of first groove structures and one second groove structure of the plurality of second groove structures.

[Supplementary Note A13]

The blade member according to Supplementary Note A12, wherein the one first groove structure and the third groove structure are connected to each other so that a direction of a tangent line of the one first groove structure is same as a direction of a tangent line of the third groove structure at a boundary between the one first groove structure and the third groove structure, the one second groove structure and the third groove structure are connected to each other so that a direction of a tangent line of the one second groove structure is same as a direction of a tangent line of the third groove structure at a boundary between the one second groove structure and the third groove structure.

[Supplementary Note A14]

The blade member according to Supplementary Notes A12 or A13, wherein a plurality of third groove structures are formed, at least one of the plurality of third groove structures extends along the third direction, at least other one of the plurality of third groove structures extends along a fourth direction that is different from the third direction.

[Supplementary Note A15]

The blade member according to any one of Supplementary Notes A12 to A14, wherein an amplitude cycle of the third wavy shape varies depending on a position thereof along the third direction.

[Supplementary Note A16]

The blade member according to any one of Supplementary Notes A12 to A15, wherein an amplitude cycle of the third wavy shape is fixed regardless of a position thereof along the third direction.

[Supplementary Note A17]

The blade member according to any one of Supplementary Notes A12 to A16, wherein the third groove structure extends along a direction intersecting with the first and second directions.

[Supplementary Note A18]

The blade member according to any one of Supplementary Notes A12 to A17, wherein the third groove structure extends along a direction parallel to the first and second directions.

[Supplementary Note A19]

The blade member according to any one of Supplementary Notes A12 to A18, wherein an amplitude of the third wavy shape varies depending on a position thereof along the third direction.

[Supplementary Note A20]

The blade member according to any one of Supplementary Notes A12 to A19, wherein an amplitude of the third wavy shape is fixed regardless of a position thereof along the third direction.

[Supplementary Note A21]

A blade member on a surface of which a groove structure is formed, wherein the blade member comprises:

a first area in which a groove structure extending in a first direction is formed;

a second area in which the groove structure is not formed; and a third area which is located between the first area and the second area and in which a groove structure connected to the groove structure in the first area is formed, a depth of the groove structure formed in the third area is shallower as it is closer to the second area from the first area.

[Supplementary Note A22]

The blade member according to Supplementary Note A21, wherein the depth of the groove structure formed in the third area is shallower in a continuous manner as it is closer to the second area from the first area along the first direction.

[Supplementary Note A23]

The blade member according to Supplementary Notes A21 or A22, wherein the depth of the groove structure formed in the third area is shallower in a stepwise manner as it is closer to the second area from the first area along the first direction.

[Supplementary Note A24]

The blade member according to any one of Supplementary Notes A21 to A23, wherein a depth of the groove structure at an edge part of the first area is same as the depth of the groove structure at an edge part of the third area that is connected to the edge part of the first area.

[Supplementary Note A25]

The blade member according to any one of Supplementary Notes A21 to A24, wherein a height of an edge part of the third area that is connected to the second area is same as a height of an edge part of the second area that is connected to the third area.

[Supplementary Note A26]

The blade member according to any one of Supplementary Notes A21 to A25, wherein the groove structure including two grooves, which are arranged along a second direction intersecting with the first direction to form at least one of a protrusion-shape, a convex-shape, and a mountain-shape, is formed in the first area.

[Supplementary Note A27]

The blade member according to any one of Supplementary Notes A21 to A26, wherein the groove structure including two grooves, which are arranged along a second direction intersecting with the first direction to form at least one of a protrusion-shape, a convex-shape, and a mountain-shape, is formed in at least a part of the third area.

[Supplementary Note A28]

The blade member according to Supplementary Notes A26 or A27, wherein a depth of the groove represents a position of a bottom of the groove relative to a peak of at least one of the protrusion-shape, the convex-shape, and the mountain-shape.

[Supplementary Note A29]

A structural member on a surface of which a groove structure is formed, wherein the groove structure includes a plurality of first groove structures, a plurality of second groove structures, and a third groove structure, the plurality of first groove structures are formed to extend in a first direction, the plurality of second groove structures are formed to extend in a second direction that is different from the first direction.

the third groove structure extends along a third direction and is formed between one first groove structure of the plurality of first groove structures and one second groove structure of the plurality of second groove structures.

[Supplementary Note A30]

The structural member according to Supplementary Note A29, wherein a plurality of third groove structures are formed, directions along which at least two of the plurality of third groove structures extend, respectively, are parallel to each other.

[Supplementary Note A31]

The structural member according to Supplementary Notes A29 or A30, wherein the first direction is same as the second direction.

[Supplementary Note A32]

The structural member according to any one of Supplementary Notes A29 to A31, wherein an arrangement pitch of the first groove structures is same as an arrangement pitch of the second groove structures.

[Supplementary Note A33]

The structural member according to any one of Supplementary Notes A29 to A32, wherein the first direction is a direction along which a streamline in the first area of the surface, in which the plurality of first groove structures are formed, extends, the second direction is a direction along which a streamline in the second area of the surface, in which the plurality of second groove structures are formed, extends.

[Supplementary Note A34]

The structural member according to any one of Supplementary Notes A29 to A33, wherein a structure having at least one of a protrusion-shape, a convex-shape, and a mountain-shape is included between adjacent two among the plurality of first groove structures, the plurality of second groove structures, and the third groove structure.

[Supplementary Note A35]

A structural member on a surface of which a groove structure is formed, wherein the groove structure includes a plurality of first groove structures, a plurality of second groove structures, and a third groove structure, the plurality of first groove structures have a first wavy shape extending in a first direction and are formed to be arranged along a direction intersecting with the first direction at a first arrangement pitch, the plurality of second groove structures have a second wavy shape extending in a second direction and are formed to be arranged along a direction intersecting with the second direction at a second arrangement pitch, the third groove structure has a third wavy shape extending in a third direction and is formed between one first groove structure of the plurality of first groove structures and one second groove structure of the plurality of second groove structures.

[Supplementary Note A36]

A structural member on a surface of which a groove structure is formed, wherein the groove structure includes a plurality of first groove structures, a plurality of second groove structures, and a third groove structure, the plurality of first groove structures have a first wavy shape extending in a first direction and are formed to be arranged along a direction intersecting with the first direction at a first arrangement pitch, the plurality of second groove structures extend in a second direction and are formed to be arranged along a direction intersecting with the second direction at a second arrangement pitch, the third groove structure has a third wavy shape extending in a third direction and is formed between one first groove structure of the plurality of first groove structures and one second groove structure of the plurality of second groove structures.

[Supplementary Note A37]

The structural member according to Supplementary Note A36, wherein an edge part of the one second groove structure and an edge part of the third groove structure are located at the same position along a direction intersecting with the second direction at a boundary between the one second groove structure and the third groove structure.

[Supplementary Note A38]

The structural member according to Supplementary Notes A36 or A37, wherein the one second groove structure linearly extend along the second direction.

[Supplementary Note A39]

The structural member according to any one of Supplementary Notes A36 to A38, wherein an amplitude of the third wavy shape is smaller as the third groove structure is closer to a boundary between the first second groove structure and the third groove structure.

[Supplementary Note A40]

The structural member according to Supplementary Note A39, wherein the one first groove structure and the third groove structure are connected to each other so that a direction of a tangent line of the one first groove structure is same as a direction of a tangent line of the third groove structure at a boundary between the one first groove structure and the third groove structure, the one second groove structure and the third groove structure are connected to each other so that a direction of a tangent line of the one second groove structure is same as a direction of a tangent line of the third groove structure at a boundary between the one second groove structure and the third groove structure.

[Supplementary Note A41]

The structural member according to Supplementary Note A35, wherein an amplitude cycle of the third wavy shape varies depending on a position thereof along the third direction.

[Supplementary Note A42]

The structural member according to any one of Supplementary Notes A35 to A41, wherein an amplitude cycle of the third wavy shape is fixed regardless of a position thereof along the third direction.

[Supplementary Note A43]

The structural member according to any one of Supplementary Notes A35 to A42, wherein an amplitude of the third wavy shape varies depending on a position thereof along the third direction.

[Supplementary Note A44]

The structural member according to Supplementary Note A35, wherein an amplitude of the third wavy shape is fixed regardless of a position thereof along the third direction.

[Supplementary Note A45]

The structural member according to any one of Supplementary Notes A35 to A44, wherein the third groove structure extends along a direction intersecting with the first and second directions.

[Supplementary Note A46]

The structural member according to any one of Supplementary Notes A35 to A45, wherein the third groove structure extends along a direction parallel to the first and second directions.

[Supplementary Note A47]

A structural member on a surface of which a groove structure is formed, wherein the structural member comprises:

a first area in which a groove structure extending in a first direction is formed, a second area in which the groove structure is not formed; and a third area which is located between the first area and the second area and in which a groove structure connected to the groove structure in the first area is formed, a depth of the groove structure formed in the third area is shallower as it is closer to the second area from the first area.

The features of each example embodiment described above may be appropriately combined with each other. A part of the features of each example embodiment described above may not be used. The features of each example embodiment described above may be appropriately replaced by the features of another example embodiment. Moreover, the disclosures of all publications and United States patents related to an apparatus and the like cited in each embodiment described above are incorporated in the disclosures of the present application by reference if it is legally permitted.

The present invention is not limited to the above described examples and is allowed to be changed, if desired, without departing from the essence or spirit of the invention which can be read from the claims and the entire specification, and a blade member, a structural member, a processing system and a processing method, which involve such changes, are also intended to be within the technical scope of the present invention.

DESCRIPTION OF REFERENCE CODES

1 processing apparatus
3 control apparatus
8 land structure
9 groove structure
EL processing light
SYS processing system
W workpiece
BL turbine blade
RB riblet structure
RL riblet line

The invention claimed is:

1. A turbine blade comprising:

a surface; and a groove structure that is formed on the surface, wherein the groove structure includes a plurality of first groove structures, a plurality of second groove structures, and a third groove structure, the plurality of first groove structures extend linearly in a first direction, the plurality of second groove structures extend linearly in a second direction that is different from the first direction, the third groove structure extends linearly along a third direction that is different from the first and second directions, and is directly connected to (i) one first groove structure of the plurality of first groove structures and (ii) one second groove structure of the plurality of second groove structures, the first direction is substantially the same as a flow direction of fluid on a first part of the surface, the plurality of first groove structures being formed on the first part of the surface, and the second direction is substantially the same as a flow direction of fluid on a second part of the surface, the plurality of second groove structures being formed on the second part of the surface.

2. The turbine blade according to claim 1, wherein each of a first angle and a second angle is larger than a third angle, the first angle corresponds to a larger angle of angles between a first axis extending along the first direction and a third axis extending along the third direction, the second angle corresponds to a larger angle of angles between a second axis extending along the second direction and the third axis, the third angle corresponds to a larger angle of angles between the first axis and the second axis.

3. The turbine blade according to claim 2, wherein a sum of the first angle and the second angle is an angle obtained by adding 180 degrees to the third angle.

4. The turbine blade according to claim 1, wherein a plurality of third groove structures are formed, at least two of the plurality of third groove structures extend along the third direction.

5. The turbine blade according to claim 1, wherein the plurality of first groove structures are parallel to each other, the plurality of second groove structures are parallel to each other.

6. The turbine blade according to claim 5, wherein a plurality of third groove structures are formed, an arrangement pitch of the plurality of third groove structures is constant regardless of a position thereof along the third direction.

7. The turbine blade according to claim 1, wherein a plurality of third groove structures are formed, at least one of the plurality of third groove structures extends along the third direction, at least other one of the plurality of third groove structures extends along a fourth direction that is different from the third direction.

8. The turbine blade according to claim 7, wherein an arrangement pitch of the plurality of third groove structures varies depending on a position thereof.

9. The turbine blade according to claim 1, wherein an arrangement pitch of the plurality of first groove structures is different from an arrangement pitch of the plurality of second groove structures.

10. The turbine blade according to claim 1, wherein a plurality of third groove structures are formed, an arrangement pitch of two of the plurality of first groove structures connected to at least two of the plurality of third groove structures is different from an arrangement pitch of two of the plurality of second groove structures connected to the at least two of the plurality of third groove structures.

11. The turbine blade according to claim 1, wherein a structure having at least one of a protrusion-shape, and a convex-shape is included between adjacent two among the plurality of first groove structures, the plurality of second groove structures, and the third groove structure.

12. The turbine blade according to claim 1, wherein:

a first land structure is formed between the plurality of first groove structures, an arrangement pitch of the first land structure is substantially equal to an arrangement pitch of the plurality of first groove structures, a second land structure is formed between the plurality of second groove structures, and an arrangement pitch of the second land structure is substantially equal to an arrangement pitch of the plurality of second groove structures.

13. A turbine blade comprising:

a surface; and a groove structure that is formed on the surface, wherein the groove structure includes a plurality of first groove structures, a plurality of second groove structures, and a third groove structure, the plurality of first groove structures extend linearly in a first direction, the plurality of second groove structures extend linearly in a second direction that is different from the first direction, the third groove structure extends linearly along a third direction that is different from the first and second directions, and is directly connected to (i) one first groove structure of the plurality of first groove structures and (ii) one second groove structure of the plurality of second groove structures, and an arrangement pitch of the plurality of first groove structures is different from an arrangement pitch of the plurality of second groove structures.

14. A turbine blade comprising:

a surface; and a groove structure that is formed on the surface, wherein the groove structure includes a plurality of first groove structures, a plurality of second groove structures, and a plurality of third groove structures, the plurality of first groove structures extend linearly in a first direction, the plurality of second groove structures extend linearly in a second direction that is different from the first direction, at least one of the plurality of third groove structures extends linearly along a third direction that is different from the first and second directions, and is directly connected to (i) one first groove structure of the plurality of first groove structures and (ii) one second groove structure of the plurality of second groove structures, and an arrangement pitch of the plurality of third groove structures varies depending on a position thereof.

* * * * *